US007054587B2

(12) United States Patent
Sohmiya et al.

(10) Patent No.: US 7,054,587 B2
(45) Date of Patent: May 30, 2006

(54) IMAGE FORMING APPARATUS FOR RECORDING ON TWO SIDES IN A SINGLE PASS

(75) Inventors: Norimasa Sohmiya, Saitama (JP); Kenichi Taguma, Chiba (JP); Chiemi Kaneko, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/872,687

(22) Filed: Jun. 22, 2004

(65) Prior Publication Data

US 2005/0031384 A1 Feb. 10, 2005

(30) Foreign Application Priority Data

Jun. 23, 2003 (JP) ..... 2003-178262
Jun. 30, 2003 (JP) ..... 2003-186665
Jun. 30, 2003 (JP) ..... 2003-186667
Jun. 30, 2003 (JP) ..... 2003-186668
Aug. 1, 2003 (JP) ..... 2003-285477

(51) Int. Cl.
*G03G 15/20* (2006.01)

(52) U.S. Cl. ..... 399/309

(58) Field of Classification Search ..... 399/107, 399/121, 297, 298, 299, 302, 306, 308, 309
See application file for complete search history.

(56) References Cited

U.S. PATENT DOCUMENTS 4,032,463 A 6/1977 Kawanishi et al.
4,538,901 A 9/1985 Soumiya
4,962,394 A 10/1990 Sohmiya et al.
5,006,896 A 4/1991 Koichi et al.
5,038,175 A 8/1991 Sohmiya et al.
5,070,369 A * 12/1991 Mahoney et al. ..... 399/301
5,357,330 A * 10/1994 Hauser ..... 399/302
5,394,231 A 2/1995 Sudo et al.
5,499,078 A 3/1996 Kurokawa et al.
5,559,590 A 9/1996 Arai et al.
5,570,162 A 10/1996 Sohmiya
5,619,311 A 4/1997 Kurokawa et al.
5,797,077 A * 8/1998 Samizo et al. ..... 399/309
6,061,543 A * 5/2000 Kayahara et al. ..... 399/302
6,085,058 A * 7/2000 Goto et al. ..... 399/313
6,173,148 B1 1/2001 Matsuda et al.
6,175,712 B1 * 1/2001 Masuda et al. ..... 399/302

(Continued)

FOREIGN PATENT DOCUMENTS

JP 1-209470 8/1989

(Continued)

*Primary Examiner*—Hoan Tran
(74) *Attorney, Agent, or Firm*—Oblon, Spivak, McClelland, Maier & Neustadt, P.C.

(57) ABSTRACT

An image forming apparatus for recording on two sides in a single pass, with which the transfer of a toner image onto one side of a recording medium and the transfer of a toner image onto the other side can both be performed under optimal conditions, which results in an increase in image quality. Contact-type transfer rollers are used as secondary and tertiary transfer means, so unlike with a transfer charger (a non-contact type of transfer means), there is no discharge product. A toner image that has been once transferred from an image support onto a recording medium is prevented from being retransferred back onto the image support, and a toner image that has been transferred onto the recording medium by the action of a first transfer member is prevented from being retransferred to the image support when a toner image is transferred onto the recording medium by the action of a second transfer member.

63 Claims, 22 Drawing Sheets

U.S. PATENT DOCUMENTS 6,246,856 B1 * 6/2001 Kopp et al. ..... 399/299
6,345,167 B1 * 2/2002 Bean ..... 399/302
6,347,214 B1 2/2002 Kaneko
6,556,804 B1 * 4/2003 Lobel et al. ..... 399/306
6,574,448 B1 6/2003 Mochimaru et al.
6,643,489 B1 11/2003 Omata et al.
6,728,505 B1 4/2004 Omata et al.
6,745,002 B1 * 6/2004 Nakashima et al. ..... 399/307

FOREIGN PATENT DOCUMENTS

JP 3-253881 11/1991
JP 2000-105513 4/2000

* cited by examiner

IMAGE FORMING APPARATUS FOR RECORDING ON TWO SIDES IN A SINGLE PASS

BACKGROUND OF THE INVENTION

1. Field of the Invention

The present invention relates to an image forming apparatus for recording on two sides in a single pass, with which a toner image can be formed on both sides of a recording medium in a single paper pass.

2. Description of the Related Art

Some known copiers, printers, facsimile devices, and other such image forming apparatus are designed with a two-side recording function, whereby images are formed on both sides of a recording medium such as paper. With such conventional image forming apparatus capable of recording on two sides, the standard approach is to employ a system whereby the image (visualized image such as toner image) from one side of an original formed on an image support such as a photosensitive member is first transferred to and fixed on the surface of paper, and then this paper is turned over by an inversion path or the like and fed through the machine again, so that the image (visualized image) on the other side of the original is transferred to and fixed on the back side of the paper. With this system, however, it is impossible to ensure adequate reliability of paper conveyance because the paper conveyance direction has to be switched, because paper curling occurs during the fixing of the image on side, and for other such reasons.

One known way to deal with this situation is to transfer and form toner images onto both sides of the paper in a single paper pass, that is, use an image forming apparatus capable of recording on two sides in a single pass. Such apparatus have been proposed, for example, in Japanese Patent No. 2,906,538 and Japanese Laid-Open Patent Application No. 2000-105513.

Nevertheless, with the image forming apparatus disclosed in the above-mentioned Japanese Patent No. 2,906,538, the polarity is switched for one of the two sides' worth of toner images formed on the photosensitive member (that is, enough for the front and back of the recording medium). This switching of the toner image polarity requires the provision of a polarity switching means such as an opposite-polarity corona charging means, which makes the structure that much more complicated. Also, with the image forming apparatus disclosed in Japanese Laid-Open Patent Application No. 2000-105513, two types of toner with different polarity are readied, the toner image on side is formed with one toner, and the toner image on the other side is formed with the other toner of different polarity. Consequently, this image forming apparatus requires two developing apparatus for holding two types of toner of different polarity, which again makes the structure that much more complicated.

In addition, Japanese Laid-Open Patent Application No. H1-209470 (pp. 2–3, FIG. 1) has disclosed an image forming apparatus having first and second image supports for forming toner images on the surfaces thereof, which is constituted such that the toner images formed on these first and second image supports are each transferred to the one or the other side of the recording medium to obtain recorded images. With this image forming apparatus, first and second transfer members are provided along a contact component where the first and second image supports come into contact, with the first transfer member being disposed further upstream in the movement direction of the first and second image supports than the second transfer member. The recording medium is fed in between the first and second image supports, which are in contact with each other, the toner image on the first image support is electrostatically transferred onto one side of the recording medium by the action of one of the first and second transfer members, and the toner image on the second image support is electrostatically transferred onto the other side of the recording medium by the action of the other transfer member. With a constitution such as this, the toner images can be transferred onto either side of the recording medium by passing the recording medium between the contact components of the first and second image supports.

With this image forming apparatus, however, there is the possibility that the toner image electrostatically transferred to one side or the other of the recording medium by the first transfer member will be electrostatically retransferred back to the image support side when the toner image is transferred to one side or the other of the recording medium by the second transfer member, and this can result in degradation of the quality of the recorded image formed on the recording medium.

Technologies relating to the present invention are also disclosed in, e.g., Japanese Laid-open Patent Application No. H3-253881.

SUMMARY OF THE INVENTION

It is an object of the present invention to provide an image forming apparatus for recording on two sides in a single pass, with which the transfer of a toner image onto one side of a recording medium and the transfer of a toner image onto the other side can both be performed under optimal conditions, which results in an increase in image quality.

It is another object of the present invention to provide an image forming apparatus for recording on two sides in a single pass, with which a toner image that has already been transferred from an image support onto a recording medium is prevented from being retransferred back onto the image support, which results in an increase in image quality. It is another object of the present invention to provide an image forming apparatus for recording on two sides in a single pass, with which the quality of a formed image can be increased by a simple constitution.

It is another object of the present invention to provide an image forming apparatus for recording on two sides in a single pass, which effectively suppresses the problem of a toner image that has been transferred onto a transfer method by the action of a first transfer member being retransferred to the image support when a toner image is transferred onto the recording medium by the action of a second transfer member, allowing high-quality images to be obtained on both sides.

It is another object of the present invention to provide an image forming apparatus for recording on two sides in a single pass, with which contact-type transfer rollers are used as secondary and tertiary transfer means, which increases transfer performance and results in higher image quality through more stable image transfer.

In an aspect of the present invention, a transfer method comprises the steps of moving a first image support for supporting a toner image and a second image support for supporting a toner image in the same direction and at the same speed within a contact region in which the image support sides of the two image supports come into contact, conveying a recording medium sandwiched between the two image supports within the contact region, using a first transfer member disposed upstream in the movement direction of the image supports within the contact region to transfer a toner image supported on one of the image supports to one side of the recording medium conveyed within the contact region, and using a second transfer member disposed downstream in the movement direction of the image supports within the contact region to transfer a toner image supported on the other image support to the other side of the recording medium conveyed within the contact region.

In another aspect of the present invention, a transfer apparatus comprises a first image support that moves while supporting a toner image on an image support side, a second image support that moves while supporting a toner image on an image support side, a contact region in which the image support sides of the two image supports come into contact and a recording medium is conveyed in between these image support sides, a first transfer member that is disposed upstream in the movement direction of the image supports within the contact region, and that transfers the toner image supported on one of the image supports to one side of the recording medium conveyed within the contact region, and a second transfer member that is disposed downstream in the movement direction of the image supports within the contact region, and that transfers the toner image supported on the other image support to the other side of the recording medium conveyed within the contact region. At least one of the two image supports is a belt image support, and the transfer member is disposed within a belt loop of the belt image support.

In another aspect of the present invention, an image forming apparatus comprises an imaging component for producing a toner image, a transfer apparatus for transferring toner images produced by the imaging component to both sides of a recording medium, and a fixing apparatus for fixing the toner images transferred to the recording medium. The transfer apparatus comprises a first image support that moves while supporting a toner image on an image support side, a second image support that moves while supporting a toner image on an image support side, a contact region in which the image support sides of the two image supports come into contact and a recording medium is conveyed in between these image support sides, a first transfer member that is disposed upstream in the movement direction of the image supports within the contact region, and that transfers the toner image supported on one of the image supports to one side of the recording medium conveyed within the contact region, and a second transfer member that is disposed downstream in the movement direction of the image supports within the contact region, and that transfers the toner image supported on the other image support to the other side of the recording medium conveyed within the contact region. At least one of the two image supports is a belt image support, and the transfer member is disposed within a belt loop of the belt image support.

In another aspect of the present invention, an image forming apparatus comprises a first image support that moves while supporting a toner image on an image support side, a second image support that moves while supporting a toner image on an image support side, a contact region in which the image support side of the first image support and the image support side of the second image support come into contact and a recording medium having toner images transferred onto both sides thereof is conveyed in between these image support sides, two electroconductive rollers disposed upstream and downstream in the movement direction of the first image support and in contact with the side of the first image support opposite the image support side within the contact region, andtwo electroconductive rollers disposed upstream and downstream in the movement direction of the second image support and in contact with the side of the second image support opposite the image support side within the contact region. The two electroconductive rollers on the first image support side and the two electroconductive rollers on the second image support side sandwich the first image support and the second image support and thereby forming an upstream nip and a downstream nip. In the pair of electroconductive rollers forming the upstream nip and the pair of electroconductive rollers forming the downstream nip, one electroconductive roller in each pair serves as an application roller to which transfer current is applied, and the other electroconductive roller serves as a ground roller. The absolute value of the transfer current applied to the application roller located in the upstream nip is set to be equal to or greater than the absolute value of the transfer current applied to the application roller located in the downstream nip.

In another aspect of the present invention, an image forming apparatus comprises a first image support that moves while supporting a toner image on an image support side, a second image support that moves while supporting a toner image on an image support side, a contact region in which the image support side of the first image support and the image support side of the second image support come into contact and a recording medium having toner images transferred onto both sides thereof is conveyed in between these image support sides, two electroconductive rollers disposed upstream and downstream in the movement direction of the first image support and in contact with the side of the first image support opposite the image support side within the contact region, andtwo electroconductive rollers disposed upstream and downstream in the movement direction of the second image support and in contact with the side of the second image support opposite the image support side within the contact region. The two electroconductive rollers on the first image support side and the two electroconductive rollers on the second image support side sandwich the first image support and the second image support and thereby forming an upstream nip and a downstream nip.

In the pair of electroconductive rollers forming the upstream nip and the pair of electroconductive rollers forming the downstream nip, one electroconductive roller in each pair serves as an application roller to which transfer current is applied, and the other electroconductive roller serves as a ground roller. The nip width of the upstream nip is set to be equal to or greater than the nip width of the downstream nip.

In another aspect of the present invention, an image forming apparatus comprises a first image support that moves while supporting a toner image on an image support side, a second image support that moves while supporting a toner image on an image support side, a contact region in which the image support side of the first image support and the image support side of the second image support come into contact and a recording medium having toner images transferred onto both sides thereof is conveyed in between these image support sides, two electroconductive rollers disposed upstream and downstream in the movement direction of the first image support and in contact with the side of the first image support opposite the image support side within the contact region, andtwo electroconductive rollers disposed upstream and downstream in the movement direction of the second image support and in contact with the side of the second image support opposite the image support side within the contact region. The two electroconductive rollers on the first image support side and the two electroconductive rollers on the second image support side sandwich the first image support and the second image support and thereby forming an upstream nip and a downstream nip. In the pair of electroconductive rollers forming the upstream nip and the pair of electroconductive rollers forming the downstream nip, one electroconductive roller in each pair serves as an application roller to which transfer current is applied, and the other electroconductive roller serves as a ground roller. The transfer pressure of the upstream nip is set to be equal to or greater than the transfer pressure of the downstream nip.

In another aspect of the present invention, an image forming apparatus comprises a first image support that moves while supporting a toner image on an image support side, a second image support that moves while supporting a toner image on an image support side, a contact region in which the image support side of the first image support and the image support side of the second image support come into contact and a recording medium having toner images transferred onto both sides thereof is conveyed in between these image support sides, two electroconductive rollers disposed upstream and downstream in the movement direction of the first image support and in contact with the side of the first image support opposite the image support side within the contact region, and two electroconductive rollers disposed upstream and downstream in the movement direction of the second image support and in contact with the side of the second image support opposite the image support side within the contact region. The two electroconductive rollers on the first image support side and the two electroconductive rollers on the second image support side sandwich the first image support and the second image support and thereby forming an upstream nip and a downstream nip. In the pair of electroconductive rollers forming the upstream nip and the pair of electroconductive rollers forming the downstream nip, one electroconductive roller in each pair serves as an application roller to which transfer current is applied, and the other electroconductive roller serves as a ground roller. The hardness of the pair of electroconductive rollers that form the upstream nip is set to be equal to or greater than the hardness of the pair of electroconductive rollers that form the downstream nip.

In another aspect of the present invention, an image forming apparatus comprises a first image support that moves while supporting a toner image on an image support side, a second image support that moves while supporting a toner image on an image support side, a contact region in which the image support side of the first image support and the image support side of the second image support come into contact and a recording medium having toner images transferred onto both sides thereof is conveyed in between these image support sides, two electroconductive rollers disposed upstream and downstream in the movement direction of the first image support and in contact with the side of the first image support opposite the image support side within the contact region, and two electroconductive rollers disposed upstream and downstream in the movement direction of the second image support and in contact with the side of the second image support opposite the image support side within the contact region. The two electroconductive rollers on the first image support side and the two electroconductive rollers on the second image support side sandwich the first image support and the second image support and thereby forming an upstream nip and a downstream nip. In the pair of electroconductive rollers forming the upstream nip and the pair of electroconductive rollers forming the downstream nip, one electroconductive roller in each pair serves as an application roller to which transfer current is applied, and the other electroconductive roller serves as a ground roller. The timing at which the transfer current is applied to the two upstream and downstream application rollers is either when or before the front end of the recording medium reaches the upstream nip.

In another aspect of the present invention, an image forming apparatus comprises a first image support that moves while supporting a toner image on an image support side, a second image support that moves while supporting a toner image on an image support side, a contact region in which the image support side of the first image support and the image support side of the second image support come into contact and a recording medium having toner images transferred onto both sides thereof is conveyed in between these image support sides, two electroconductive rollers disposed upstream and downstream in the movement direction of the first image support and in contact with the side of the first image support opposite the image support side within the contact region, and two electroconductive rollers disposed upstream and downstream in the movement direction of the second image support and in contact with the side of the second image support opposite the image support side within the contact region. The two electroconductive rollers on the first image support side and the two electroconductive rollers on the second image support side sandwich the first image support and the second image support and thereby forming an upstream nip and a downstream nip. In the pair of electroconductive rollers forming the upstream nip and the pair of electroconductive rollers forming the downstream nip, one electroconductive roller in each pair serves as an application roller to which transfer current is applied, and the other electroconductive roller serves as a ground roller. The timing at which application of the transfer current to the two upstream and downstream application rollers is stopped is after the rear end of the recording medium has passed through the downstream nip.

In another aspect of the present invention, an image forming apparatus comprises a first image support that moves while supporting a toner image on an image support side, a second image support that moves while supporting a toner image on an image support side, a contact region in which the image support side of the first image support and the image support side of the second image support come into contact and a recording medium having toner images transferred onto both sides thereof is conveyed in between these image support sides, two electroconductive rollers disposed upstream and downstream in the movement direction of the first image support and in contact with the side of the first image support opposite the image support side within the contact region, and two electroconductive rollers disposed upstream and downstream in the movement direction of the second image support and in contact with the side of the second image support opposite the image support side within the contact region. The two electroconductive rollers on the first image support side and the two electroconductive rollers on the second image support side sandwich the first image support and the second image support and thereby forming an upstream nip and a downstream nip. In the pair of electroconductive rollers forming the upstream nip and the pair of electroconductive rollers forming the downstream nip, one electroconductive roller in each pair serves as an application roller to which transfer current is applied, and the other electroconductive roller serves as a ground roller. At least one of the application rollers is left on after the rear end of the recording medium has passed through the downstream nip and until the front end of the recording medium reaches the nip on the fixing apparatus side.

In another aspect of the present invention, an image forming apparatus for recording images on both sides of a recording medium comprises first and second image supports on the surfaces of which are formed toner images, the toner image formed on each of said first and second image supports being transferred to one side or the other of a recording medium, and first and second transfer members disposed along a contact component in contact with the first and second image supports. The first transfer member is located further upstream in the movement direction of the first and second image supports than the second transfer member. The toner image formed on the surface of the first image support is transferred by the action of one of the first and second transfer members onto one side of a recording medium fed in between the first and second image supports in contact with each other. The toner image formed on the surface of the second image support is transferred by the action of the other of the first and second transfer members onto the other side of the recording medium fed in between the first and second image supports in contact with each other. The toner image transfer conditions is set such that if we let E(U) be the transfer electric field formed by the first transfer member, q1 be the amount of toner charge per unit of volume of the toner image transferred by the action of the first transfer member, E(D) be the transfer electric field formed by the second transfer member, and q2 be the amount of toner charge per unit of volume of the toner image transferred by the action of the second transfer member. The absolute values of the forces at which the toner images are transferred onto the recording medium are expressed by $F(U)=q1\times E(U)$ and $F(D)=q2\times E(D)$, are such that $F(U)\geqq F(D)$.

In another aspect of the present invention, an image forming apparatus for recording images on both sides of a recording medium comprises an image support, and first and second intermediate transfer members, a visualized image temporarily transferred from the image support via the first intermediate transfer member onto the second intermediate transfer member being transferred from the second intermediate transfer member onto one side of a recording medium, and a visualized image transferred from the image support onto the first intermediate transfer member being transferred from the first intermediate transfer member onto the other side of the recording medium, a first transfer roller for transferring the visualized image on the first intermediate transfer member onto one side of the recording medium or the second intermediate transfer member being disposed inside the first intermediate transfer member or second intermediate transfer member, and a second transfer roller for transferring the visualized image on the second intermediate transfer member onto the other side of the recording medium being disposed inside the first intermediate transfer member or second intermediate transfer member, first and second opposing rollers being disposed sandwiching the first and second intermediate transfer members and in pressure contact facing the respective transfer rollers, and an elastic layer with a thickness of 5 mm or less being provided on the top layer of each of the transfer rollers, the hardness of said transfer rollers being no more than 50 degrees as JIS-A hardness, and the hardness of said transfer rollers being lower than the hardness of the opposing rollers.

In another aspect of the present invention, an image forming apparatus for recording images on both sides of a recording medium comprises an image support, and first and second intermediate transfer members onto which a visualized image is transferred from said image support, the visualized images supported on each of the first and second intermediate transfer members being transferred to the respective sides of a recording medium, a first transfer roller that transfers the visualized image on the first intermediate transfer member onto one side of the recording medium being disposed inside the first intermediate transfer member or the second intermediate transfer member, and a second transfer roller that transfers the visualized image on the second intermediate transfer member onto the other side of the recording medium being disposed inside the second intermediate transfer member or the first intermediate transfer member, first and second opposing rollers being disposed sandwiching the first and second intermediate transfer members and in pressure contact facing the respective transfer rollers, and an elastic layer with a thickness of 5 mm or less being provided on the top layer of each of the transfer rollers, the hardness of said transfer rollers being no more than 50 degrees as JIS-A hardness, and the hardness of said transfer rollers being lower than the hardness of the opposing rollers.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

Before describing the present invention, we will describe a conventional image forming apparatus for recording on two sides in a single pass.

Figure 1:
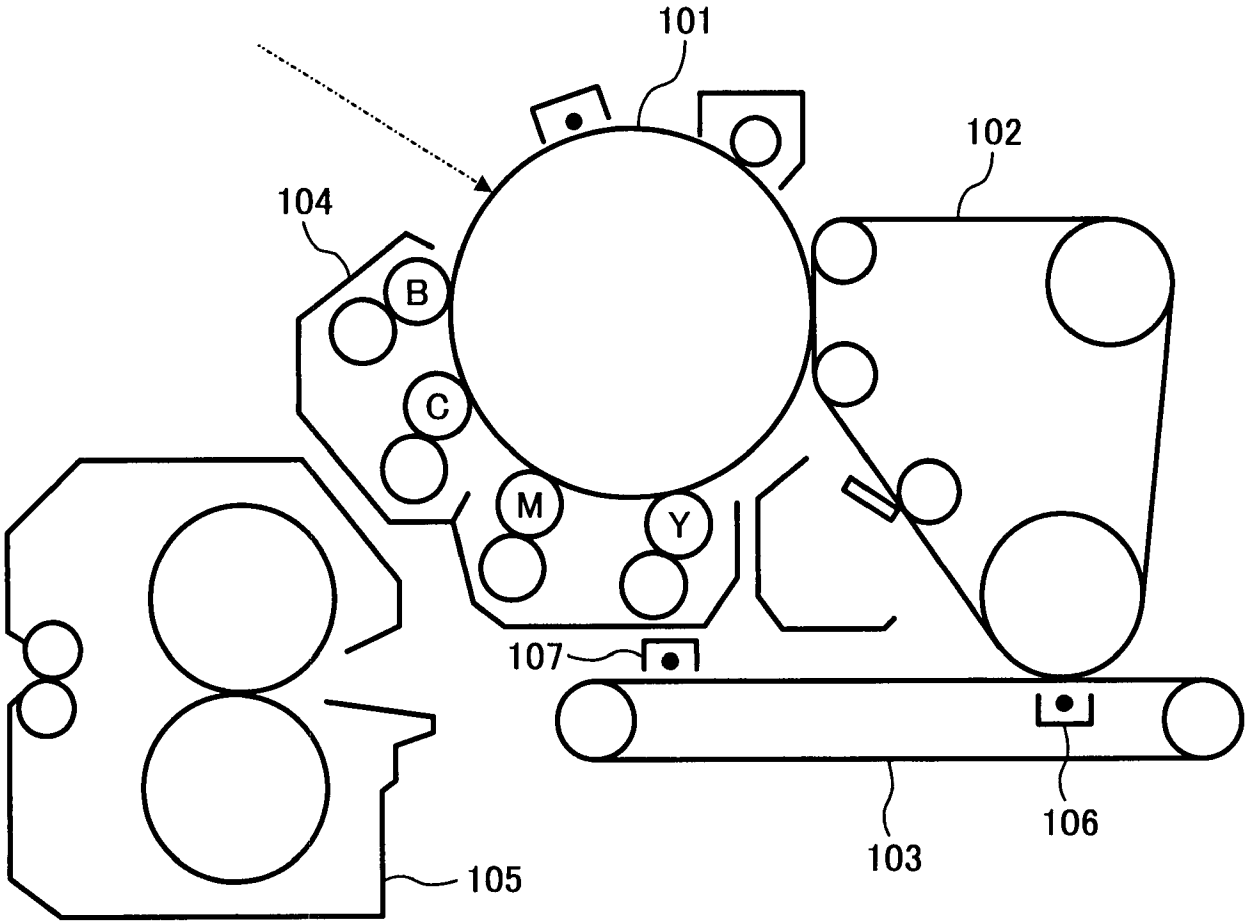
FIG. 1 PRIOR ART
FIG. 1 is a simplified structural diagram of an example of a conventional image forming apparatus for recording on two sides in a single pass.

FIG. 1 shows the simplified structure near the imaging components in an example of a conventional image forming apparatus for recording on two sides in a single pass, equipped with two intermediate transfer members. When two-side printing is performed with this image forming apparatus, the toner image formed on a photosensitive drum 101 (back image) is transferred via a first intermediate transfer belt 102 onto a second intermediate transfer belt 103, and this back image is supported on the second intermediate transfer belt 103 and sent around one rotation of the belt. Next, the toner image that will become the front image is formed on the photosensitive drum 101 so as to be synchronized with the back image formed previously, and this toner image (front image) is transferred onto the first intermediate transfer belt 102. Paper or another such recording medium is then fed out from resist rollers (not shown) at a timing matched to the toner images on the front and back sides, and the toner images are transferred from the first and second intermediate transfer belts 102 and 103 onto both sides of the paper. This allows toner images to be formed on both sides of the paper in a single paper pass, without having to invert the paper.

In the drawings, 104 is a developing apparatus, and 105 is a fixing apparatus.

Here, the transfer of the toner image (the back image in the case of the above-mentioned two-sided printing) from the first intermediate transfer belt 102 to the second intermediate transfer belt 103, and the transfer of the toner image (the front image in the case of the above-mentioned two-sided printing) from the first intermediate transfer belt 102 to the top side of the paper are accomplished by the action of a transfer charger 106 that is a transfer means provided inside the second intermediate transfer belt 103, that is, a secondary transfer means. Meanwhile, the transfer of the toner image (the back image in the case of the above-mentioned of two-sided printing) supported on the second intermediate transfer belt 103 to the bottom side of the paper is accomplished by the action of a transfer charger 107 provided outside the loop of the second intermediate transfer belt 103, that is, a tertiary transfer means.

The above-mentioned secondary transfer means 106 can also be a contact-type of transfer means that comes into contact with the second intermediate transfer belt 103, such as a transfer roller. However, the above-mentioned tertiary transfer means 107 must be a transfer means (transfer charger) that does not come into contact with the second intermediate transfer belt 103 because the unfixed toner image supported on the second intermediate transfer belt 103 passes by the transfer means 107 position, and because the unfixed toner image transferred onto the top side of the paper passes by the transfer means 107 position.

It is commonly known that a problem with transfer chargers is that they generate ozone and other such harmful discharge products during their operation. Also, since the above-mentioned two-side recording involves performing tertiary transfer in a state in which toner rests on the top side of the paper, that is, transfer of the toner image from the second intermediate transfer belt 103 to the bottom side of the paper, the toner on top of the paper scatters according to the electric field of the discharge and fouls the charger, among numerous other problems.

These problems can be dealt with as disclosed in the above-mentioned Japanese Laid-Open Patent Application No. H3-253881, in which a mechanism for switching the polarity of the toner image is provided, and the front and back images are given different polarities, so that the tertiary transfer means is eliminated and the secondary transfer means doubles as a tertiary transfer means, or as disclosed in the above-mentioned Japanese Laid-Open Patent Application No. 2000-105513, in which the tertiary transfer means is eliminated by using toners of different polarity from the outset. Nevertheless, these apparatus have complicated structures and are expensive, and therefore do not represent a fundamental solution. Also, as discussed in the above-mentioned Japanese Laid-Open Patent Application No. 2000-105513, the toner image polarity switching means is a corona charger, which generates ozone and other such harmful discharge products.

In view of this, the above problems are solved with the present invention by using a contact-type of transfer roller for the secondary and tertiary transfer means.

Embodiment of the present invention will now be described in detail.

In all of these embodiments, it is possible for the tertiary transfer means provided on the outside of the second intermediate transfer belt (a conventional second intermediate transfer member) made into be a contact-type transfer roller by disposing it inside the first intermediate transfer belt (first intermediate transfer member). Accordingly, all of the transfer means, from primary transfer to tertiary transfer, can be contact-type transfer means, so no discharge products are generated as would be a transfer charger which is a non-contact transfer means. Also, there no scattering of the toner supported on the second intermediate transfer belt or the toner transferred to the paper, which means that fouling of the members and so forth can be prevented. Furthermore, there is no need for a mechanism for switching the polarity of the toner images and so forth, so the apparatus structure is less complicated, and a simpler structure equates to a lower cost.

First Embodiment

This first embodiment will be described in detail through reference to the drawings.

Figure 2:
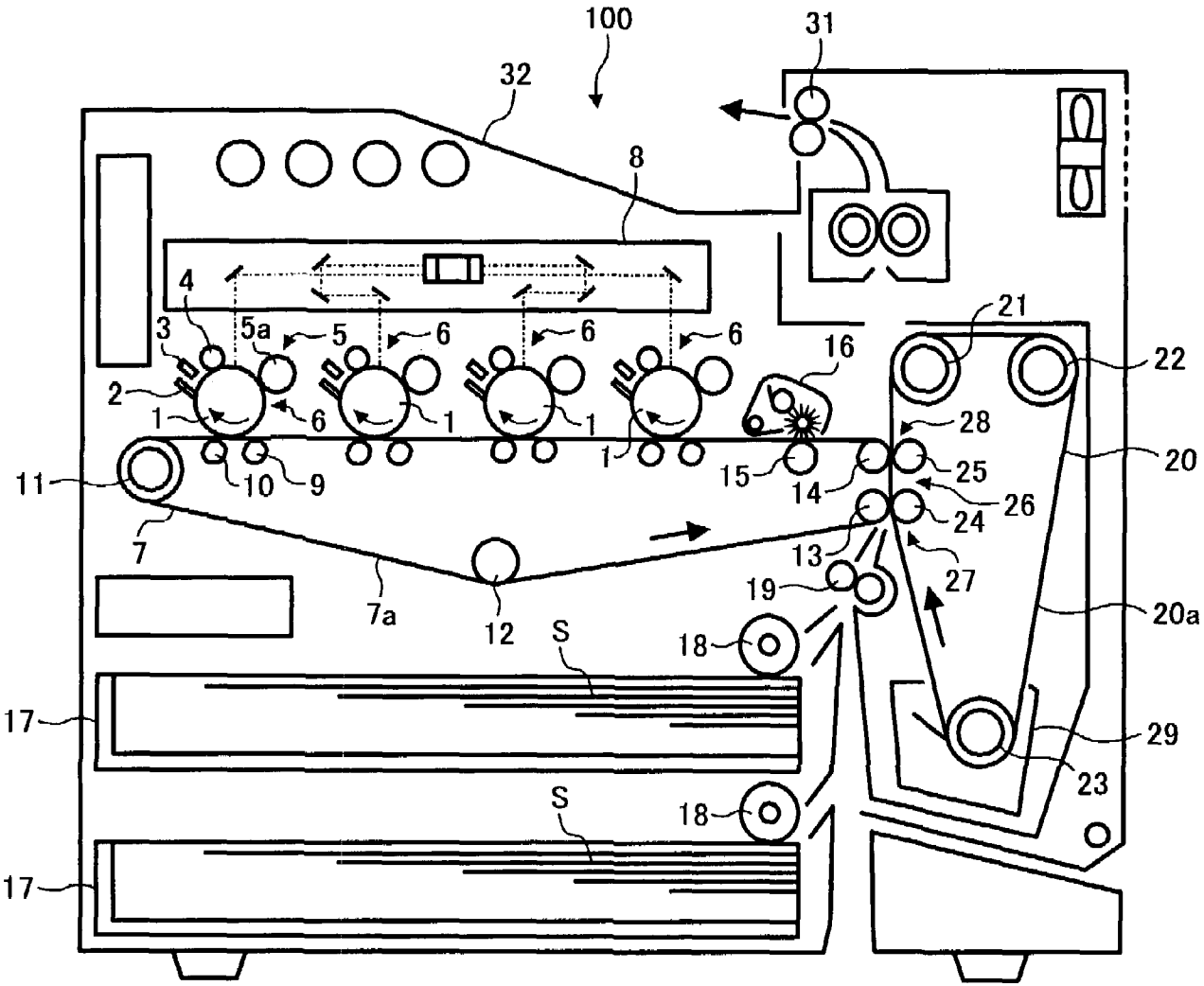
FIG. 2 is a cross section illustrating the simplified structure of a color printer, which is an example of the image forming apparatus pertaining to the first embodiment of the present invention.

FIG. 2 shows the simplified structure of a color printer 100, which is an example of the image forming apparatus in this embodiment. As shown in the drawing, this color printer 100 is what is called a tandem color printer, in which four photosensitive drums 1 are lined up in the approximate center of the apparatus. Each of the photosensitive drums 1 comprises a layer of an organic semiconductor (a photoconductive substance) provided to the surface of an aluminum cylinder with a diameter of about 30 to 100 mm. Photosensitive belts can be employed instead of these photosensitive drums 1, and a photoconductive substance other than an organic semiconductor can also be used.

Figure 3:
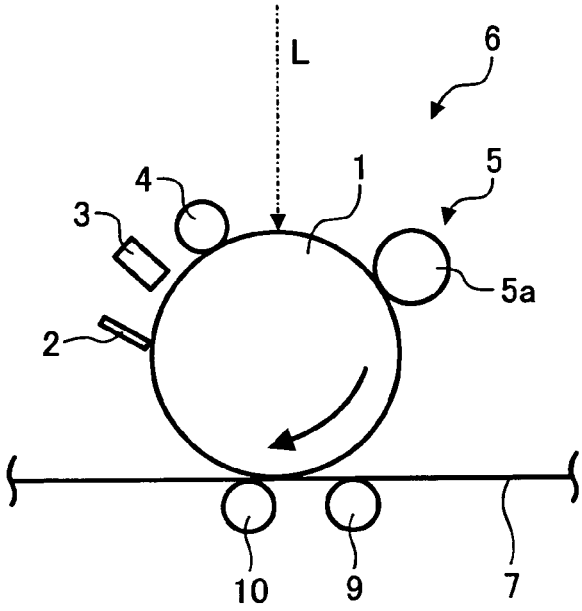
FIG. 3 is an enlarged front view of the structure of the imaging unit of this color printer.

As shown in FIG. 3, a cleaning apparatus 2, a static eliminator 3, a charging apparatus 4, and a developing apparatus 5 are disposed around each of the photosensitive drums 1, constituting an imaging unit 6, which is an imaging component that produces toner images. All of the imaging units 6 have the same structure, the only difference being the color of the toner contained in the developing apparatus 5. A first intermediate transfer belt 7, which is a first image support, is provided under the four imaging units 6, and the four photosensitive drums 1 are lined up in contact with the top of the first intermediate transfer belt 7. An exposure apparatus 8 is disposed above the imaging units 6.

The developing apparatus 5 of each imaging unit 6 has a developing roller 5*a*, contains a cyan, magenta, yellow, or black toner, and provides toner of one of these colors to the electrostatic latent image formed on each photosensitive drum 1.

Between each charging apparatus 4 and developing apparatus 5 is a write location, and the photosensitive drums 1 are irradiated with laser light L emitted from the exposure apparatus 8. The exposure apparatus 8 is a known type of laser, and in this embodiment, color separation is performed and optical information corresponding to the colors of the toner being developed irradiates the surface of the uniformly charged photosensitive drums 1 to create a latent image. An exposure apparatus consisting of an LED array and an imaging means can also be used instead of the exposure apparatus 8. A transfer roller 9 and a back roller 10 are disposed facing each of the photosensitive drums 1 with the first intermediate transfer belt 7 sandwiched therebetween. The toner images formed on the photosensitive drums 1 are transferred to the first intermediate transfer belt 7 by the action of the transfer rollers 9.

The cyan, magenta, yellow, and black toner images formed on the photosensitive drums 1 of the imaging units 6 are successively transferred on top of one another on the first intermediate transfer belt 7, forming a color toner image on the first intermediate transfer belt 7. If a monochromatic image is to be formed, then a toner image is produced with just the imaging unit 6 containing black toner, and the monochromatic image is transferred onto the first intermediate transfer belt 7.

The first intermediate transfer belt 7 is a heat-resistant belt whose substrate is rubber or a resin film with a thickness of 50 to 1000 μm or 50 to 600 μm, has a resistance of $10^6$ to $10^{11}$ Ω·cm (which allows transfer of the toner images from the photosensitive drums), and has an outer peripheral surface comprising an image support side 7*a* for supporting toner images. This first intermediate transfer belt 7 is wound around and supported by four rotatable support rollers 11, 12, 13, and 14, and is able to move counter-clockwise as shown in the drawings. Within the belt loop, that is, on the side of the first intermediate transfer belt 7 that is opposite the image support side 7*a*, a back roller 15 is provided to the left of the support roller 14. A belt cleaning apparatus 16 is disposed to the outside of the belt loop so as to be across from this back roller 15. The belt cleaning apparatus 16 sweeps away debris such as paper powder or toner remaining on the surface of the first intermediate transfer belt 7. The cleaning method employed in this embodiment involves moving the belt to a cleaning roller, scraping it with a blade, and conveying the debris to a holder (not shown) with a recovery means. It is also possible to scrape directly with a blade and not provide a cleaning roller.

Two paper feed cassettes 17 are provided in the lower part of this color printer 100. Each of the paper feed cassettes 17 holds paper or another such recording medium S. The recording medium S is fed out one sheet at a time, from the top down, by a paper feed roller 18, and sent toward resist rollers 19.

A second intermediate transfer belt 20 (second image support) is disposed to the right of the first intermediate transfer belt 7. The second intermediate transfer belt 20 is a heat-resistant belt whose substrate is rubber or a resin film with a thickness of 50 to 1000 μm, has a resistance of $10^6$ to $10^{11}$ Ω·cm, and has an outer peripheral surface comprising an image support side 20*a* for supporting toner images. This second intermediate transfer belt 20 is wound around and supported by five rotatable support rollers 21, 22, 23, 24, and 25, and is able to move clockwise as shown in the drawings.

The first intermediate transfer belt 7 and the second intermediate transfer belt 20 have a contact region 26 in which part of the image support side 7*a* and part of the image support side 20*a* come into contact. Within this contact region 26, the above-mentioned support rollers 13 and 14 come into contact with the back of the first intermediate transfer belt 7 (the inner side of the belt loop), and the above-mentioned support rollers 24 and 25 come into contact with the back of the second intermediate transfer belt 20 (the inner side of the belt loop). These support rollers 13, 14, 24, and 25 are electroconductive rollers, with the support rollers (hereinafter also referred to as electroconductive rollers as needed) 13 and 14 being disposed upstream and downstream along the movement direction of the first intermediate transfer belt 7, and the support rollers (hereinafter also referred to as electroconductive rollers as needed) 24 and 25 being disposed upstream and downstream along the movement direction of the second intermediate transfer belt 20. The upstream electroconductive rollers 13 and 24 form an upstream nip 27 by sandwiching the first intermediate transfer belt 7 and the second intermediate transfer belt 20, while the downstream electroconductive rollers 14 and 25 form a downstream nip 28 by sandwiching the first intermediate transfer belt 7 and the second intermediate transfer belt 20.

The gap between the electroconductive roller 13 and the electroconductive roller 14, and the gap between the electroconductive roller 24 and the electroconductive roller 25 is preferably such that the outer peripheral gap is at least 5 mm and no more than 200 mm, with at least 10 mm and no more than 100 mm being even better. The gap is 29 mm in this embodiment.

The above-mentioned contact region 26 is a region into which is fed the recording medium S conveyed by the resist rollers 19. At the point when the portions on the two image support sides 7*a* and 20*a* where the toner images are supported face each other in the contact region 26, the recording medium S is conveyed in between these portions and transfer current is applied (discussed below), which transfers the toner images to both sides of the recording medium S.

Figure 4A:
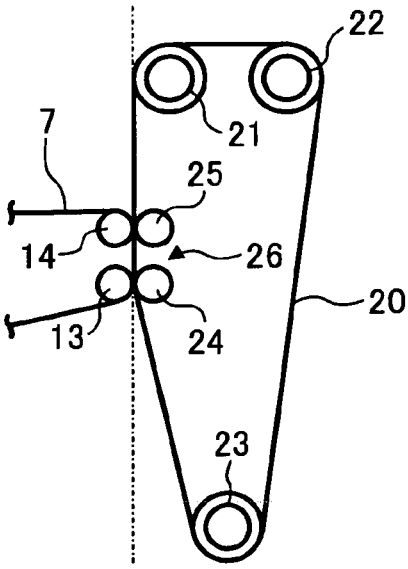
FIGS. 4A and 4B are front views illustrating the structure that allows the contact region to move in and out of contact by the rotation of a second intermediate transfer belt of this color printer.
Figure 4B:
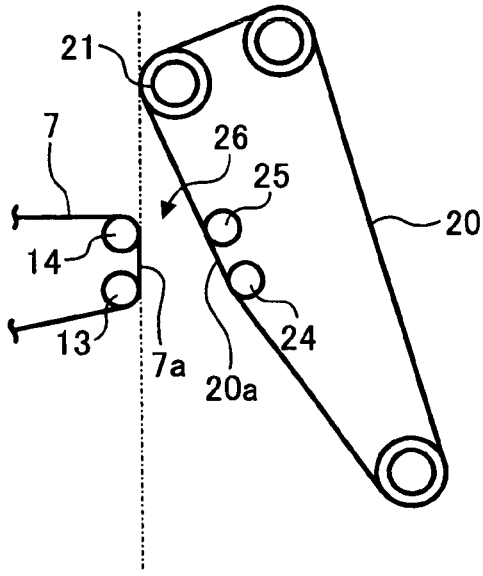

As shown in FIGS. 4A and 4B, the second intermediate transfer belt 20 is able to rotate around the axis of a support roller 21, and this rotation brings the image support side 7*a* and image support side 20*a* into and out of contact in the contact region 26. A mechanism that makes use of a solenoid and a spring is an example of the mechanism for rotating the second intermediate transfer belt 20 around the axis of the support roller 21. Any recording medium S that becomes jammed in the contact region 26 can be easily removed by rotating the second intermediate transfer belt 20 to the position shown in FIG. 4B. Also, if no image is to be formed, then the second intermediate transfer belt 20 can be rotated to the position shown in FIG. 4B to prevent any changes in the state of the first intermediate transfer belt 7 and the second intermediate transfer belt 20, such as stickiness or flat spots, that may occur if the first intermediate transfer belt 7 and the second intermediate transfer belt 20 are left sandwiched by the electroconductive rollers 13, 24 (and 14 and 25) for an extended period of time.

A belt cleaning apparatus 29 is disposed underneath and outside the belt loop of the second intermediate transfer belt 20. The belt cleaning apparatus 29 is equipped with an internal cleaning blade that sweeps away paper powder or toner remaining on the surface of the second intermediate transfer belt 20.

A fixing apparatus 30 is provided above the second intermediate transfer belt 20. The fixing apparatus 30 is equipped with a pressing roller and a fixing roller each heated by a heating element. After fixing, the recording medium S is discharged by a discharge roller 31 and stacked in a discharge tray 32.

Figure 5:
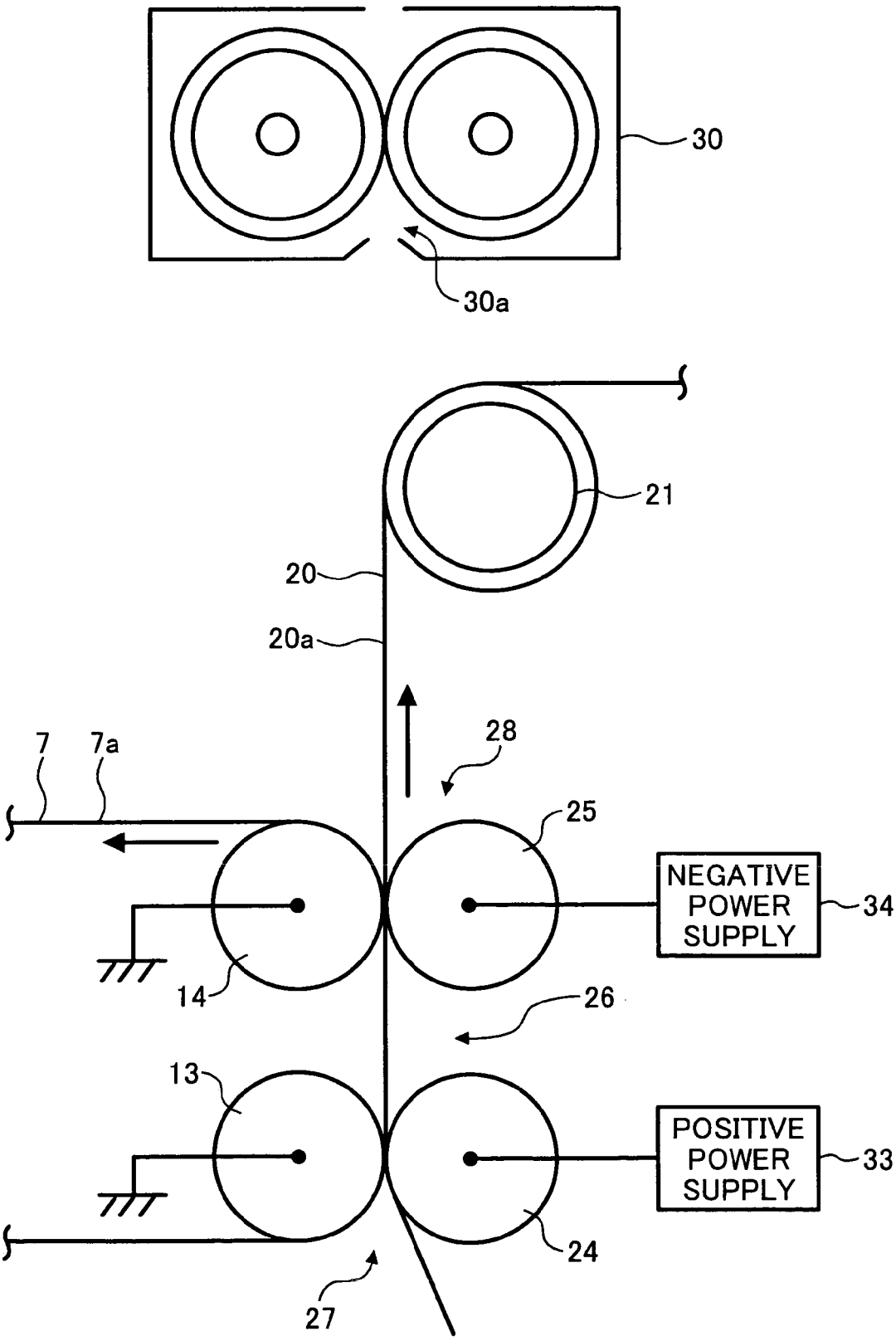
FIG. 5 is an enlarged front view of the structure of the area around this contact region.

FIG. 5 shows an enlarged view of the structure of the area around the contact region 26. Of the pair of electroconductive rollers 13 and 24 that form the upstream nip 27, the electroconductive roller 24 serves as an application roller, which is a first transfer member to which transfer current is applied, and the electroconductive roller 13 serves as a ground roller that is grounded. Of the pair of electroconductive rollers 14 and 25 that form the downstream nip 28, the electroconductive roller 25 serves as an application roller, which is a second transfer member to which transfer current is applied, and the electroconductive roller 14 serves as a ground roller. As a result, the application rollers (transfer members) 24 and 25 are disposed within the belt loop of the second intermediate transfer belt 20, while the ground rollers 13 and 14 are disposed within the belt loop of the first intermediate transfer belt 7. A power supply 33 for applying transfer current is connected to the application roller 24, and a power supply 34 for applying transfer current is connected to the application roller 25.

With this color printer 100, a transfer apparatus is constituted by the first intermediate transfer belt 7, the second intermediate transfer belt 20, the contact region 26, the upstream nip 27, the downstream nip 28, and so forth.

Also, this color printer 100 is provided with a controller (not shown) for controlling the various components according to a preinstalled program according to the detection results of various sensors, inputted data, and so on. Switching the power supply 33 and 34 on and off, switching the resist rollers 19 on and off, and so forth are controlled by the controller on the basis of detection results from a sensor (not shown) that detects the conveyance of the recording medium S.

We will now describe the operation of two-side printing in which toner images (color toner images in this embodiment) are transferred to both sides of the recording medium S in a single pass with the color printer 100 constituted as above.

First, the toner images of various colors produced by the imaging units 6 are successively transferred from the photosensitive drums 1 onto the first intermediate transfer belt 7 by the action of the transfer rollers 9, forming a color toner image on the first intermediate transfer belt 7. The toner that forms this color toner image is negatively charged, as is the case in all of the embodiments given below. At the point when the color toner image formed on the first intermediate transfer belt 7 passes through the contact region 26, a positive transfer current (+20 μA) is applied from the power supply 33 to the application roller 24, which positively charges the second intermediate transfer belt 20, and the color toner image on the first intermediate transfer belt 7 is transferred onto the image support side 20*a* of the second intermediate transfer belt 20. This color toner image transferred onto the second intermediate transfer belt 20 becomes a first side image (back image) when transferred to the recording medium S. The color toner image (first side image) transferred onto the second intermediate transfer belt 20 moves along with the second intermediate transfer belt 20.

When the first side image is transferred from the first intermediate transfer belt 7 to the second intermediate transfer belt 20, the production of the second side image (the image transferred to the front side of the recording medium S) is commenced by the imaging units 6, the toner images on the photosensitive drums 1 of the various imaging units 6 are successively transferred onto the first intermediate transfer belt 7 by the action of the transfer rollers 9, and a color toner image (second side image) is formed on the first intermediate transfer belt 7. The color toner image on the second intermediate transfer belt 20 (first side image) and the color toner image on the first intermediate transfer belt 7 (second side image) are carried toward the contact region 26 along with the movement of the first intermediate transfer belt 7 and the second intermediate transfer belt 20.

The recording medium S fed out by the resist rollers 19 enters the contact region 26 at the point when the color toner image on the second intermediate transfer belt 20 (first side image) and the color toner image on the first intermediate transfer belt 7 (second side image) have been brought to the contact region 26 and face each other. At the point when the recording medium S has entered the contact region 26, a positive transfer current (+50 μA) is applied from the power supply 33 to the application roller 24 of the upstream nip 27, and a negative transfer current (−30 μA) is applied from the power supply 34 to the application roller 25 of the downstream nip 28.

When the positive transfer current is applied to the application roller 24 of the upstream nip 27, a positive charge is given to the second intermediate transfer belt 20, the color toner image on the first intermediate transfer belt 7 (second side image) is subjected to electrostatic action, and this color toner image is transferred by attraction to one side of the recording medium S (the side facing the first intermediate transfer belt 7). When the negative transfer current is applied from the power supply 34 to the application roller 25 of the downstream nip 28, a negative charge is given to the second intermediate transfer belt 20, the color toner image on the second intermediate transfer belt 20 is subjected to electrostatic repulsion, and this color toner image is transferred by repulsion to the other side of the recording medium S (the side facing the second intermediate transfer belt 20).

When the recording medium S is conveyed through the contact region 26, color toner images are transferred to both sides thereof, and furthermore the transfer conditions at the application roller 24, which transfers the color toner image to one side of the recording medium S, and the transfer conditions at the application roller 25, which transfers the color toner image to the other side of the recording medium S, are individually set to be optimal.

Since the application rollers 24 and 25 are disposed on the inside of the belt loop of the second intermediate transfer belt 20, the application rollers 24 and 25 are positioned with the second intermediate transfer belt 20 interposed between them and the toner and the recording medium S, which reduces the adhesion of toner and paper dust to the application rollers 24 and 25. Also, since the ground rollers 13 and 14 are disposed on the inside of the belt loop of the first intermediate transfer belt 7, the ground rollers 13 and 14 are positioned with the first intermediate transfer belt 7 interposed between them and the toner and the recording medium S, which reduces the adhesion of toner and paper dust to the ground rollers 13 and 14.

After having the color toner images transferred to both of its sides, the recording medium S is fed into the fixing apparatus 30, and after the fixing treatment in the fixing apparatus 30, the recording medium S is discharged into the discharge tray 32.

When the discharge tray 32 is constituted as shown in FIG. 2, the recording medium S is discharged into the discharge tray 32 such that the last of the two color toner images transferred onto the two sides of the recording medium S, that is, the color toner image transferred directly from the first intermediate transfer belt 7 onto the recording medium S, is facing down. Accordingly, in order to adjust the page sequence of the recording medium S discharged into the discharge tray 32, the page-two image should be formed first, this image transferred onto the second intermediate transfer belt 20, then the subsequently-formed page-one color toner image transferred directly from the first intermediate transfer belt 7 to the recording medium S. Also, the image transferred from the first intermediate transfer belt 7 onto the recording medium S is formed as a positive image on the photosensitive drums 1, whereas the color toner image transferred from the second intermediate transfer belt 20 onto the recording medium S is formed as a reverse image (mirror image) on the surface of the photosensitive drums 1.

The image production sequence for this page sequencing can be accomplished by known technology for storing image data in a memory, and the switching of the exposed positive image and reverse image for forming positive and reverse (mirror) images on the photosensitive drums 1 can be accomplished by known image processing technology.

In this embodiment, an example was given in which the electroconductive roller 24 at the upstream nip 27 was an application roller and the electroconductive roller 13 was a ground roller, but the electroconductive roller 13 may instead by an application roller and the electroconductive roller 24 a ground roller. Similarly, in this example the electroconductive roller 25 at the downstream nip 28 was an application roller and the electroconductive roller 14 was a ground roller, but the electroconductive roller 14 may instead be an application roller and the electroconductive roller 25 a ground roller.

Also, in this embodiment, an example was given in which the color toner image on the first intermediate transfer belt 7 was transferred onto the recording medium S at the upstream nip 27, and the color toner image on the second intermediate transfer belt 20 was transferred onto the recording medium S at the downstream nip 28, but the constitution may instead be such that the color toner image on the second intermediate transfer belt 20 is transferred onto the recording medium S at the upstream nip 27, and the color toner image on the first intermediate transfer belt 7 is transferred onto the recording medium S at the downstream nip 28.

Figure 6:
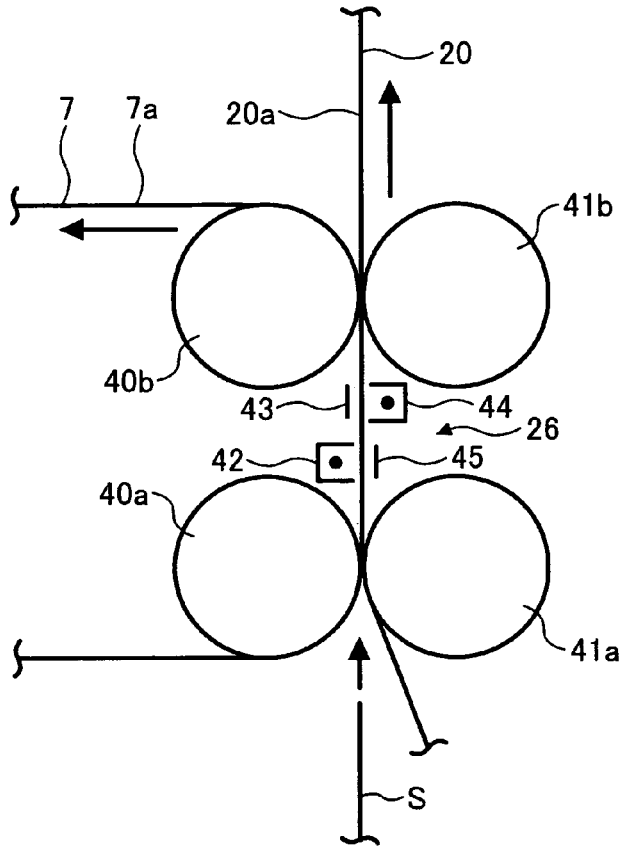
FIG. 6 is an enlarged front view of the structure of the area around the contact region in a first modification of this first embodiment.

Next, a first modification of the structure of the area around the contact region 26 in this embodiment will be described through reference to FIG. 6. Those components that are the same as the components described in FIGS. 2 to 5 are numbered the same and will not be described again (the same applies to the various modifications given below).

This modification is the same as the first embodiment in that the first intermediate transfer belt 7 is used as the first image support, the second intermediate transfer belt 20 is used as the second image support, and the image support side 7*a* of the first intermediate transfer belt 7 and the image support side 20*a* of the second intermediate transfer belt 20 come into contact in the contact region 26. However, in this contact region 26, the first intermediate transfer belt 7 is supported by support rollers 40*a* and 40*b*, the second intermediate transfer belt 20 is supported by support rollers 41*a* and 41*b*, and the first intermediate transfer belt 7 and the second intermediate transfer belt 20 are sandwiched between two sets of support rollers 40*a* and 41*a* (and 40*b* and 41*b*), with the rollers in each pair disposed facing each other. The first and second intermediate transfer belts 7 and 20 are polyimide belts with a thickness of 1000 μm and a resistance of $10^{11}$ Ω·cm.

A charger 42 and a ground electrode 43 (first transfer members) are disposed on the inside of the belt loop of the first intermediate transfer belt 7 and within the range of the contact region 26. The charger 42 is located upstream in the movement direction of the first intermediate transfer belt 7, and the electrode 43 is located downstream in this direction.

A charger 44 and a ground electrode 45 (second transfer members) are disposed on the inside of the belt loop of the second intermediate transfer belt 20 and within the range of the contact region 26. The electrode 45 is located upstream in the movement direction of the second intermediate transfer belt 20, and the charger 44 is located downstream in this direction. The charger 44 and the ground electrode 43 face each other with the first and second intermediate transfer belts 7 and 20 sandwiched therebetween, and the ground electrode 45 and the charger 42 also face each other with the first and second intermediate transfer belts 7 and 20 sandwiched therebetween.

With this constitution, a color toner image is formed on the first intermediate transfer belt 7, and transfer current (+400 μA) is applied to the charger 44 at the point when this color toner image passes through the contact region 26, which transfers this color toner image to the second intermediate transfer belt 20. After this, the recording medium S is fed into the contact region 26 at the point when the color toner image transferred to the second intermediate transfer belt 20 and the color toner image newly formed on the first intermediate transfer belt 7 are carried into the contact region 26.

Transfer current (+400 μA) is applied to the chargers 42 and 44 at the point when the recording medium S is fed into the contact region 26, the color toner image on the second intermediate transfer belt 20 is transferred by attraction to one side of the recording medium S by the application of transfer current to the charger 42, and the color toner image on the first intermediate transfer belt 7 is transferred by attraction to the other side of the recording medium S by the application of transfer current to the charger 44.

After having the color toner images transferred to both of its sides, the recording medium S is fed into the fixing apparatus 30 and fixed, and after this fixing treatment the recording medium S is discharged into the discharge tray 32. The images formed on the recording medium S discharged into the discharge tray 32 were checked, which confirmed that good images had been formed on both sides.

Here, since the charger 42 and electrode 43 are disposed on the inside of the belt loop of the first intermediate transfer belt 7, the charger 42 and electrode 43 are positioned with the first intermediate transfer belt 7 interposed between them and the toner and the recording medium S, which reduces the adhesion of toner and paper dust to the charger 42 and electrode 43. Also, since the charger 44 and electrode 45 are disposed on the inside of the belt loop of the second intermediate transfer belt 20, the charger 44 and electrode 45 are positioned with the second intermediate transfer belt 20 interposed between them and the toner and the recording medium S, which reduces the adhesion of toner and paper dust to the charger 44 and electrode 45.

Figure 7:
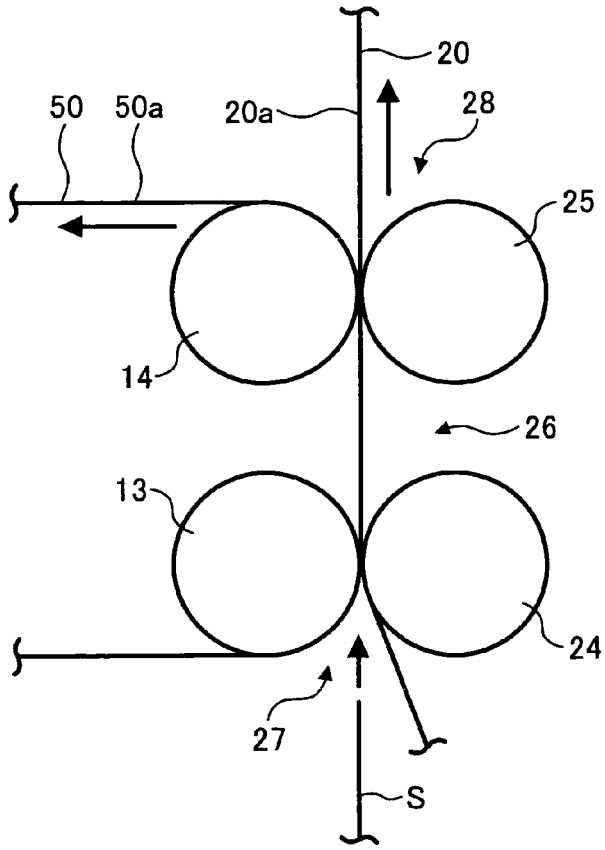
FIG. 7 is an enlarged front view of the structure of the area around the contact region in a second modification of this first embodiment.

Next, a second modification of the structure of the area around the contact region 26 in this embodiment will be described through reference to FIG. 7.

In this modification, a photosensitive belt 50 is used as the first image support, the intermediate transfer belt 20 is used as the second image support, and the image support side 50*a* of the photosensitive belt 50 and the image support side 20*a* of the intermediate transfer belt 20 come into contact in the contact region 26. The photosensitive belt 50 comprises a layer of an organic semiconductor (a photoconductive substance) provided to the surface of a heat-resistant (thermal deformation transfer of at least 350° C.) belt with a thickness of 32 μm and based on rubber. The intermediate transfer belt 20 is a polyimide belt with a thickness of 600 μm and a resistance of $10^9$ Ω·cm.

The application rollers 24 and 25 (first and second transfer members) are disposed on the inside of the belt loop of the intermediate transfer belt 20 and within the range of the contact region 26. These application rollers 24 and 25 are electroconductive rollers with a resistance of $10^8$ Ω·cm and a layer thickness set to 0.3 mm. Each of these application rollers 24 and 25 is connected to a power supply.

The ground rollers 13 and 14 are disposed on the inside of the belt loop of the photosensitive belt 50 and within the range of the contact region 26. These ground rollers 13 and 14 and the application rollers 24 and 25 sandwich the photosensitive belt 50 and the intermediate transfer belt 20 within the contact region 26, thereby forming the upstream nip 27 and the downstream nip 28. The nip width of the upstream nip 27 and the downstream nip 28 is 2.5 mm.

The nip width referred to here is the width at which the outer peripheral surfaces of the pairs of electroconductive rollers 24 and 13 (and 25 and 14) that constitute the upstream nip 27 and the downstream nip 28 are in contact with the intermediate transfer belt 20 or the photosensitive belt 50. In specific terms, when a toner layer is supported on the image support side of the intermediate transfer belt 20 and the image support side 50*a* of the photosensitive belt 50, and either the photosensitive belt 50 or the intermediate transfer belt 20 is moved without feeding the recording medium S between the photosensitive belt 50 and the intermediate transfer belt 20, this is the shaved width of the toner layer on the photosensitive belt 50 or the intermediate transfer belt 20 stopped at the upstream nip 27 and the downstream nip 28.

With this constitution, color toner images are formed on the intermediate transfer belt 20 and the photosensitive belt 50, and the recording medium S is fed into the contact region 26 at the point when these color toner images are brought into the contact region 26 along with the movement of the intermediate transfer belt 20 and the photosensitive belt 50.

At the point when the recording medium S enters the contact region 26, positive transfer current (+50 μA) is applied to the application roller 24 of the upstream nip 27, and negative transfer current (−30 μA) is applied to the application roller 25 of the downstream nip 28.

The color toner image on the photosensitive belt 50 is transferred by attraction to one side of the recording medium S by the action of electrostatic attraction by the application of positive transfer current to the application roller 24 of the upstream nip 27. Also, the color toner image on the intermediate transfer belt 20 is transferred to the other side of the recording medium S by the action of electrostatic repulsion by the application of negative transfer current to the application roller 25 of the downstream nip 28.

After having the color toner images transferred to both of its sides, the recording medium S is fed into the fixing apparatus 30 and fixed, and after this fixing treatment the recording medium S is discharged into the discharge tray 32. The images formed on the recording medium S discharged into the discharge tray 32 were checked, which confirmed that good images had been formed on both sides.

Here, since the application rollers 24 and 25 are disposed on the inside of the belt loop of the intermediate transfer belt 20, the application rollers 24 and 25 are positioned with the intermediate transfer belt 20 interposed between them and the toner and the recording medium S, which reduces the adhesion of toner and paper dust to the application rollers 24 and 25. Also, since the ground rollers 13 and 14 are disposed on the inside of the belt loop of the photosensitive belt 50, the ground rollers 13 and 14 are positioned with the photosensitive belt 50 interposed between them and the toner and the recording medium S, which reduces the adhesion of toner and paper dust to the ground rollers 13 and 14.

Figure 8:
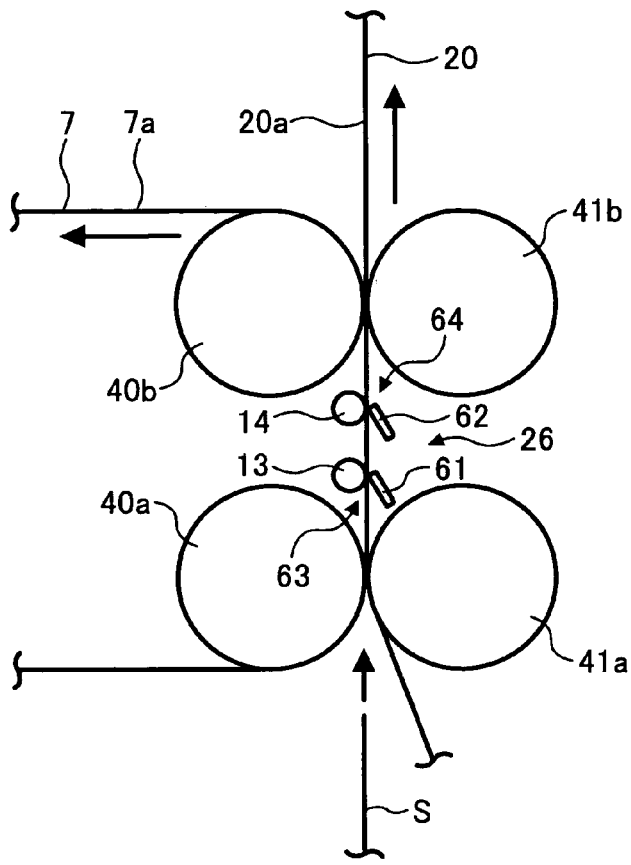
FIG. 8 is an enlarged front view of the structure of the area around the contact region in a third modification of this first embodiment.

The amount of ozone generated during transfer was measured and compared to the amount generated when the chargers 42 and 44 of the first modification were used, which revealed that the amount of ozone was sharply decreased from 18.0 ppm to 0.02 ppm. The ozone measurement location was at a height of 1.2 m, 0.3 m away in the horizontal direction from the front center of the color printer 100. Next, a third modification of the structure of the area around the contact region 26 in this embodiment will be described through reference to FIG. 8.

This modification is the same as the various modifications given above in that the first intermediate transfer belt 7 is used as the first image support, the second intermediate transfer belt 20 is used as the second image support, and the image support side 7*a* of the first intermediate transfer belt 7 and the image support side 20*a* of the second intermediate transfer belt 20 come into contact in the contact region 26. Also the same as the first modification given above is that in this contact region 26, the first intermediate transfer belt 7 is supported by support rollers 40*a* and 40*b*, the second intermediate transfer belt 20 is supported by support rollers 41*a* and 41*b*, and the first intermediate transfer belt 7 and the second intermediate transfer belt 20 are sandwiched between two sets of support rollers 40*a* and 41*a* (and 40*b* and 41*b*), with the rollers in each pair disposed facing each other. The first and second intermediate transfer belts 7 and 20 are polyimide belts with a thickness of 600 μm and a resistance of $10^9$ Ω·cm.

An application blade 61 (first transfer member) and an application blade 62 (second transfer member) are disposed within the contact region 26 and on the inside of the belt loop of the second intermediate transfer belt 20. A positive transfer current (+30 μA) is applied to the upstream application blade 61, and a negative transfer current (−20 μA) is applied to the downstream application blade 62.

The ground rollers 13 and 14 are disposed within the contact region 26 and on the inside of the belt loop of the first intermediate transfer belt 7, and these ground rollers 13 and 14 and the application blades 61 and 62 sandwich the first and second intermediate transfer belts 7 and 20 within the contact region 26 to form an upstream nip 63 and a downstream nip 64. The nip width of the upstream and downstream nips 63 and 64 is 1.0 mm.

With this constitution, color toner images are formed on the first intermediate transfer belt 7 and the second intermediate transfer belt 20, and the recording medium S is fed into the contact region 26 at the point when these color toner images are brought into the contact region 26 along with the movement of the first and second intermediate transfer belts 7 and 20.

At the point when the recording medium S has entered the contact region 26, a positive transfer current (+30 μA) is applied to the application blade 61 of the upstream nip 63, and a negative transfer current (−20 μA) is applied to the application blade 62 of the downstream nip 64.

When the positive transfer current is applied to the application blade 61 of the upstream nip 63, the color toner image on the first intermediate transfer belt 7 is subjected to electrostatic attraction, and this color toner image is transferred by attraction to one side of the recording medium S. When the negative transfer current is applied to the application blade 62 of the downstream nip 64, the color toner image on the second intermediate transfer belt 20 is subjected to electrostatic repulsion, and this color toner image is transferred by repulsion to the other side of the recording medium S.

After having the color toner images transferred to both of its sides, the recording medium S is fed into the fixing apparatus 30 and fixed, and after this fixing treatment the recording medium S is discharged into the discharge tray 32. The images formed on the recording medium S discharged into the discharge tray 32 were checked, which confirmed that good images had been formed on both sides.

Here, since the application blades 61 and 62 are disposed on the inside of the belt loop of the second intermediate transfer belt 20, the application blades 61 and 62 are positioned with the second intermediate transfer belt 20 interposed between them and the toner and the recording medium S, which reduces the adhesion of toner and paper dust to the application blades 61 and 62. Also, since the ground rollers 13 and 14 are disposed on the inside of the belt loop of the first intermediate transfer belt 7, the ground rollers 13 and 14 are positioned with the first intermediate transfer belt 7 interposed between them and the toner and the recording medium S, which reduces the adhesion of toner and paper dust to the ground rollers 13 and 14.

The amount of ozone generated during transfer was measured and compared to the amount generated when the chargers 42 and 44 of the first modification were used, which revealed that the amount of ozone was sharply decreased from 18.0 ppm to 0.02 ppm. The ozone measurement location was at a height of 1.2 m, 0.3 m away in the horizontal direction from the front center of the color printer 100.

Figure 9:
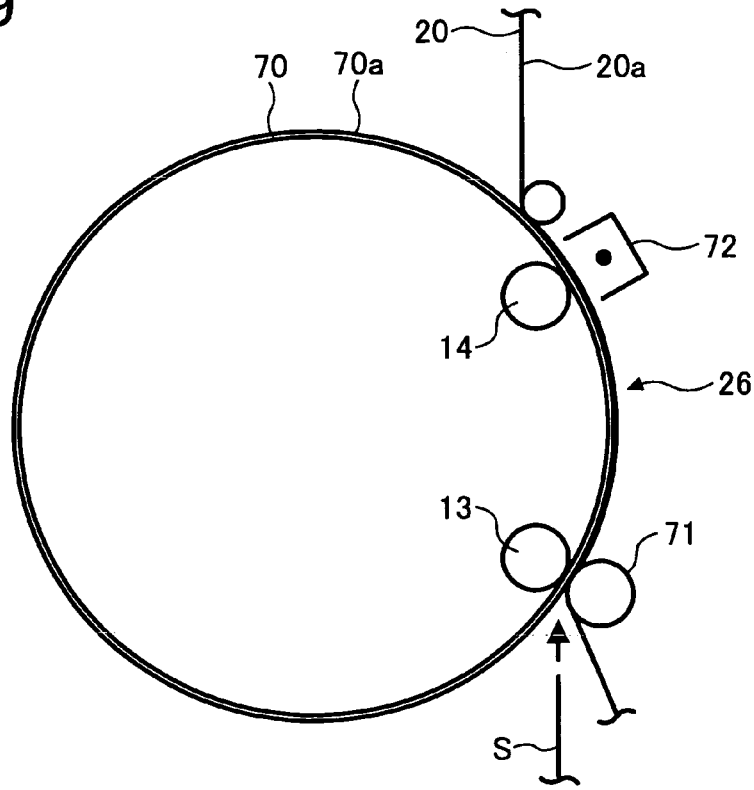
FIG. 9 is an enlarged front view of the structure of the area around the contact region in a fourth modification of this first embodiment.

Next, a fourth modification of the structure of the area around the contact region 26 in this embodiment will be described through reference to FIG. 9.

In this modification, an intermediate photosensitive drum 70 is used as the first image support, the intermediate transfer belt 20 is used as the second image support, and the image support side 70*a* of the intermediate photosensitive drum 70 and the image support side 20*a* of the intermediate transfer belt 20 come into contact in the contact region 26. The intermediate photosensitive drum 70 comprises a layer of polyimide with a resistance of $10^8$ Ω·cm provided to the surface of an insulating cylinder with a diameter of 70 mm. The intermediate transfer belt 20 is a polyimide belt with a thickness of 600 μm and a resistance of $10^9$ Ω·cm.

An application roller 71 (first transfer member) and a charger 72 (second transfer member) are disposed on the inside of the belt loop of the intermediate transfer belt 20 and within the range of the contact region 26. The application roller 71 is in contact with the inner side of the belt loop of the intermediate transfer belt 20, and has applied to it a negative transfer current (−40 μA). The charger 72 is away from the inner side of the belt loop of the intermediate transfer belt 20, and has applied to it a positive transfer current (+300 μA).

The ground rollers 13 and 14 are disposed on the inner peripheral side of the intermediate photosensitive drum 70 at locations opposite the application roller 71 and the charger 72, and these ground rollers 13 and 14 are in contact with the inner peripheral surface of the intermediate photosensitive drum 70. The application roller 71 and the ground roller 13 nip the intermediate photosensitive drum 70 and the intermediate transfer belt 20 at a nip width of 2.0 mm.

With this constitution, color toner images are formed on the intermediate photosensitive drum 70 and the intermediate transfer belt 20, and the recording medium S is fed into the contact region 26 at the point when these color toner images are brought into the contact region 26 along with the movement of the intermediate photosensitive drum 70 and the intermediate transfer belt 20.

At the point when the recording medium S enters the contact region 26, negative transfer current (−40 μA) is applied to the application roller 71, and positive transfer current (+300 μA) is applied to the charger 72.

On the application roller 71 side (the upstream side), the color toner image on the intermediate transfer belt 20 is subjected to electrostatic repulsion, and this color toner image is transferred by repulsion to one side of the recording medium S. On the charger 72 side (the downstream side), the color toner image on the intermediate photosensitive drum 70 is subjected to electrostatic attraction, and this color toner image is transferred by attraction to the other side of the recording medium S.

After having the color toner images transferred to both of its sides, the recording medium S is fed into the fixing apparatus 30 and fixed, and after this fixing treatment the recording medium S is discharged into the discharge tray 32. The images formed on the recording medium S discharged into the discharge tray 32 were checked, which confirmed that good images had been formed on both sides.

Here, since the application roller 71 and the charger 72 are disposed on the inside of the belt loop of the intermediate transfer belt 20, the application roller 71 and the charger 72 are positioned with the intermediate transfer belt 20 interposed between them and the toner and the recording medium S, which reduces the adhesion of toner and paper dust to the application roller 71 and the charger 72. Also, since the ground rollers 13 and 14 are disposed on the inside of the belt loop of the intermediate photosensitive drum 70, the ground rollers 13 and 14 are positioned with the intermediate photosensitive drum 70 interposed between them and the toner and the recording medium S, which reduces the adhesion of toner and paper dust to the ground rollers 13 and 14.

The amount of ozone generated during transfer was measured and compared to the amount generated when the chargers 42 and 44 of the first modification were used, which revealed that the amount of ozone was sharply decreased from 18.0 ppm to 9.01 ppm. The ozone measurement location was at a height of 1.2 m, 0.3 m away in the horizontal direction from the front center of the color printer 100.

Figure 10:
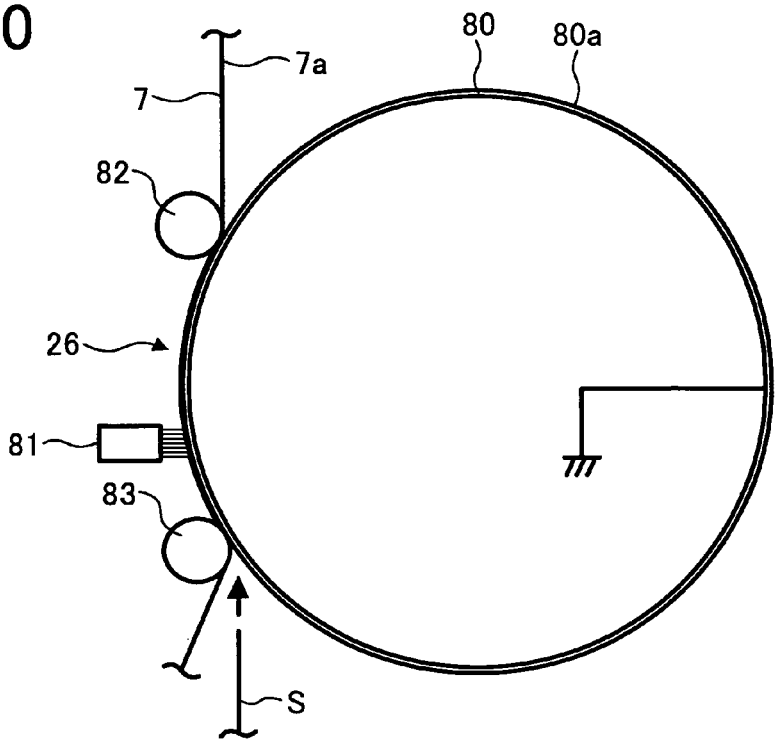
FIG. 10 is an enlarged front view of the structure of the area around the contact region in a fifth modification of this first embodiment.

Next, a fifth modification of the structure of the area around the contact region 26 in this embodiment will be described through reference to FIG. 10.

In this modification, the intermediate transfer belt 7 is used as the first image support, a photosensitive drum 80 is used as the second image support, and the image support side 7*a* of the intermediate transfer belt 7 and the image support side 80*a* of the photosensitive drum 80 come into contact in the contact region 26. The intermediate transfer belt 7 is a polyimide belt with a thickness of 50 μm and a resistance of $10^6$ Ω·cm. The photosensitive drum 80 comprises a layer of a heat-resistant photoconductive substance provided to the surface of an aluminum cylinder with a diameter of 70 mm.

An application brush 81 (first transfer member), a thermal transfer roller 82 (second transfer member), and a support roller 83 are disposed on the inside of the belt loop of the intermediate transfer belt 7 and within the contact region 26. The application brush 81 is conductive, with a resistance of $10^8$ Ω·cm, and has applied to it a positive transfer current (+50 μA). The thermal transfer roller 82 is heated to a roller surface temperature of 90° C. The thermal transfer roller 82 and the photosensitive drum 80 nip the intermediate transfer belt 7 at a nip width of 3.0 mm.

With this constitution, color toner images are formed on the intermediate transfer belt 7 and the photosensitive drum 80, and the recording medium S is fed into the contact region 26 at the point when these color toner images are brought into the contact region 26 along with the movement of the intermediate transfer belt 7 and the photosensitive drum 80.

At the point when the recording medium S enters the contact region 26, positive transfer current (+50 μA) is applied to the application brush 81 to heat the thermal transfer roller 82.

On the application brush 81 side (the upstream side), the color toner image on the photosensitive drum 80 is subjected to electrostatic attraction, and this color toner image is transferred by attraction to one side of the recording medium S. On the thermal transfer roller 82 side (the downstream side), the color toner image on the intermediate transfer belt 7 is subjected to heat, and this color toner image is thermally transferred to the other side of the recording medium S.

After having the color toner images transferred to both of its sides, the recording medium S is fed into the fixing apparatus 30 and fixed, and after this fixing treatment the recording medium S is discharged into the discharge tray 32. The images formed on the recording medium S discharged into the discharge tray 32 were checked, which confirmed that good images had been formed on both sides.

Here, since the application brush 81 and the thermal transfer roller 82 are disposed on the inside of the belt loop of the intermediate transfer belt 7, the application brush 81 and the thermal transfer roller 82 are positioned with the intermediate transfer belt 7 interposed between them and the toner and the recording medium S, which reduces the adhesion of toner and paper dust to the application brush 81 and the thermal transfer roller 82.

The amount of ozone generated during transfer was measured and compared to the amount generated when the chargers 42 and 44 of the first modification were used, which revealed that the amount of ozone was sharply decreased from 18.0 ppm to 9.01 ppm. The ozone measurement location was at a height of 1.2 m, 0.3 m away in the horizontal direction from the front center of the color printer 100.

Figure 11:
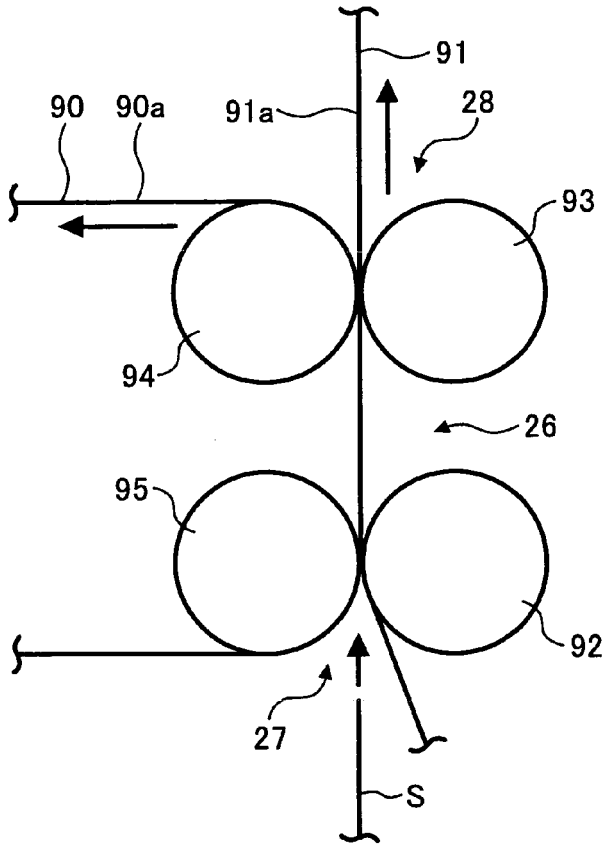
FIG. 11 is an enlarged front view of the structure of the area around the contact region in a sixth modification of this first embodiment.

Next, a sixth modification of the structure of the area around the contact region 26 in this embodiment will be described through reference to FIG. 11.

In this modification, a photosensitive belt 90 is used as the first image support, a photosensitive belt 91 is used as the second image support, and the image support side 90*a* of the photosensitive belt 90 and the image support side 91*a* of the photosensitive belt 91 come into contact in the contact region 26. A thermal transfer roller 92 (first transfer member) and a support roller 93 come into contact on the inside of the belt loop of the photosensitive belt 91 in the contact region 26. A thermal transfer roller 94 (second transfer member) and a support roller 95 come into contact on the inside of the belt loop of the photosensitive belt 90 in the contact region 26. The thermal transfer roller 92 and the support roller 95 form the upstream nip 27 that sandwiches the photosensitive belts 90 and 91, and the nip width of this nip is 2.3 mm. The thermal transfer roller 94 and the support roller 93 form the downstream nip 28 that sandwiches the photosensitive belts 90 and 91, and the nip width of this nip is 2.3 mm.

The photosensitive belts 90 and 91 comprise a layer of a heat-resistant photoconductive substance provided to the surface of a heat-resistant (thermal deformation transfer of at least 350° C.) belt with a thickness of 32 μm and based on rubber.

The thermal transfer rollers 92 and 94 are heated to a roller surface temperature of 100° C.

With this constitution, color toner images are formed on the photosensitive belt 90 and the photosensitive belt 91, and the recording medium S is fed into the contact region 26 at the point when these color toner images are brought into the contact region 26 along with the movement of the photosensitive belts 90 and 91.

At the point when the recording medium S enters the contact region 26, the thermal transfer rollers 92 and 94 are heated, the thermal transfer roller 92 on the upstream side is heated to transfer the color toner image on the photosensitive belt 91 to one side of the recording medium S, and the thermal transfer roller 94 on the downstream side is heated to transfer the color toner image on the photosensitive belt 90 to the other side of the recording medium S.

After having the color toner images transferred to both of its sides, the recording medium S is fed into the fixing apparatus 30 and fixed, and after this fixing treatment the recording medium S is discharged into the discharge tray 32. The images formed on the recording medium S discharged into the discharge tray 32 were checked, which confirmed that good images had been formed on both sides.

Here, since the thermal transfer roller 92 is disposed on the inside of the belt loop of the photosensitive belt 91, and the thermal transfer roller 94 is disposed on the inside of the belt loop of the photosensitive belt 90, the thermal transfer rollers 92 and 94 are positioned with the photosensitive belts 90 and 91 interposed between them and the toner and the recording medium S, which reduces the adhesion of toner and paper dust to the thermal transfer rollers 92 and 94.

The amount of ozone generated during transfer was measured and compared to the amount generated when the chargers 42 and 44 of the first modification were used, which revealed that the amount of ozone was sharply decreased from 18.0 ppm to 0.02 ppm. The ozone measurement location was at a height of 1.2 m, 0.3 m away in the horizontal direction from the front center of the color printer 100.

The first embodiment and various modifications thereof given above have the following effects.

(1) Because toner images are transferred without any misalignment between the recording medium and the image support, good-quality images can be formed on the image support, and because the transfer of the toner image to one side of the recording medium is accomplished using a first transfer member, while the transfer of the toner image to the other side of the recording medium is accomplished using a second transfer member, the transfer of the toner image with the first transfer member and the transfer of the toner image with the second transfer member can each been performed under optimal conditions, allowing even better images to be formed on the recording medium.

(2) Since the image supports are photosensitive members or intermediate transfer members, the transfer process can be simplified and the productivity of image formation can be improved by using a photosensitive member as the image support, and if an intermediate transfer member is used as the image support, it is possible to form a color toner image on the intermediate transfer member, allowing a good color image to be formed on the recording medium.

(3) Because the transfer with the transfer members is performed by electrostatic transfer or thermal transfer, efficient transfer from the image support to the recording medium is possible, allowing a good-quality image to be formed on the recording medium.

(4) The transfer member disposed on the inside of the belt loop of the belt-form image support is positioned with the image support interposed between it and the toner and recording medium, which minimizes the soiling of the transfer member by the adhesion of toner or paper dust.

(5) The transfer member performs electrostatic transfer, is in contact with the inner side of the belt loop of the image support, and applies a charge to the image support, which reduces the generation of discharge products such as ozone during transfer.

(6) The transfer member performs electrostatic transfer, and applies a charge to the image support in a state of non-contact with the inner side of the belt loop of the image support, so no contact resistance is generated between the transfer members and the inner surface of the belt of the image support, and wear to the image support and transfer members can be prevented.

(7) The transfer member is in the form of a roller, a brush, or a blade, so a charge can be applied to the image support efficiently, and the transfer of the toner image from the image support to the recording medium can be carried out favorably.

(8) The image support is an intermediate transfer belt, is based on rubber or a resin film with a thickness of 50 to 1000 μm, and has a resistance of $10^6$ to $10^{11}$ Ω·cm, which affords good transfer of a toner image from this intermediate transfer belt to the recording medium.

(9) The first image support and/or the second image support is provided movably to a position where the contact region releases contact, and releasing the contact in the contact region when no transfer is being performed minimizes the changes in the image support characteristics that would occur if the contact region were left in contact all the time, and also allows any jams that occur in the contact region to be cleared more easily.

Second Embodiment

A second embodiment will now be described in detail through reference to the drawings. FIGS. 2 to 5 and the descriptions thereof referred to in the first embodiment above apply substantially equally to this embodiment, and therefore these descriptions will not be repeated here, and mainly just the points of difference will be described.

As described through reference to FIG. 5 in the first embodiment above, when a positive transfer current is applied to the application roller 24 of the upstream nip 27, a positive charge is given to the second intermediate transfer belt 20, the color toner image (second side image) on the first intermediate transfer belt 7 is subjected to the action of electrostatic attraction, and this color toner image is transferred by attraction to one side of the recording medium S (the side facing the first intermediate transfer belt 7). When a negative transfer current is applied from the power supply 34 to the application roller 25 of the downstream nip 28, a negative charge is given to the second intermediate transfer belt 20, the color toner image on the second intermediate transfer belt 20 is subjected to the action of electrostatic repulsion, and this color toner image is transferred by repulsion to the other side of the recording medium S (the side facing the second intermediate transfer belt 20).

Meanwhile, when a negative transfer current is applied to the application roller 25 at the upstream nip 28, this transfer current exerts electrostatic repulsion on the color toner image on the second intermediate transfer belt 20, and this color toner image is transferred to the other side of the recording medium S, but since electrostatic repulsion is simultaneously exerted on the color toner image transferred from the first intermediate transfer belt 7 to the recording medium S in the upstream nip 27, this color toner image may sometimes end up being retransferred from the recording medium S back to the first intermediate transfer belt 7.

After having the color toner images transferred to both of its sides, the recording medium S is conveyed in a state of being held to the second intermediate transfer belt 20, which moves closer to the fixing apparatus 30 than the first intermediate transfer belt 7, and the color toner image is fixed to the recording medium S within the fixing apparatus 30.

Experiment examples will now be described, in which the inventors examined the conditions under which the retransfer of the color toner image from the recording medium S to the first intermediate transfer belt 7 occurs in the downstream nip 28.

EXPERIMENT EXAMPLE 1

In this Experiment Example 1, we examined the relationship between the transfer currents applied to the application roller 24 of the upstream nip 27 and to the application roller 25 of the downstream nip 28. In this experiment example, conditions other than the transfer current applied to the application rollers 24 and 25 were such that retransfer would be prevented from occurring (see the other experiment examples). When the color toner image on the first intermediate transfer belt 7 was transferred to the second intermediate transfer belt 20, a transfer current of +20 μA was applied to the application roller 24 of the upstream nip 27, and the color toner image on the first intermediate transfer belt 7 was subjected to the action of electrostatic attraction and transferred to the second intermediate transfer belt 20.

Two-sided transfer to the recording medium S was performed by applying a transfer current of +50 μA to the application roller 24 of the upstream nip 27 and applying a transfer current of −30 μA to the application roller 25 of the downstream nip 28, after which the images were fixed by the fixing apparatus 30. Examination of the fixed images confirmed that images of good quality had been formed on both sides. This tells us that there was no retransfer of the color toner images from the recording medium S to the first intermediate transfer belt 7 in the downstream nip 28.

Next, two-sided transfer to the recording medium S was performed by applying a transfer current of +40 μA to the application roller 24 of the upstream nip 27 and applying a transfer current of −40 μA to the application roller 25 of the downstream nip 28, after which the images were fixed by the fixing apparatus 30. Examination of the fixed images confirmed that images of good quality had been formed on both sides. This tells us that there was no retransfer of the color toner images from the recording medium S to the first intermediate transfer belt 7 in the downstream nip 28.

Next, two-sided transfer to the recording medium S was performed by applying a transfer current of +20 μA to the application roller 24 of the upstream nip 27 and applying a transfer current of −50 μA to the application roller 25 of the downstream nip 28, after which the images were fixed by the fixing apparatus 30. Examination of the fixed images confirmed that the color toner image transferred from the first intermediate transfer belt 7 was an image with a low transfer ratio on one side of the recording medium S. This indicates that retransfer of the color toner images from the recording medium S to the first intermediate transfer belt 7 did occur in the downstream nip 28.

To summarize the results of this experiment example, it can be concluded that the retransfer of the color toner image from the recording medium S to the first intermediate transfer belt 7 can be prevented by setting the absolute value of the transfer current applied to the application roller 24 located in the upstream nip 27 to be the same as or greater than the absolute value of the transfer current applied to the application roller 25 located in the downstream nip 28.

EXPERIMENT EXAMPLE 2

In this Experiment Example 2, in addition to what was done in Experiment Example 1, we examined the relationship between the thickness of the recording medium S and the transfer current applied to the application rollers 24 and 25.

This color printer 100 is provided with means for varying the transfer current applied to the application rollers 24 and 25 according to the thickness of the recording medium S. This means is a function executed by the controller according to a program preloaded on a ROM or the like, on the basis of detection results from a paper thickness detector that detects the thickness of the recording medium S. Examples of the paper thickness detector that detects the thickness of the recording medium S include various sensors provided to the site of the resist rollers, such as a sensor for sensing the gap of the roller pair constituting the resist rollers 19 while the recording medium S passes through, and a strain sensor for sensing the pressing force exerted between the roller pair while the recording medium S passes through.

Using cardstock as the recording medium S, two-sided transfer onto this cardstock was performed by applying a transfer current of +50 μA to the application roller 24 of the upstream nip 27, and applying a transfer current of −30 μA to the application roller 25 of the downstream nip 28, after which the images were fixed by the fixing apparatus 30. The fixed images were examined, which confirmed that transfer was unsatisfactory on both sides.

Next, in two-sided transfer onto cardstock, a transfer current of +60 μA was applied to the application roller 24 of the upstream nip 27, and a transfer current of −40 μA was applied to the application roller 25 of the downstream nip 28. The images were then fixed and examined, which confirmed that good images had been formed on both sides.

Next, in two-sided transfer onto tracing paper as the recording medium S, a transfer current of +50 μA was applied to the application roller 24 of the upstream nip 27, and a transfer current of −30 μA was applied to the application roller 25 of the downstream nip 28. The images were then fixed and examined, which confirmed that transfer was unsatisfactory on both sides.

Next, in two-sided transfer onto tracing paper, a transfer current of +40 μA was applied to the application roller 24 of the upstream nip 27, and a transfer current of −20 μA was applied to the application roller 25 of the downstream nip 28. The images were then fixed and examined, which confirmed that good images had been formed on both sides.

To summarize the results of this experiment example 2, it can be concluded that to prevent the retransfer of the color toner image from the recording medium S to the first intermediate transfer belt 7, the absolute value of the transfer current applied to the application roller 24 located in the upstream nip 27 must be the same as or greater than the absolute value of the transfer current applied to the application roller 25 located in the downstream nip 28, and to prevent unsatisfactory transfer, the proper transfer current must be applied according to the thickness of the recording medium S.

EXPERIMENT EXAMPLE 3

In this Experiment Example 3, we examined the relationship between the width of the nip of the electroconductive rollers 13 and 24 of the upstream nip 27 (nip width), and the width of the nip of the electroconductive rollers 14 and 25 of the downstream nip 28 (nip width). In this example, conditions other than the nip width were such that retransfer could be prevented (see the other experiment examples).

Two-sided transfer to the recording medium S was performed with the nip width of the upstream nip 27 set to 4 mm and the nip width of the downstream nip 28 set to 1 mm, after which the images were fixed by the fixing apparatus 30. The fixed images were examined, which confirmed that no retransfer of the color toner images from the recording medium S to the first intermediate transfer belt 7 occurred in the downstream nip 28.

The outer peripheral surface of the pairs of electroconductive rollers 24 and 13 (25 and 14) that constitute the upstream nip 27 and the downstream nip 28 is the width in contact with the first and second intermediate transfer belts 7 and 20. Specifically, when toner images are supported on the image support side 7*a* of the first intermediate transfer belt 7 and the image support side 20*a* of the second intermediate transfer belt 20, and just the first or second intermediate transfer belt 7 or 20 moves, without the recording medium S being fed in between the first and second intermediate transfer belts 7 and 20, this is the shaved width of the toner layer on the first or second intermediate transfer belts 7 and 20 stopped at the upstream nip 27 and the downstream nip 28.

Next, two-sided transfer to the recording medium S was performed with the nip width of the upstream nip 27 set to 3 mm and the nip width of the downstream nip 28 set to 3 mm, after which the images were fixed by the fixing apparatus 30. The fixed images were examined, which confirmed that good images had been formed on both sides. This tells us that there was no retransfer of the color toner images from the recording medium S to the first intermediate transfer belt 7 in the downstream nip 28.

Next, two-sided transfer to the recording medium S was performed with the nip width of the upstream nip 27 set to 1 mm and the nip width of the downstream nip 28 set to 4 mm, after which the images were fixed by the fixing apparatus 30. Examination of the fixed images confirmed that the color toner image transferred from the first intermediate transfer belt 7 was an image with a low transfer ratio on one side of the recording medium S. This tells us that retransfer of the color toner images from the recording medium S to the first intermediate transfer belt 7 occurred in the downstream nip 28.

To summarize the results of this Experiment Example 3, it can be concluded that the retransfer of the color toner image from the recording medium S to the first intermediate transfer belt 7 can be prevented by setting the nip width of the upstream nip 27 to be the same as or greater than the nip width of the downstream nip 28.

EXPERIMENT EXAMPLE 4

In this Experiment Example 4, we examined the relationship between the transfer pressure between the electroconductive rollers 13 and 24 of the upstream nip 27, and the transfer pressure between the electroconductive rollers 14 and 25 of the downstream nip 28. In this example, conditions other than the transfer pressure between the electroconductive rollers 13 and 24 and the electroconductive rollers 14 and 25 were such that retransfer could be prevented (see the other experiment examples).

Two-sided transfer to the recording medium S was performed with the transfer pressure between the electroconductive rollers 13 and 24 of the upstream nip 27 set to 15 N and the transfer pressure between the electroconductive rollers 14 and 25 of the downstream nip 28 set to 5 N, after which the images were fixed by the fixing apparatus 30. The fixed images were examined, which confirmed that good images had been formed on both sides. This tells us that no retransfer of the color toner images from the recording medium S to the first intermediate transfer belt 7 occurred in the downstream nip 28.

Next, two-sided transfer to the recording medium S was performed with the transfer pressure between the electroconductive rollers 13 and 24 of the upstream nip 27 set to 10 N and the transfer pressure between the electroconductive rollers 14 and 25 of the downstream nip 28 set to 10 N, after which the images were fixed by the fixing apparatus 30. The fixed images were examined, which confirmed that good images had been formed on both sides. This tells us that there was no retransfer of the color toner images from the recording medium S to the first intermediate transfer belt 7 in the downstream nip 28.

Next, two-sided transfer to the recording medium S was performed with the transfer pressure between the electroconductive rollers 13 and 24 of the upstream nip 27 set to 5 N and the transfer pressure between the electroconductive rollers 14 and 25 of the downstream nip 28 set to 15 N, after which the images were fixed by the fixing apparatus 30. Examination of the fixed images confirmed that the color toner image transferred from the first intermediate transfer belt 7 was an image with a low transfer ratio on one side of the recording medium S. This tells us that retransfer of the color toner images from the recording medium S to the first intermediate transfer belt 7 occurred in the downstream nip 28.

To summarize the results of this Experiment Example 4, it can be concluded that the retransfer of the color toner image from the recording medium S to the first intermediate transfer belt 7 can be prevented by setting the transfer pressure between the electroconductive rollers 13 and 24 of the upstream nip 27 to be the same as or greater than the transfer pressure between the electroconductive rollers 14 and 25 of the downstream nip 28.

EXPERIMENT EXAMPLE 5

In this Experiment Example 5, we examined the relationship between the hardness of the electroconductive rollers 13 and 24 of the upstream nip 27, and the hardness of the electroconductive rollers 14 and 25 of the downstream nip 28. In this example, conditions other than the hardness of the electroconductive rollers 13 and 24 and the electroconductive rollers 14 and 25 were such that retransfer could be prevented (see the other experiment examples).

Two-sided transfer to the recording medium S was performed with the hardness of the electroconductive rollers 13 and 24 of the upstream nip 27 set to 51 degrees, and with the hardness of the electroconductive rollers 14 and 25 of the downstream nip 28 set to 38 degrees, after which the images were fixed by the fixing apparatus 30. The fixed images were examined, which confirmed that good images had been formed on both sides. This tells us that no retransfer of the color toner images from the recording medium S to the first intermediate transfer belt 7 occurred in the downstream nip 28.

Next, two-sided transfer to the recording medium S was performed with the hardness of the electroconductive rollers 13 and 24 of the upstream nip 27 set to 48 degrees, and with the hardness of the electroconductive rollers 14 and 25 of the downstream nip 28 set to 48 degrees, after which the images were fixed by the fixing apparatus 30. The fixed images were examined, which confirmed that good images had been formed on both sides. This tells us that there was no retransfer of the color toner images from the recording medium S to the first intermediate transfer belt 7 in the downstream nip 28.

Two-sided transfer to the recording medium S was performed with the hardness of the electroconductive rollers 13 and 24 of the upstream nip 27 set to 38 degrees, and with the hardness of the electroconductive rollers 14 and 25 of the downstream nip 28 set to 51 degrees, after which the images were fixed by the fixing apparatus 30. Examination of the fixed images confirmed that the color toner image transferred from the first intermediate transfer belt 7 was an image with a low transfer ratio on one side of the recording medium S. This tells us that retransfer of the color toner images from the recording medium S to the first intermediate transfer belt 7 occurred in the downstream nip 28.

To summarize the results of this Experiment Example 5, it can be concluded that the retransfer of the color toner image from the recording medium S to the first intermediate transfer belt 7 can be prevented by setting the hardness of the electroconductive rollers 13 and 24 of the upstream nip 27 to be the same as or greater than the hardness of the electroconductive rollers 14 and 25 of the downstream nip 28.

EXPERIMENT EXAMPLE 6

In this Experiment Example 6, in addition to what was done in Experiment Example 5 above, we examined the relationship of the hardness of the electroconductive rollers 14 and 25 of the downstream nip 28. In this example, conditions other than the hardness of the electroconductive rollers 14 and 25 were such that retransfer could be prevented (see the other experiment examples).

Two-sided transfer to the recording medium S was performed with the hardness of the electroconductive roller (application roller) 25 in the downstream nip 28 set to 51 degrees and the hardness of the electroconductive roller (ground roller) 14 set to 38 degrees, and after passing through the downstream nip 28, the recording medium S was conveyed toward the fixing apparatus 30. The recording medium S was conveyed in a state of being affixed to the second intermediate transfer belt 20, and was fed into the fixing apparatus 30 without any jamming occurring.

Next, two-sided transfer to the recording medium S was performed with the hardness of the electroconductive roller (application roller) 25 in the downstream nip 28 set to 48 degrees and the hardness of the electroconductive roller (ground roller) 14 set to 48 degrees, and after passing through the downstream nip 28, the recording medium S was conveyed toward the fixing apparatus 30. The recording medium S was conveyed in a state of being affixed to the second intermediate transfer belt 20, and was fed into the fixing apparatus 30 without any jamming occurring.

Next, two-sided transfer to the recording medium S was performed with the hardness of the electroconductive roller (application roller) 25 in the downstream nip 28 set to 38 degrees and the hardness of the electroconductive roller (ground roller) 14 set to 51 degrees, and after passing through the downstream nip 28, the recording medium S was conveyed toward the fixing apparatus 30. After passing through the downstream nip 28, the recording medium S separated from the second intermediate transfer belt 20 and resulted in a jam, without being fed into the fixing apparatus 30.

To summarize the results of this Experiment Example 6, it can be concluded that the recording medium S that has passed through the downstream nip 28 will be conveyed to the fixing apparatus 30 in a state of being affixed to the second intermediate transfer belt 20, and jamming of the recording medium S at the entry to the fixing apparatus 30 can be prevented, by setting the hardness of the electroconductive rollers 14 and 25 of the downstream nip 28 such that the hardness of the electroconductive roller 25, which is located on the side of the second intermediate transfer belt 20, which is disposed so as to be closer to the fixing apparatus 30 than the first intermediate transfer belt 7, is the same as or greater than the hardness of the other electroconductive roller 14.

In this second embodiment, just as in the first embodiment given above, an example was given in which the electroconductive roller 24 at the upstream nip 27 was an application roller and the electroconductive roller 13 was a ground roller, but the electroconductive roller 13 may instead by an application roller and the electroconductive roller 24 a ground roller. Similarly, in this example the electroconductive roller 25 at the downstream nip 28 was an application roller and the electroconductive roller 14 was a ground roller, but the electroconductive roller 14 may instead be an application roller and the electroconductive roller 25 a ground roller. Also, an example was given in which the color toner image on the first intermediate transfer belt 7 was transferred onto the recording medium S at the upstream nip 27, and the color toner image on the second intermediate transfer belt 20 was transferred onto the recording medium S at the downstream nip 28, but the constitution may instead be such that the color toner image on the second intermediate transfer belt 20 is transferred onto the recording medium S at the upstream nip 27, and the color toner image on the first intermediate transfer belt 7 is transferred onto the recording medium S at the downstream nip 28.

The second embodiment given above has the following effects.

(1) If the absolute value of the transfer current applied to the application roller located in the upstream nip is set to be the same as or greater than the absolute value of the transfer current applied to the application roller located in the downstream nip, then the force that holds the toner image on the recording medium, which is generated by applying transfer current to the application roller of the upstream nip, will be substantially the same as or greater than the force acting to retransfer the toner image from the recording medium back to the first or second image support, which is generated by applying transfer current to the application roller of the downstream nip, so the toner image transferred from the first or second image support to the recording medium in the upstream nip will be less apt to be retransferred back to the first or second image support in the downstream nip, which affords an increase in the quality of the images formed on both sides of the recording medium.

(2) Since the transfer currents applied to the application roller located at the upstream nip and to the application roller located at the downstream nip can be varied according to the thickness of the transfer method, when recording media of different thicknesses are used, a transfer current suited to that thickness can be applied to the application roller, which prevents the occurrence of poor transfer that would be caused by the application of too much or too little transfer current.

(3) Since there is a paper thickness detector disposed along the conveyance path of the recording medium as a member for detecting the thickness of the recording medium, the thickness of the recording medium can be detected very quickly.

(4) If the nip width of the upstream nip is set to be the same as or greater than the nip width of the downstream nip, then the force that transfers the toner image on the first or second image support to the recording medium at the upstream nip will be substantially the same as or greater than the force acting to retransfer the toner image from the recording medium back to the first or second image support at the downstream nip, so the toner image transferred from the first or second image support to the recording medium in the upstream nip will be less apt to be retransferred back to the first or second image support in the downstream nip, which affords an increase in the quality of the images formed on both sides of the recording medium.

(5) If the transfer pressure of the upstream nip is set to be the same as or greater than the transfer pressure of the downstream nip, then the force that transfers the toner image on the first or second image support to the recording medium at the upstream nip will be substantially the same as or greater than the force acting to retransfer the toner image from the recording medium back to the first or second image support at the downstream nip, so the toner image transferred from the first or second image support to the recording medium in the upstream nip will be less apt to be retransferred back to the first or second image support in the downstream nip, which affords an increase in the quality of the images formed on both sides of the recording medium.

(6) If the hardness of the electroconductive roller of the upstream nip is set to be the same as or greater than the hardness of the electroconductive roller of the downstream nip, then the force that transfers the toner image on the first or second image support to the recording medium at the upstream nip will be substantially the same as or greater than the force acting to retransfer the toner image from the recording medium back to the first or second image support at the downstream nip, so the toner image transferred from the first or second image support to the recording medium in the upstream nip will be less apt to be retransferred back to the first or second image support in the downstream nip, which affords an increase in the quality of the images formed on both sides of the recording medium.

(7) Since the hardness of the pair of electroconductive rollers forming the upstream nip is set such that the hardness of the electroconductive roller located on the side of the first or second image support which is disposed so as to be closer to the fixing apparatus than the other image support, is the same as or greater than the hardness of the other electroconductive roller, the recording medium that has passed through the downstream nip will be conveyed to the fixing apparatus in a state of being affixed to the image support that moves closest to the fixing apparatus, which prevents the recording medium from jamming prior to entering the fixing apparatus.

Third Embodiment

A third embodiment will now be described in detail through reference to the drawings. FIGS. 2 and 3 and the descriptions thereof referred to in the first and second embodiments above apply substantially equally to this embodiment, and therefore these descriptions will not be repeated here, and mainly just the points of difference will be described.

Figure 12:
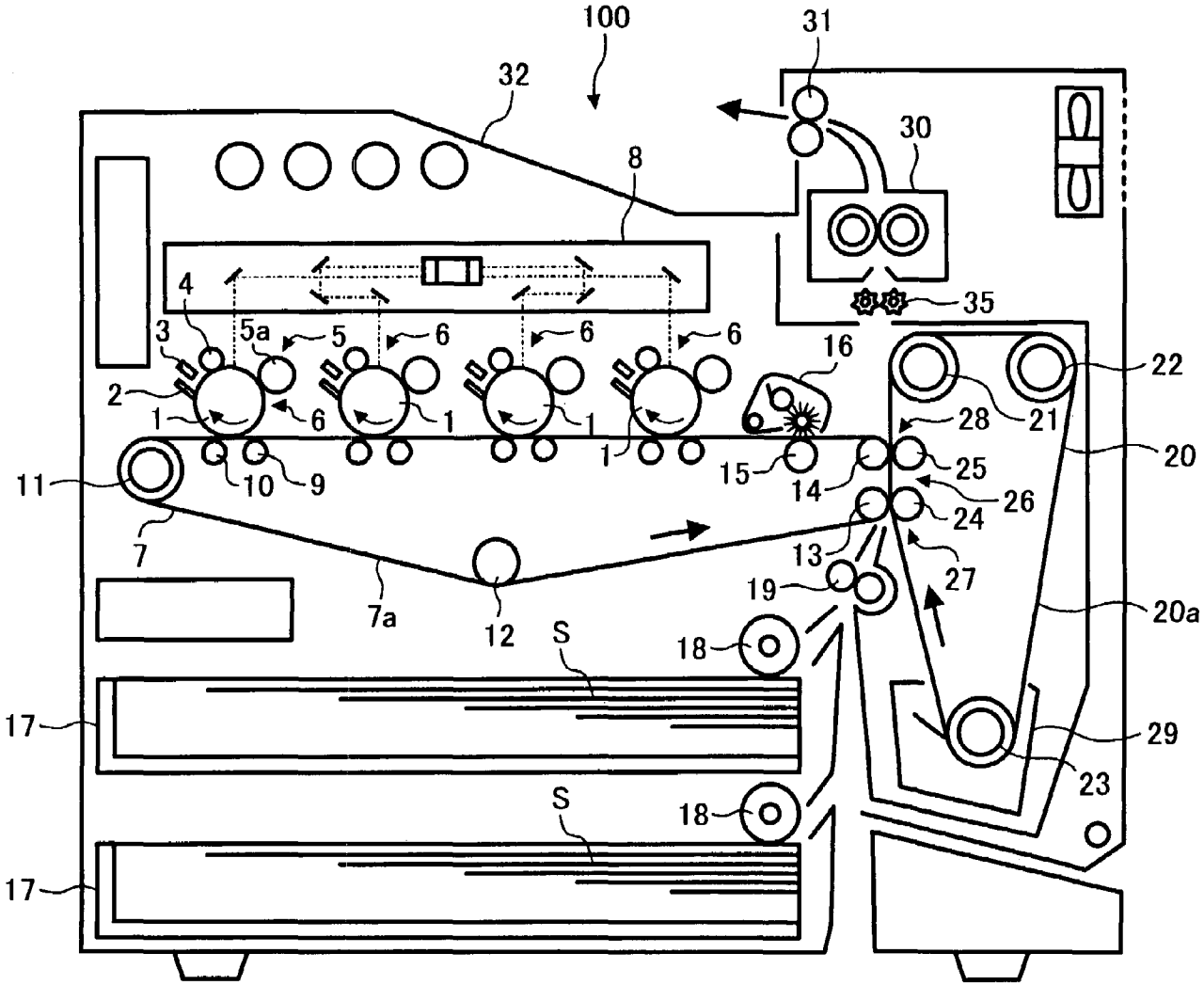
FIG. 12 is a cross section illustrating the simplified structure of a color printer in a third embodiment of the present invention.

As shown in FIG. 12, the color printer 100 in this embodiment is the same as the color printer 100 shown in FIG. 2, except for the addition of spurs 35 (discussed below).

Figure 13:
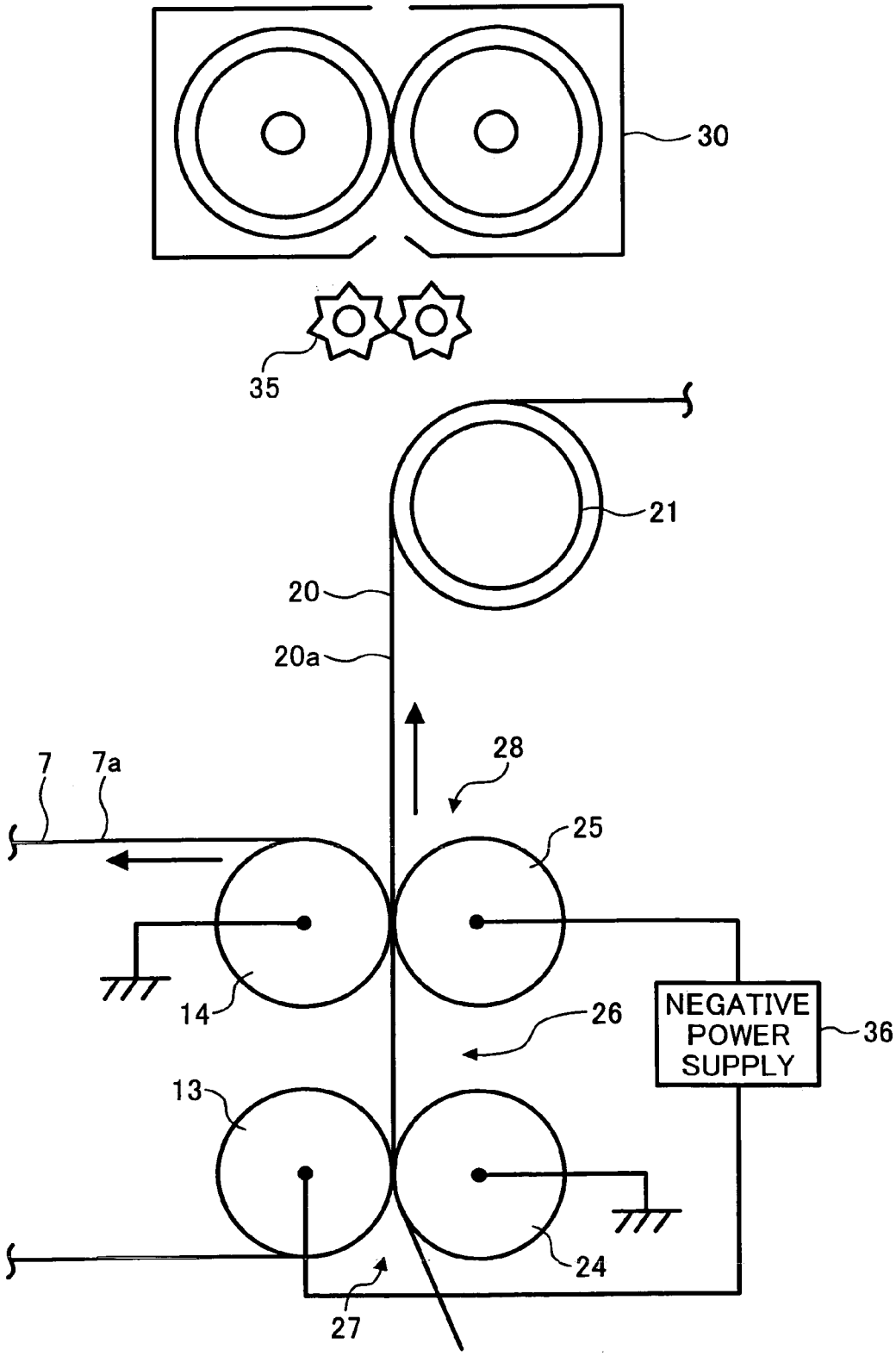
FIG. 13 is an enlarged front view of the structure of the area around the contact region of this color printer.

FIG. 13 shows the structure of the area around the contact region 26 of the color printer 100 pertaining to this third embodiment. As shown in the drawing, of the pair of electroconductive rollers 13 and 24 forming the upstream nip 27, the electroconductive roller 13 serves as an application roller to which transfer current is applied, while the electroconductive roller 24 serves as a ground roller that is grounded. Of the pair of electroconductive rollers 14 and 25 forming the downstream nip 28, the electroconductive roller 25 serves as an application roller to which transfer current is applied, while the electroconductive roller 14 serves as a ground roller that is grounded. The application rollers 13 and 25 are connected to a power supply 36 for applying a transfer current.

The above-mentioned spurs 35 are provided as a nip on the side of the fixing apparatus 30, for sandwiching the recording medium S that has passed through the contact region 26, and are provided on the entry side of the fixing apparatus 30 in the conveyance direction of the recording medium S that has passed through the contact region 26.

Here, this color printer 100 is provided with a controller (not shown) for controlling the various components according to a preinstalled program according to the detection results of various sensors, inputted data, and so on. Switching the power supply 36 on and off, switching the resist rollers 19 on and off, and so forth are controlled by the controller on the basis of detection results from a sensor (not shown) that detects the conveyance of the recording medium S.

We will now describe the operation of two-side printing in which color toner images are transferred to both sides of the recording medium S in a single pass with the color printer 100 constituted as above.

First, the toner images of various colors produced by the imaging units 6 are successively transferred from the photosensitive drums 1 onto the first intermediate transfer belt 7 by the action of the transfer rollers 9, forming a color toner image on the first intermediate transfer belt 7. The toner that forms this color toner image is assumed to be negatively charged. At the point when the color toner image formed on the first intermediate transfer belt 7 passes through the contact region 26, a negative transfer current is applied from the power supply 36 to the application roller 13, and the color toner image is transferred onto the second intermediate transfer belt 20. This color toner image transferred onto the second intermediate transfer belt 20 becomes a first side image (back image) when transferred to the recording medium S. The color toner image (first side image) transferred onto the second intermediate transfer belt 20 moves along with the rotation of the second intermediate transfer belt 20.

When the first side image is transferred from the first intermediate transfer belt 7 to the second intermediate transfer belt 20, the formation of the second side image (the image transferred to the front side of the recording medium S) is commenced by the imaging units 6, the toner images on the photosensitive drums 1 of the various imaging units 6 are successively transferred onto the first intermediate transfer belt 7 by the action of the transfer rollers 9, and a color toner image (second side image) is formed on the first intermediate transfer belt 7. The color toner image on the second intermediate transfer belt 20 (first side image) and the color toner image on the first intermediate transfer belt 7 (second side image) are carried toward the contact region 26 along with the rotation of the first intermediate transfer belt 7 and the second intermediate transfer belt 20.

The recording medium S fed out by the resist rollers 19 enters the contact region 26 at the point when the color toner image on the second intermediate transfer belt 20 (first side image) and the color toner image on the first intermediate transfer belt 7 (second side image) have been brought to the contact region 26. The color toner image on the second intermediate transfer belt 20 (first side image) is transferred to one side of the recording medium S that has entered the contact region 26, and the color toner image on the first intermediate transfer belt 7 (second side image) is transferred to the other side of the recording medium S.

Figure 14:
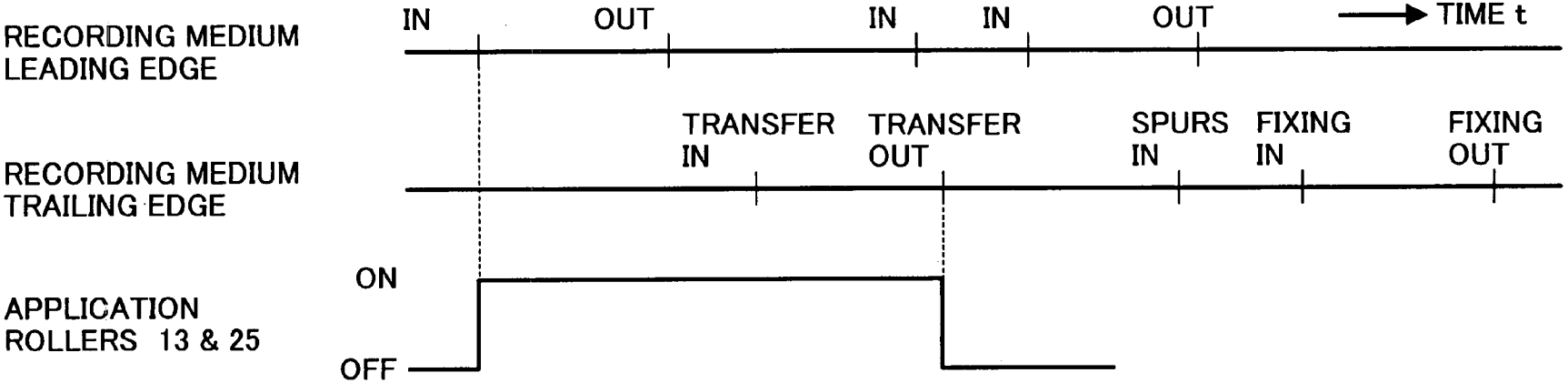
FIG. 14 is a timing chart illustrating the steps of transferring a first side image and second side image onto both sides of the recording medium of this color printer.

The steps entailed in the transfer of the first side image and second side image to the two sides of the recording medium S will now be described in detail through reference to the timing chart of FIG. 14.

At the point when the color toner image on the second intermediate transfer belt 20 (first side image) and the color toner image on the first intermediate transfer belt 7 (second side image) are brought into the contact region 26, as soon as the leading edge of the recording medium S fed out by the resist rollers 19 reaches the upstream nip 27 in the contact region 26 ("transfer IN"), the power supply 36 is switched on at that point, and a transfer current of −30 μA is simultaneously applied to the application roller 13 on the upstream side and the application roller 25 on the downstream side. "Transfer OUT" at the leading edge of the recording medium S is the point at which the leading edge of the recording medium S passes through the downstream nip 28.

When transfer current is applied to the upstream application roller 13, the color toner image on the first intermediate transfer belt 7 (second side image) is transferred to one side of the recording medium S by the repulsion between the negatively charged toner and the negative charge of the transfer current. At this point, the transfer current applied to the application roller 13 flows to the first and second intermediate transfer belts 7 and 20, and the majority thereof flows to the ground roller 24. When transfer current is applied to the downstream application roller 25, the color toner image on the second intermediate transfer belt 20 (first side image) is transferred to the other side of the recording medium S by the repulsion between the negatively charged toner and the negative charge of the transfer current. At this point, the transfer current applied to the application roller 25 flows to the second and first intermediate transfer belts 20 and 7, and the majority thereof flows to the ground roller 14.

After this, when the trailing edge of the recording medium S passes through the downstream nip 28 ("transfer OUT"), the power supply 36 is switched off at that point, and the application of transfer current to the application rollers 13 and 25 is ended simultaneously. The leading edge of the recording medium S is sandwiched by the spurs 35[5] ("spurs IN") prior to the passage of the trailing edge of the recording medium S through the downstream nip 28. Therefore, ever after the transfer current has been switched off and the second intermediate transfer belt 20 and recording medium S are not longer held together electrostatically, the conveyance of the recording medium S to the fixing apparatus 30 is kept stable by the action of the spurs 35.[5]

Figure 15:
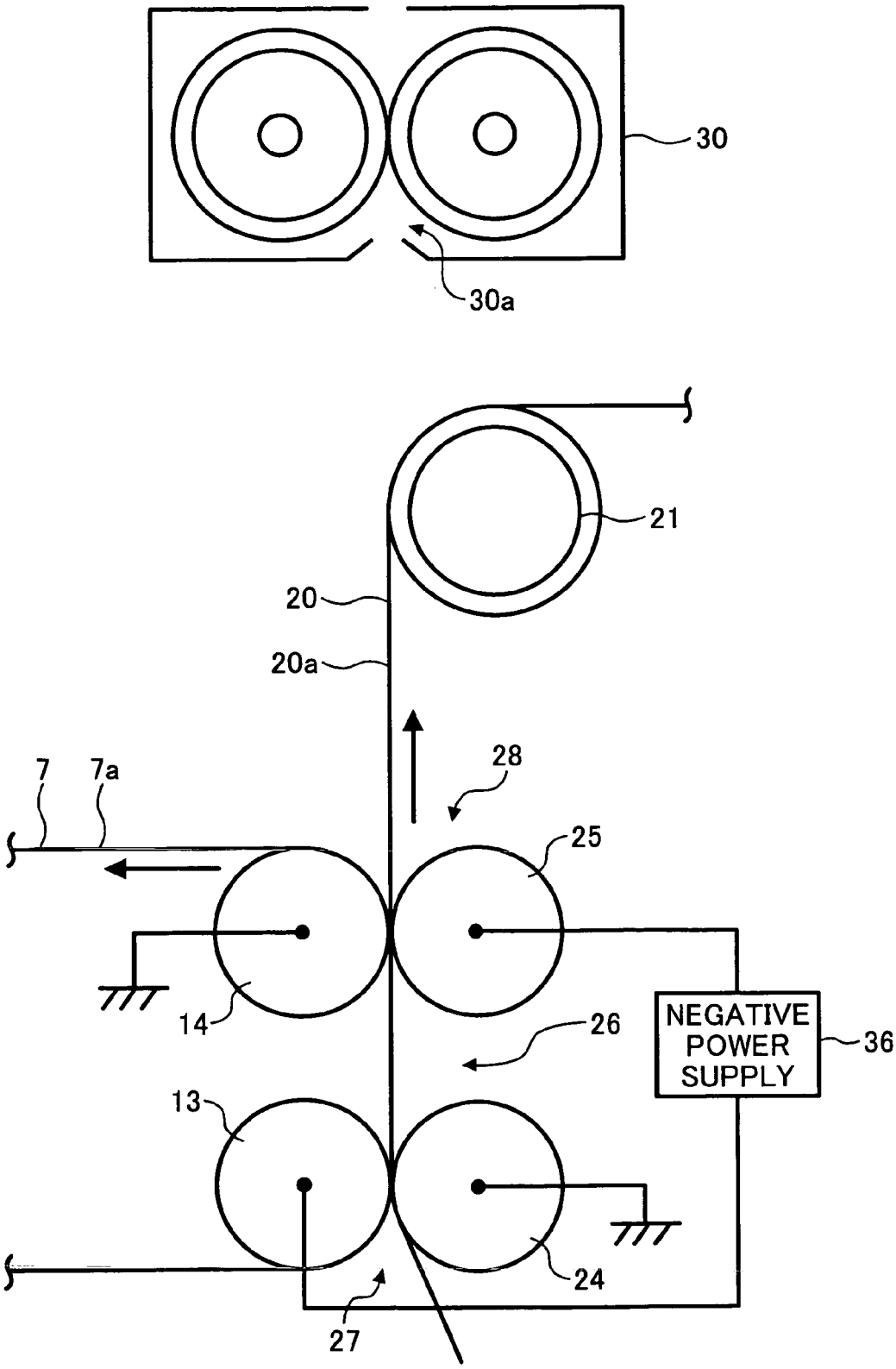
FIG. 15 is an enlarged front view of the structure of the area around the contact region in a modification of this third embodiment.
Figure 16:
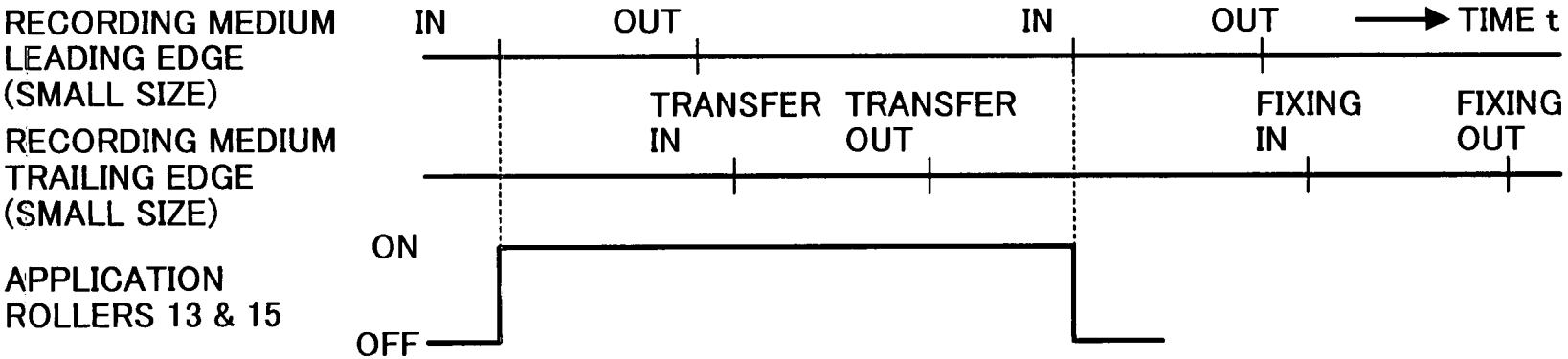
FIG. 16 is a timing chart illustrating the steps of transferring a first side image and second side image onto both sides of a small recording medium of this color printer.
Figure 17:
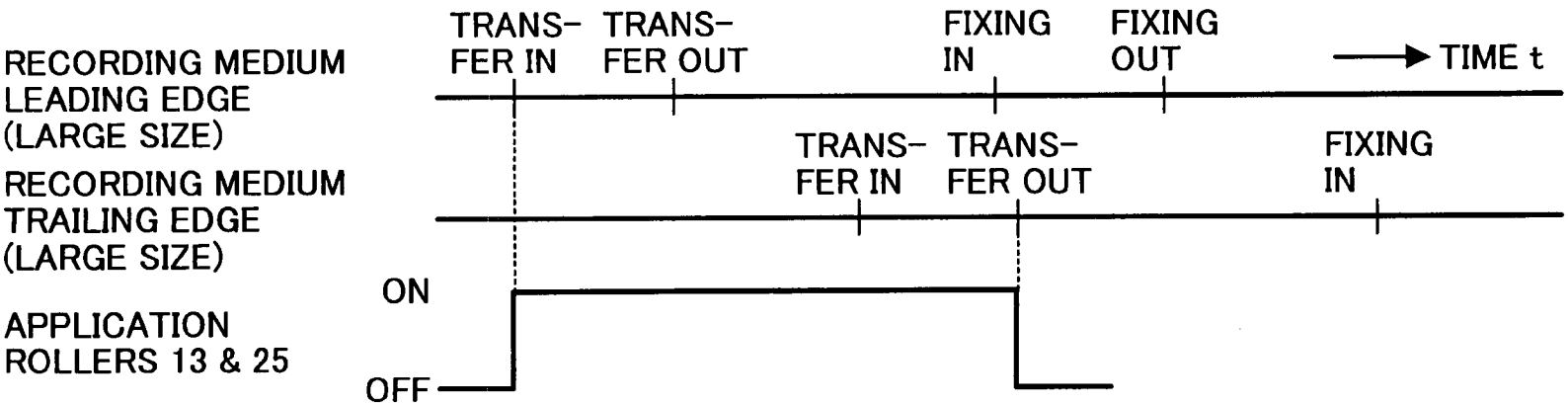
FIG. 17 is a timing chart illustrating the steps of transferring a first side image and second side image onto both sides of a large recording medium of this color printer.

A case in which the spurs 35 are not provided in this embodiment will now be described through reference to FIG. 15. FIG. 16 is a timing chart of when images are formed on a small recording medium S, and FIG. 17 is a timing chart of when images are formed on a large recording medium S.

First, the steps entailed in transferring the first side image and second side image to the two sides of a small recording medium S will be described in detail through reference to FIG. 16.

At the point when the color toner image on the second intermediate transfer belt 20 (first side image) and the color toner image on the first intermediate transfer belt 7 (second side image) are brought into the contact region 26, as soon as the leading edge of the recording medium S fed out by the resist rollers 19 reaches the upstream nip 27 in the contact region 26 ("transfer IN"), the power supply 36 is switched on at that point, and a transfer current of −30 μA is simultaneously applied to the application roller 13 on the upstream side and the application roller 25 on the downstream side.

When transfer current is applied to the upstream application roller 13, the color toner image on the first intermediate transfer belt 7 (second side image) is transferred to one side of the recording medium S just as described in this embodiment. When transfer current is applied to the downstream application roller 25, the color toner image on the second intermediate transfer belt 20 (first side image) is transferred to the other side of the recording medium S just as described in this embodiment.

After this, the application of transfer current to the application rollers 13 and 25 is maintained even after the trailing edge of the recording medium S passes through the downstream nip 28 ("transfer OUT"). At the point when the leading edge of the recording medium S has reached a nip 30*a* (see FIG. 15) on the fixing apparatus 30 side ("fixing IN"), the power supply 36 is switched off and the application of transfer current to the application rollers 13 and 25 is ended simultaneously. Accordingly, even after the trailing edge of the recording medium S has passed through the downstream nip 28, the application of transfer current to the application rollers 13 and 25 is maintained until the leading edge of the recording medium S reaches the nip 30*a* on the fixing apparatus 30 side, and as a result the recording medium S, whose trailing edge has passed through the downstream nip 28, is kept electrostatically held against the second intermediate transfer belt 20, allowing the recording medium S to be conveyed stably all the way to the fixing apparatus 30.

Next, the steps entailed in transferring the first side image and second side image to the two sides of a large recording medium S will be described in detail through reference to FIG. 17.

At the point when the color toner image on the second intermediate transfer belt 20 (first side image) and the color toner image on the first intermediate transfer belt 7 (second side image) are brought into the contact region 26, as soon as the leading edge of the recording medium S fed out by the resist rollers 19 reaches the upstream nip 27 in the contact region 26 ("transfer IN"), the power supply 36 is switched on at that point, and a transfer current of −30 μA is simultaneously applied to the application roller 13 on the upstream side and the application roller 25 on the downstream side.

When transfer current is applied to the upstream application roller 13, the color toner image on the first intermediate transfer belt 7 (second side image) is transferred to one side of the recording medium S just as described in this embodiment. When transfer current is applied to the downstream application roller 25, the color toner image on the second intermediate transfer belt 20 (first side image) is transferred to the other side of the recording medium S just as described in this embodiment.

After this, even after the leading edge of the recording medium S reaches the nip 30*a* of the fixing apparatus 30 ("transfer IN"), the application of transfer current to the application rollers 13 and 25 is maintained until the trailing edge of the recording medium S passes through the downstream nip 28, and at the point when the trailing edge of the recording medium S has passed through the downstream nip 28 ("transfer OUT"), the application of transfer current to the application rollers 13 and 25 is ended simultaneously. Accordingly, the application of transfer current to the application rollers 13 and 25 will never be switched off right in the middle of transfer of the toner images on the downstream nip 28 side, affording more reliable transfer of the toner images to the two sides of the recording medium S.

Figure 18:
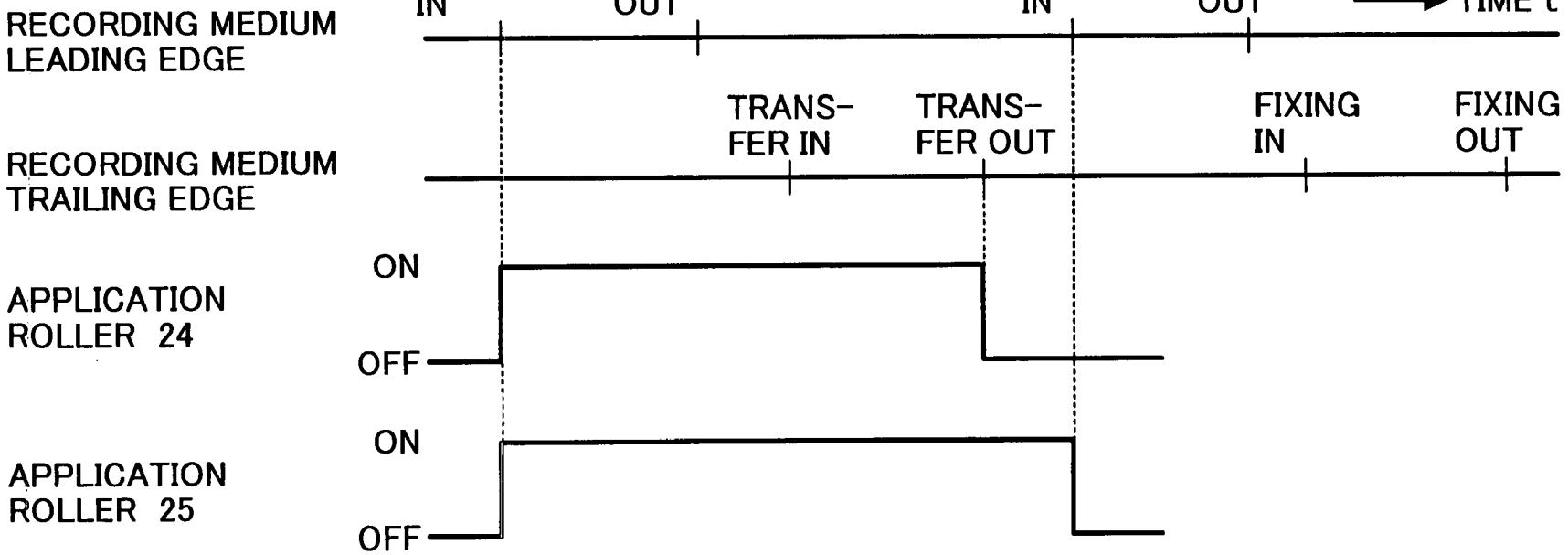
FIG. 18 is a timing chart illustrating the steps of transferring a first side image and second side image onto both sides of the recording medium of this color printer.

Next, the steps entailed in transferring the first side image and second side image to the two sides of the recording medium S in a modification of this embodiment will be described in detail through reference to the timing chart of FIG. 18.

As shown in FIG. 5, at the point when At the point when the color toner image on the second intermediate transfer belt 20 (first side image) and the color toner image on the first intermediate transfer belt 7 (second side image) are brought into the contact region 26, as soon as the leading edge of the recording medium S fed out by the resist rollers 19 reaches the upstream nip 27 in the contact region 26 ("transfer IN"), the power supplies 33 and 34 are switched on, at that point, a transfer current of +50 μA is applied to the upstream application roller 24, and a transfer current of −30 μA is applied to the downstream application roller 25.

When the positive transfer current is applied to the upstream application roller 24 the color toner image on the first intermediate transfer belt 7 (second side image) is transferred to one side of the recording medium S by the attraction between the negatively charged toner and the positive charge of the transfer current. At this point, the transfer current applied to the application roller 24 flows to the second and first intermediate transfer belts 20 and 7, and the majority thereof flows to the ground roller 13. When negative transfer current is applied to the downstream application roller 25, the color toner image on the second intermediate transfer belt 20 (first side image) is transferred to the other side of the recording medium S by the repulsion between the negatively charged toner and the negative charge of the transfer current. At this point, the transfer current applied to the application roller 25 flows to the second and first intermediate transfer belts 20 and 7, and the majority thereof flows to the ground roller 14.

After this, when the trailing edge of the recording medium S passes through the downstream nip. 28 ("transfer OUT"), even though the leading edge of the recording medium S has yet to reach the nip 30*a* on the fixing apparatus 30 side, the power supply 33 is switched off and the application of transfer current to the application roller 24 is ended. After this, at the point when the leading edge of the recording medium S reaches the nip 30*a* of the fixing apparatus 30 ("fixing IN"), the power supply 34 is switched off and the application of transfer current to the application roller 25 is ended.

Accordingly, even after the trailing edge of the recording medium S has passed through the downstream nip 28, the application of transfer current to the application roller 25 is maintained until the leading edge of the recording medium S reaches the nip 30*a* on the fixing apparatus 30 side, so the recording medium S, whose trailing edge has passed through the downstream nip 28, is kept electrostatically held against the second intermediate transfer belt 20, allowing the recording medium S to be conveyed stably all the way to the fixing apparatus 30. Furthermore, even after the trailing edge of the recording medium S passes through the downstream nip 28, the power supply 33 is off and only the power supply 34 is on until the leading edge of the recording medium S enters the nip 30*a* on the fixing apparatus 30 side, so power consumption is reduced, and this also prevents the deterioration of parts that would accompany the application of transfer current because transfer current is applied to the application roller 25 for a shorter time, so the durability of the application roller 25 and other parts is improved.

The third embodiment given above has the following effects.

(1) If the application of transfer current to the two application rollers upstream and downstream during transfer to both sides of the recording medium is timed to be when or before the leading edge of the recording medium reaches the upstream nip, then there will be no change in the behavior of the transfer current applied to the upstream application roller, as occurs when transfer current is applied to the downstream application roller at a point after the start of transfer on the upstream side by applying transfer current to the upstream application roller, and it is therefore possible to prevent the changes in density of the toner image transferred to the recording medium that occur as a result of such behavior changes. This improves the quality of the images formed on the recording medium.

(2) Since the start of application of transfer current to the above-mentioned two application rollers upstream and downstream is simultaneous, there is no need to adjust the timing at which transfer current is applied to the two application rollers, which allows for a simpler mechanism for applying the transfer current.

(3) If the application of transfer current to the two application rollers upstream and downstream during transfer to both sides of the recording medium is timed to be after the trailing edge of the recording medium has passed through the downstream nip, then there will be no change in the behavior of the transfer current applied to the downstream application roller, as occurs when the application of transfer current to the upstream application roller is switched off right in the middle of the transfer of a toner image downstream, and it is therefore possible to prevent the changes in density of the toner image transferred to the recording medium that occur as a result of such behavior changes. This improves the quality of the images formed on the recording medium.

(4) Since the end of application of transfer current to the above-mentioned two application rollers upstream and downstream is simultaneous, there is no need to adjust the timing at which transfer current to the two application rollers is switched off, which allows for a simpler mechanism for applying the transfer current.

(5) A single power supply is provided for applying transfer current to the two application rollers upstream and downstream, and since there is only one power supply, the cost is lower.

(6) If the application of transfer current at least one of the two application rollers during transfer to both sides of the recording medium is maintained after the trailing edge of the recording medium has passed through the downstream nip and until the leading edge of the recording medium reaches the nip on the fixing apparatus side, then the recording medium, whose trailing edge has passed through the downstream nip, can be kept electrostatically held against at least one of the first and second image supports, and conveyed stably all the way to the fixing apparatus.

Fourth Embodiment

A fourth embodiment will now be described in detail through reference to the drawings. FIGS. 1 and 2[6] and the descriptions thereof referred to in the first to third embodiments above apply substantially equally to this embodiment, and therefore these descriptions will not be repeated here, and mainly just the points of difference will be described.

Figure 19:
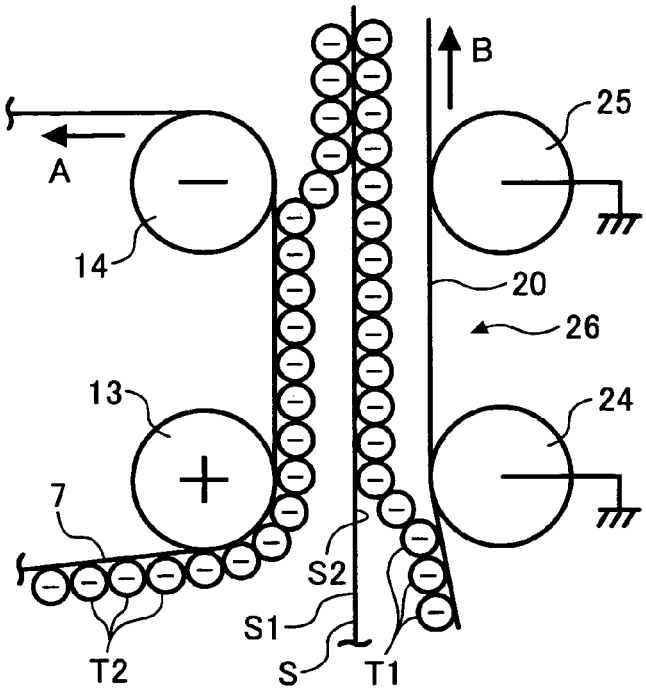
FIG. 19 is a diagram illustrating how toner images are transferred from first and second image supports onto a recording medium in the color printer pertaining to the first embodiment of the present invention.

FIG. 19 shows the structure of the area around the contact region 26 in this embodiment. As shown in the drawing, again in this embodiment, the support roller 13 is constituted as a first transfer member, the support roller 24 across therefrom is constituted as a counter electrode, the support roller 14 is constituted as a second transfer member, and the support roller 25 across therefrom is constituted as a counter electrode. The first transfer member consisting of the support roller 13 is disposed further upstream in the movement direction of the intermediate transfer belts 7 and 20 (first and second image supports) than the second transfer member consisting of the support roller 14. A positive transfer current is applied to the first transfer member consisting of the support roller 13, and a negative transfer current is applied to the second transfer member consisting of the support roller 14. The support roller 24 constituting the counter electrode of the first transfer member, and the support roller 25 constituting the counter electrode of the second transfer member are grounded as in the drawing, or voltage of the opposite polarity from that of the transfer voltage applied to the first and second transfer members is applied.

FIG. 19 schematically illustrates toner particles T1, which constitute a first toner image formed on the second intermediate transfer belt 20, and toner particles T2, which constitute a second toner image formed on the first intermediate transfer belt 7. These toner particles T1 and T2 are both negatively charged. Therefore, the first toner image on the second intermediate transfer belt 20 is electrostatically transferred to one side S2 of the recording medium S fed in between the first and second intermediate transfer belts 7 and 20, which are in contact with each other, by the action of the first transfer member consisting of the support roller 13. Next, the second toner image on the first intermediate transfer belt 7 is electrostatically transferred to the other side S1 of the recording medium S by the action of the second transfer member consisting of the support roller 14.

If negative transfer voltage is applied to the support roller 13 constituting the first transfer member, and positive transfer voltage is applied to the support roller 14 constituting the second transfer member, the second toner image on the first intermediate transfer belt 7 is first transferred to one side S1 of the recording medium S by the action of the first transfer member, and then the first toner image on the second intermediate transfer belt 20 is transferred to the other side S2 of the recording medium S by the action of the second transfer member.

As discussed above, one of the support rollers 13 and 24 is used as the first transfer member, one of the support rollers 14 and 25 is used as the second transfer member, and transfer voltage of appropriate polarity is applied to the first and second transfer members so that the second toner image formed on the first intermediate transfer belt 7 is electrostatically transferred to one side S1 of the recording medium S, and the first toner image formed on the second intermediate transfer belt 20 is electrostatically transferred to the other side S2 of the recording medium S.

In this embodiment, the first and second transfer members were constituted by a support roller for the first intermediate transfer belt 7 or a support roller for the second intermediate transfer belt 20, but it is also possible to use a transfer member consisting of a blade, brush, or transfer charger that discharges from an electrode, for example, along the above-mentioned contact region 26.

Also, with this embodiment, the above-mentioned first and second transfer members can be used when the first toner image formed on the first intermediate transfer belt 7 is transferred to the second intermediate transfer belt 20, or when even just the toner image formed on the first intermediate transfer belt 7 is transferred to one side of the recording medium S, so that an image is only formed on one side of the recording medium S. For example, when the first toner image formed on the first intermediate transfer belt 7 is transferred to the second intermediate transfer belt 20, or the toner image on the first intermediate transfer belt 7 is transferred to the recording medium S, negative transfer voltage is applied to the second transfer member comprising the support roller 14 shown in FIG. 18. Alternatively, negative transfer voltage is applied to the first transfer member comprising the support roller 13, so as to transfer the first toner image on the first intermediate transfer belt 7 onto the second intermediate transfer belt 20, or transfer the toner image on the first intermediate transfer belt 7 to one side of the recording medium S.

Here, as discussed above, when employing a structure in which the first and second transfer members are used to transfer the second toner image on the first intermediate transfer belt 7 to one side of the recording medium S and transfer the first toner image on the second intermediate transfer belt 20 to the other side of the recording medium S, as described above, there is the danger that during the transfer of the toner image on the image support to the recording medium S, the action of the second transfer member will cause the toner image that has already been transferred to the recording medium S by the first transfer member to be electrostatically retransferred back to the image support side. For example, as shown in FIG. 19, when negative transfer voltage is applied to the second transfer member comprising the support roller 14 so as to transfer the second toner image on the first intermediate transfer belt 7 to one side S1 of the recording medium S, there is the danger that the first toner image that has already been transferred to the other side of the recording medium S will be electrostatically retransferred to the surface of the second intermediate transfer belt 20.

In view of this, in this embodiment, if we let E(U) be the transfer electric field formed when transfer voltage is applied to the first transfer member comprising the support roller 13, q1 be the amount of toner charge per unit of volume of the toner image on the second intermediate transfer belt 20 and transferred by the first transfer member, E(D) be the transfer electric field formed when transfer voltage is applied to the second transfer member comprising the support roller 14, and q2 be the amount of toner charge per unit of volume of the toner image on the first intermediate transfer belt 7 and transferred by the action of the second transfer member, then the forces at which the toner images are transferred to the recording medium S are expressed by F(U)=q1×E(U) and F(D)=q2×E(D), and the transfer conditions are set such that the absolute values of these forces are such that F(U)≧F(D).

Therefore, the first transfer member can first be used to transfer the first toner image transferred at a high force from the second intermediate transfer belt 20 to the side S2 of the recording medium S, so that this toner image adheres is bonded under high force to the recording medium S, and then the second transfer member can be used to transfer the second toner image on the first intermediate transfer belt 7 to the other side of the recording medium S at the same or less force than that of the first toner image, and as a result, during the transfer of the second toner image by the second transfer member, there is no problem of the toner image transferred to the side S2 of the recording medium S being retransferred to the second intermediate transfer belt 20 side, or at least this problem can be effectively suppressed. This allows high-quality images to be formed on both sides of the recording medium S.

The technological concepts discussed above can also be applied to structures other than that shown in FIG. 19. The main thing is that if we let E(U) be the transfer electric field formed by the first transfer member, q1 be the amount of toner charge per unit of volume of the toner image transferred by the action of the first transfer member, E(D) be the transfer electric field formed by the second transfer member, and q2 be the amount of toner charge per unit of volume of the toner image transferred by the action of the second transfer member, then the toner image transfer constitutions are set so that the relationship of the absolute values of the forces at which the toner images are transferred onto the recording medium, which are expressed by F(U)=q1×E(U) and F(D)=q2×E(D), is such that F(U)≧F(D).

Figure 20:
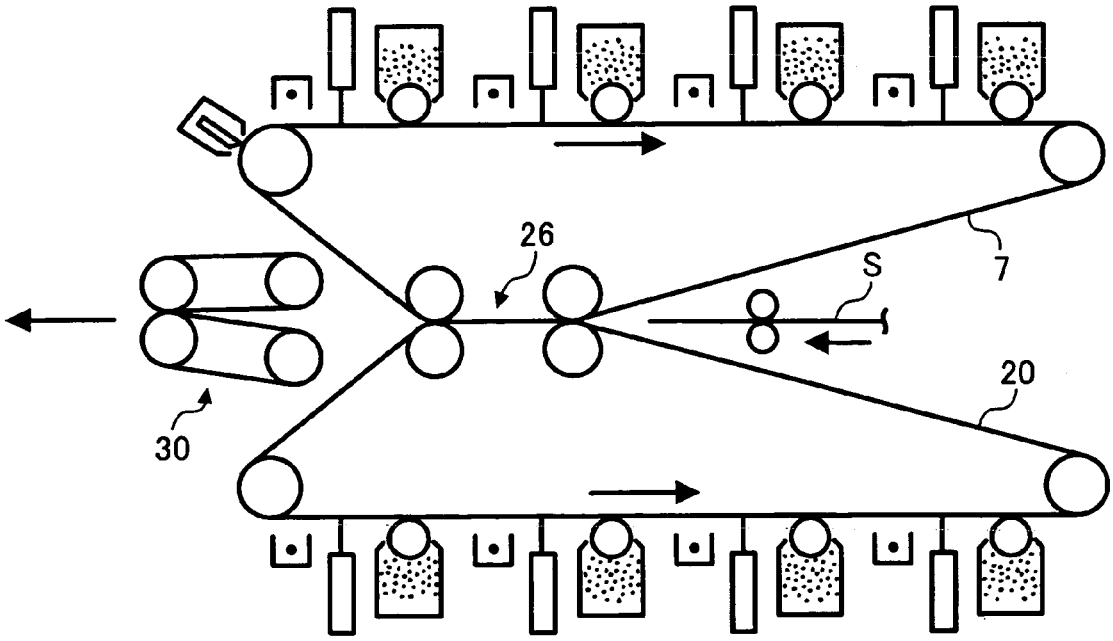
FIG. 20 is an enlarged front view of an example of the structure of the area around the contact region in this color printer.

The technological concepts discussed above can also be broadly applied to structures other than that of the contact region 26 shown in FIG. 19. For example, in the example shown in FIG. 20, the first and second intermediate transfer belts 7 and 20 are both constituted by photosensitive members comprising endless belts wound around a plurality of support rollers, a toner image that is a combination of yellow, magenta, cyan, and black toner images is formed on each of the first and second intermediate transfer belts 7 and 20, these toner images are transferred one to each side of the recording medium S that has been fed into the contact region 26 where the first and second intermediate transfer belts 7 and 20 are in contact with each other, and each of the transferred toner images is fixed by the fixing apparatus 30.

Figure 21:
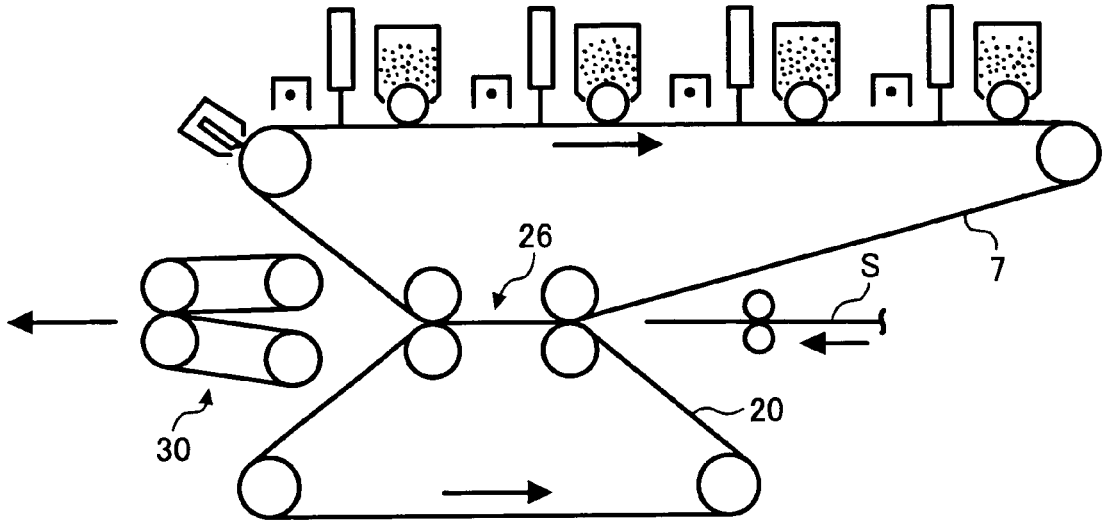
FIGS. 21 to 24 are enlarged front views of other examples of the structure of the area around the contact region in this color printer.

In the example shown in FIG. 21, a first toner image comprising a combination of a plurality of toner images of different colors is formed on the first intermediate transfer belt 7, which is constituted as a photosensitive member comprising an endless belt, this first toner image is transferred to the second intermediate transfer belt 20, which is constituted as an intermediate transfer member comprising an endless belt, a second toner image comprising a combination of toner images is formed again on the first intermediate transfer belt 7, and this second toner image and the first toner image on the second intermediate transfer belt 20 are transferred to the front and back sides of the recording medium S.

Figure 22:
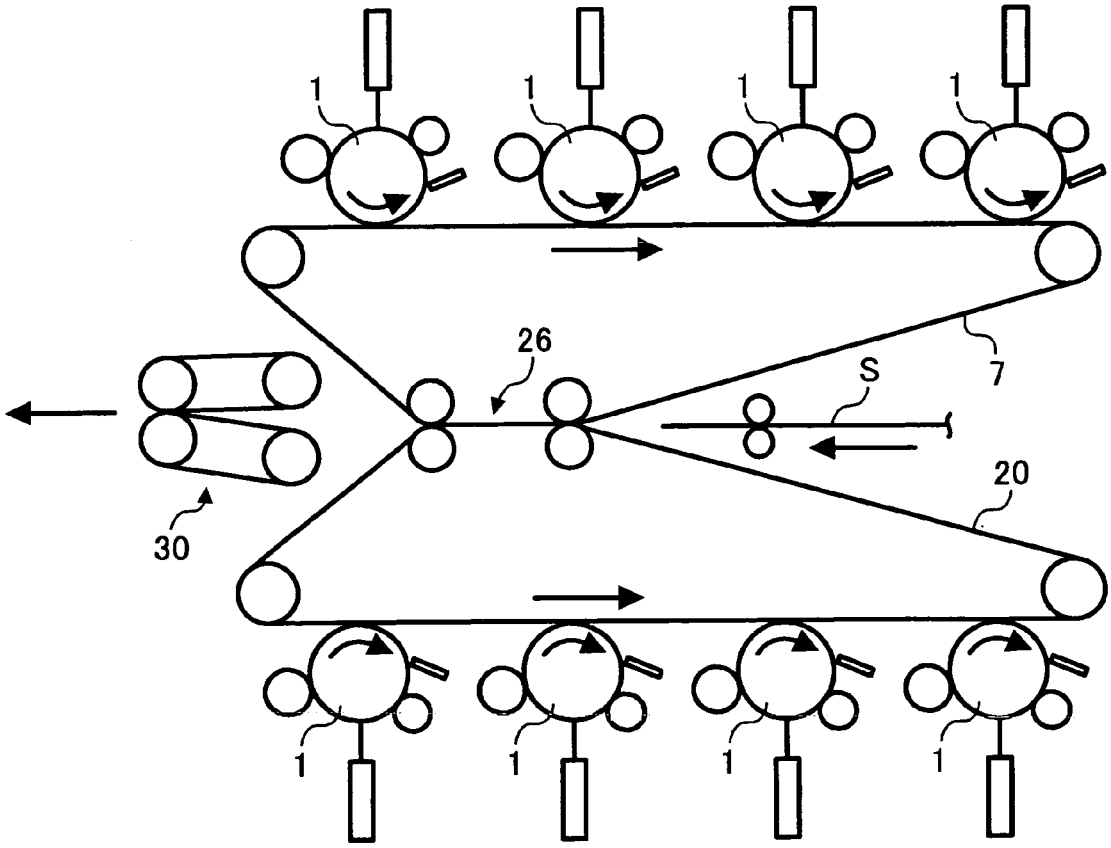

In the example shown in FIG. 22, the first and second intermediate transfer belts 7 and 20 are constituted as photosensitive members comprising endless belts, the toner images of different colors formed on the photosensitive drums 1 are transferred onto the intermediate transfer belts 7 and 20, and these toner images are transferred to the front and back sides of the recording medium S.

Figure 23:
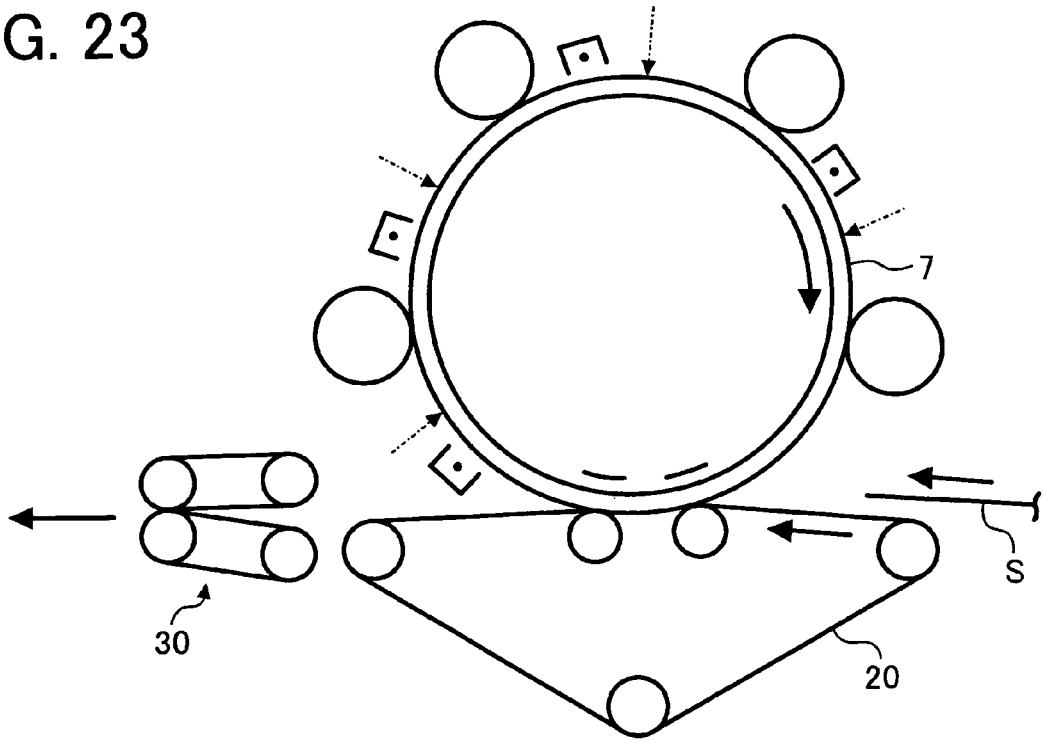

The recording medium S shown in FIG. 23 is constituted by a photosensitive drum 7 (serving as the first image support), a first toner image comprising a combination of four colors is formed on the photosensitive drum 7, and this first toner image is transferred onto the intermediate transfer belt 20, which serves as the second image support, comprising an intermediate transfer member in the form of an endless belt. Next, just as discussed above, the second toner image comprising a combination of four colors is formed on the photosensitive drum 7, and this second toner image and the first toner image on the second intermediate transfer belt 20 are transferred to the front and back sides of the recording medium S.

Figure 24:
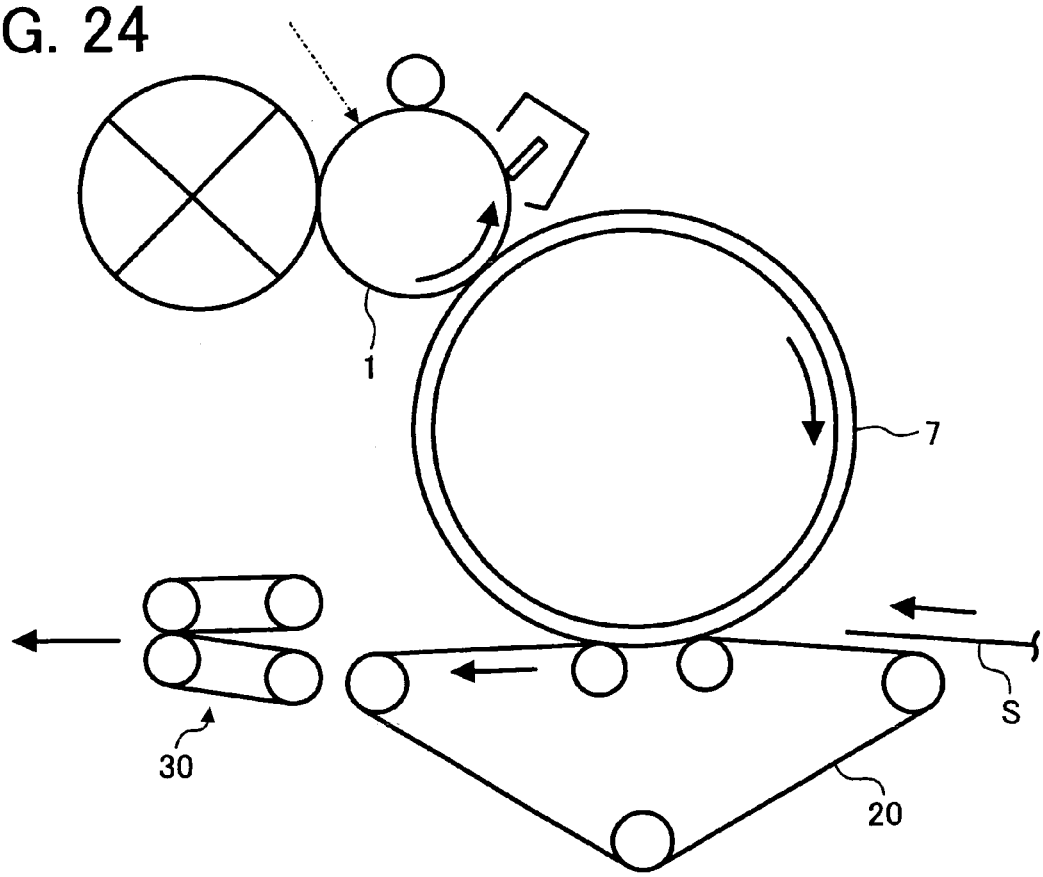

In the example shown in FIG. 24, toner images of different colors are successively formed on a single photosensitive drum 1, these toner images are successively transferred onto the intermediate transfer drum 7 (serving as the first image support), and a first toner image is formed on this intermediate transfer drum 7. This first toner image is transferred onto the intermediate transfer belt 20, which serves as the second image support, comprising an intermediate transfer member in the form of an endless belt. The toner images of different colors are then successively transferred from the photosensitive drum 1 onto the intermediate transfer drum 7, and a second toner image is formed on the intermediate transfer drum 7. This second toner image and the first toner image on the intermediate transfer belt 20 are transferred one to each side of the recording medium S.

The technological concepts described previously can also be applied in the examples shown in FIGS. 20 to 24.

Other specific examples and comparative examples will now be described.

Figure 25:
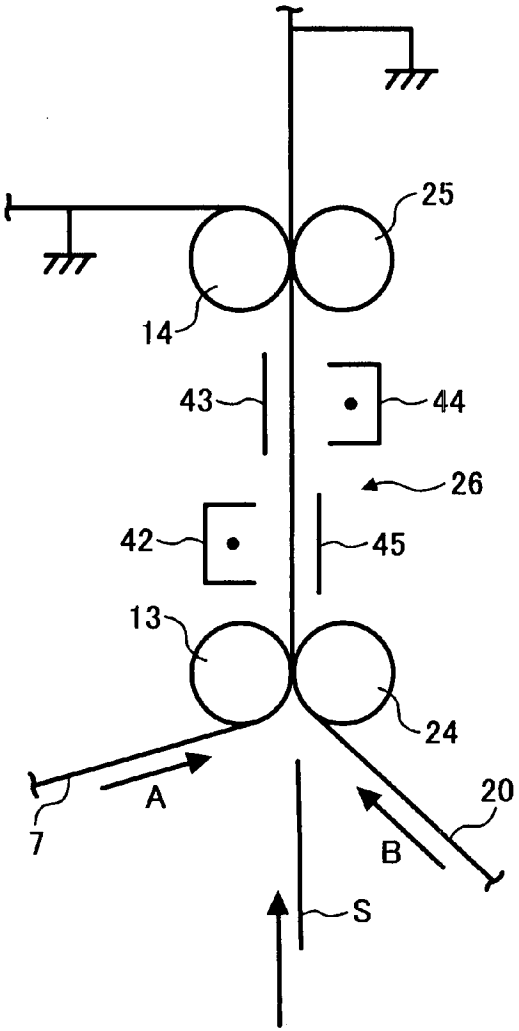
FIG. 25 is a diagram of an example in which the first and second transfer members in this color printer consist of transfer chargers.

FIG. 25 illustrates a specific example in which first and second transfer members comprising first and second transfer chargers 42 and 44 are disposed along the contact region 26 of the above-mentioned first and second intermediate transfer belts 7 and 20. In this example, the support rollers 13, 14, 24, and 25 do not function as transfer members. The first transfer charger 42 is located further upstream in the movement direction of the first and second intermediate transfer belts 7 and 20 than the second transfer charger 44, and the transfer chargers 42 and 44 sandwich the first and second intermediate transfer belts 7 and 20 and are located on mutually opposite sides. The first and second intermediate transfer belts 7 and 20 comprise polyimide belts with a surface resistivity of $10^{11}$ Ω/□ and a volumetric resistivity of $10^{7}$ Ω·cm.

A positive transfer voltage was applied to the first transfer charger 42 so that a transfer current of +300 μA was obtained, and a positive transfer voltage was applied to the second transfer charger 44 so that a transfer current of +150 μA was obtained. The recording medium S was fed in between the first and second intermediate transfer belts 7 and 20, which were in contact with each other, the toner images on the first and second intermediate transfer belts 7 and 20 were transferred one to each side of the recording medium S, and these toner images were each fixed to the recording medium S by the fixing apparatus 30, which produced images of high quality.

As a comparative example, transfer voltages were applied to the two transfer chargers such that a transfer current of +150 μA was obtained with the first transfer charger 42 and a transfer current of +300 μA was obtained with the second transfer charger 44, whereupon satisfactory transfer could be accomplished on only one side of the recording medium S.

Figure 26:
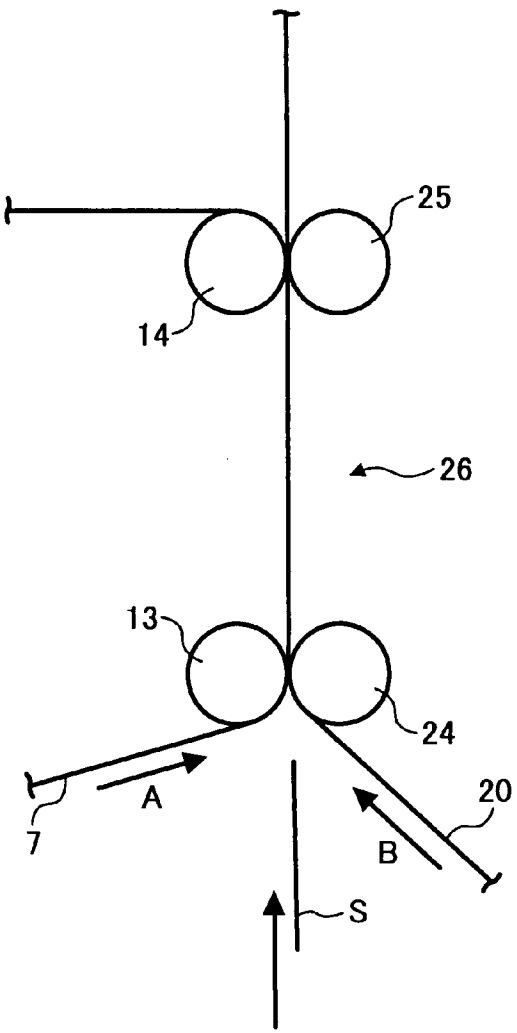
FIG. 26 is a diagram of an example in which the first image support in this color printer consists of a photosensitive member.

In the example shown in FIG. 26, the first image support is constituted by a photosensitive drum 7 comprising an endless belt wound around a plurality of support rollers. Specifically, the first image support comprises a layer of an organic semiconductor (a photoconductive substance) provided to the surface of a heat-resistant (thermal deformation transfer of at least 350° C.) belt and based on rubber. The second image support is constituted by the intermediate transfer belt 20 in the form of an endless polyimide belt with a surface resistivity of $10^{12}$ Ω/□ and a volumetric resistivity of $10^{8}$ Ω·cm. The photosensitive drum 7 and the intermediate transfer belt 20 are drive in the directions of the arrows A and B, respectively, and the portion of the first image support between the support rollers 13 and 14 and the portion of the second image support between the support rollers 24 and 25 are in contact with each other in the contact region 26.

Just as in FIG. 19, the support rollers 13 and 14 are constituted as first and second transfer members, the support rollers 24 and 25 opposing these support rollers 13 and 14 are constituted as counter electrodes, and the first support roller 13 is located further upstream in the movement direction of the first and second image supports 7 and 20 than the second support roller 14. The support rollers 13 and 14 are made of electroconductive rubber, and the support rollers 13 and 24 and the support rollers 14 and 25 are pressed together at a transfer pressure of 22 N and a nip width of 2.5 mm via the first and second image supports 7 and 20.

The first toner image formed on the first image support 7 was transferred onto the second image support 20 by the second transfer member comprising the support roller 14 to which a negative transfer voltage was applied, and this first toner image and the second toner image formed subsequently on the first image support 7 were transferred one to each side of the recording medium S that had been fed in between the image supports 7 and 20, which were in contact with each other. The polarity of the toner charge was negative. Here, a positive transfer voltage (for a transfer current of +50 μA) was applied to the support roller 13 (the first transfer member on the upstream side), a negative transfer voltage (for a transfer current of −30 μA) was applied to the support roller 14 (the second transfer member on the downstream side), and the first and second toner images on the second and first image supports 20 and 7 were transferred one to each side of the recording medium S. These toner images were fixed to the respective sides of the recording medium S by the fixing apparatus 30, which produced images of high quality on both sides of the recording medium S.

As a comparative example, transfer voltages were applied to the upstream support roller 13 and the downstream support roller 14 shown in FIG. 26 so as to produce transfer currents of +30 μA and −50 μA, and the transfer operation was conducted such that the relationship between the above-mentioned absolute force values would be $F(D) \geqq F(U)$, whereupon satisfactory transfer could be accomplished on only one side of the recording medium S.

If, as shown in FIG. 25, non-contact transfer members that do not come into contact with the first and second image supports 7 and 20 are used as the first and second transfer members and their counter electrodes 45 and 43, a large electrical charge may remain in the first and second image supports 7 and 20 after toner image transfer, which can adversely affect the quality of the toner images subsequently formed on these image supports. Therefore, in a case such as this, it is preferable to provide a static elimination means for removing any residual charge in the first and second image supports 7 and 20 after toner image transfer. In the example shown in FIG. 25, this residual charge is eliminated by grounding the first and second image supports 7 and 20.

Figure 28:
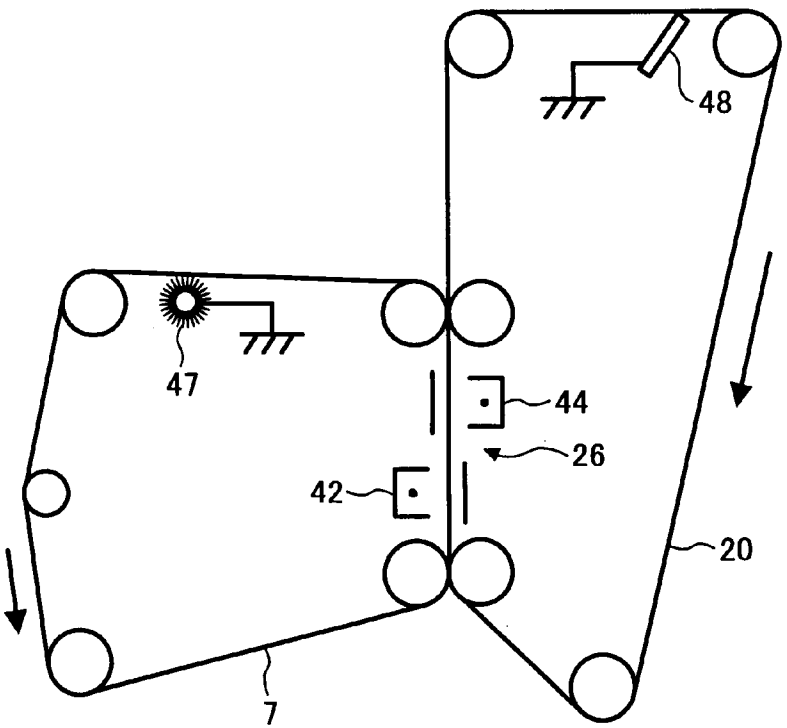
FIGS. 27 and 28 are diagrams of other examples of the structure of the area around the contact region in this color printer.
Figure 27:
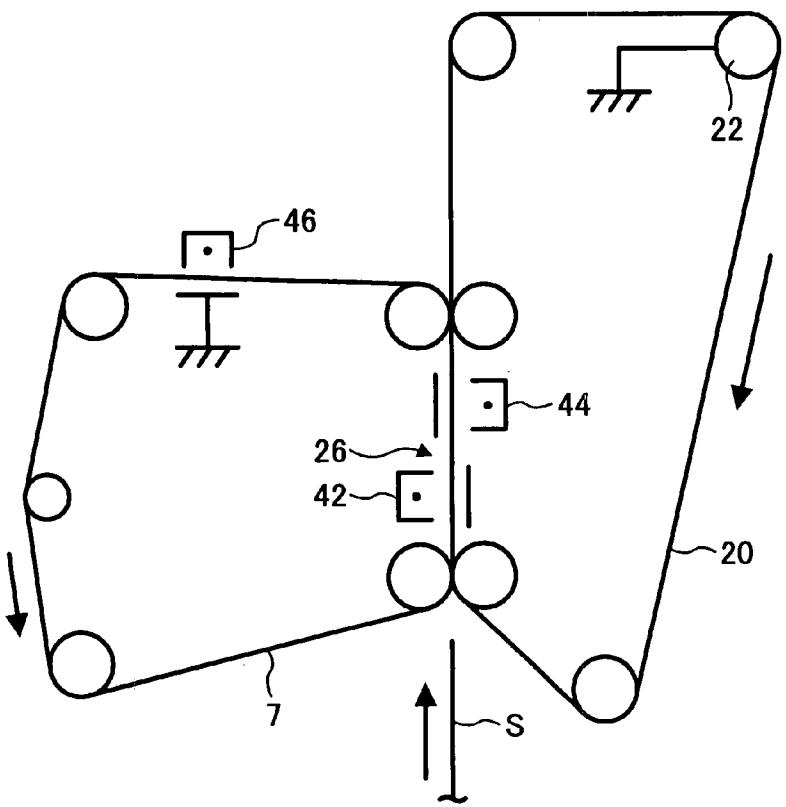

In the examples shown in FIGS. 27 and 28, the first and second image supports 7 and 20 are constituted by intermediate transfer members in the form of endless polyimide belts, the first transfer member comprising the first transfer charger 42 is disposed upstream along the contact region 26 of the image supports 7 and 20, the second transfer member comprising the second transfer charger 44 is disposed on the downstream side, and neither of these transfer chargers 42 and 44 comes into contact with the first and second image supports 7 and 20. Just as described above for FIG. 25, these transfer chargers 42 and 44 were used to transfer the second toner image formed on the first image support 7 to one side of the recording medium S, and to transfer the first toner image formed on the second image support 20 to the other side of the recording medium S.

Here, in the example shown in FIG. 27, static is removed from the first image support 7 by a static elimination means comprising a corona discharger 46, and static is removed from the second image support 20 by a static elimination means comprising the support roller 22. In the example shown in FIG. 28, static is removed from the first image support 7 by a static elimination means comprising a static eliminator brush 47, and static is removed from the second image support 20 by a static elimination means comprising a static eliminator blade 48. Such constitutions allow any remaining charges to be removed for ever transfer to the first and second image supports 7 and 20, allowing continuous images of good quality to be obtained.

Figure 29:
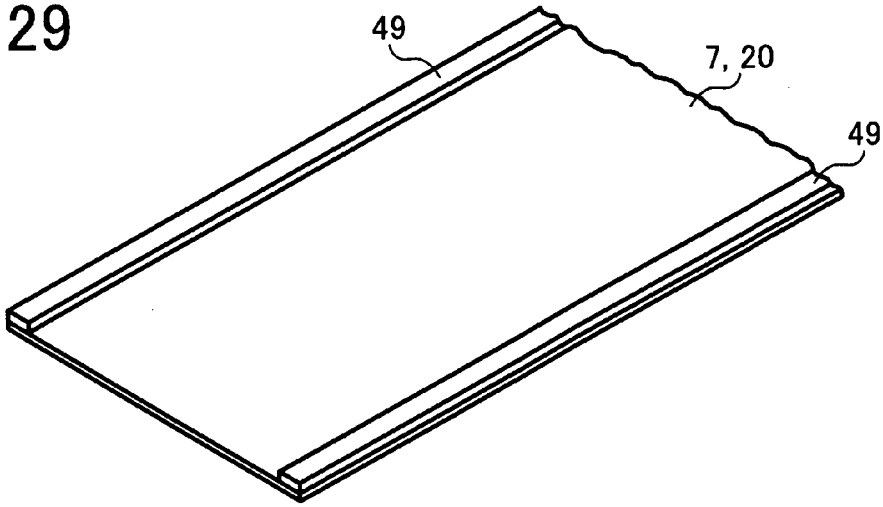
FIG. 29 is an oblique view of the back side of the first and second image supports, which consist of endless belts in this color printer, when these image supports have been laid out flat.
Figure 30:
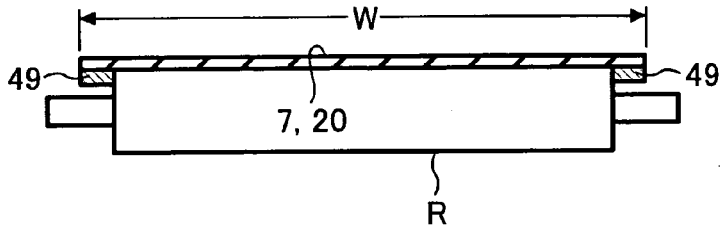
FIG. 30 is a partial cross section illustrating the relationship between these endless belts and the support rollers that support the belt.

In this embodiment, when the first and second image supports 7 and 20 comprise endless belts wound around a plurality of support rollers, if, as shown in FIG. 29, belt retainer ribs 49 that engage with the end faces of the support roller R shown in FIG. 30 are fixed to the back side of the endless belt at its ends in the width direction, then these ribs will prevent the endless belt from slipping in the axial direction during operation. It is preferable for these belt retainer ribs 49 to be made from a material having a volumetric resistivity and dielectric constant that are substantially equal to those of the first or second image support 7 or 20 comprising the endless belt. For instance, the first and second image supports 7 and 20 comprising endless belts, and the belt retainer ribs 49 fixed thereto can all be integrally molded from a polyimide. This allows the same amount of transfer current to flow to the belt retainer ribs 49 as to the first and second image supports 7 and 20, and allows toner images to be formed also on the surfaces of the image supports 7 and 20 corresponding to these ribs 49. In the example shown in FIG. 30, toner images can be formed over the entire width W of the first and second image supports 7 and 20 comprising endless belts, allowing these image supports to be utilized more effectively.

Figure 31:
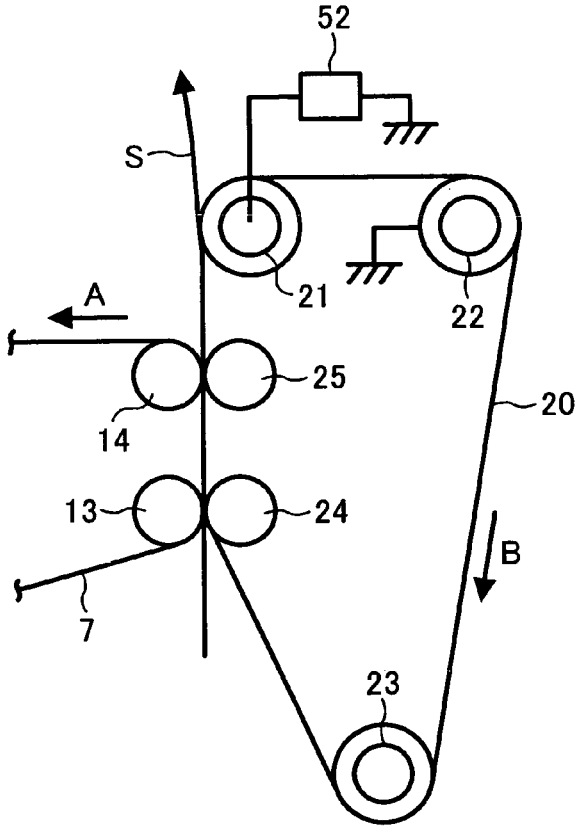
FIG. 31 is a diagram illustrating an example in which one support roller used for the second image support is constituted as an application member.

Referring to FIG. 31, a recording medium S, on both sides of which toner images have been transferred from the first and second image supports 7 and 20, is separated from the second image support 20 and conveyed to the fixing apparatus 30, but there may be cases in which the recording medium S does not separate from the second image support 20 due to the electrostatic force produced by the charge of the recording medium S and the residual charge of the second image support 20. In view of this, it is preferable if a voltage of the same polarity as that of the charge of the recording medium S is applied by a power supply 52 to the support roller 21, around which is wound the separation component where the recording medium S is separated from the second image support 20, so that the recording medium S is electrostatically repelled from the second image support 20, which efficiently separates the recording medium S from the second image support 20 and prevents the recording medium S from jamming.

Here, the support roller 22, which is further downstream in the movement direction of the second image support than the support roller 21, is grounded so that there will be no residual charge in the second image support 20. Thus, the support roller 22 in this example constitutes a grounding member that removes static from the second image support 20, but another grounding member may be provided instead.

As discussed above, in this embodiment the second image support comprises an endless belt wound around a plurality of support rollers, and a separation component is constituted by the portion of the second image support where the recording medium and the toner images transferred to the sides thereof separate from the second image support, in which case if the support roller around which this separation component is wound is constituted as an application member to which is applied voltage of the same polarity as the charge polarity of the recording medium, and if a grounding member for grounding the second image support is provided further downstream in the movement direction of the second image support than this application member, then it will be possible to prevent the recording medium from winding around the second image support can causing a jam.

The constitution discussed above can also be applied to the first image support 7. Specifically, if the first image support comprises an endless belt wound around a plurality of support rollers, and a separation component is constituted by the portion of the first image support where the recording medium S and the toner images transferred to the sides thereof separate from the first image support 7, then if the support roller around which this separation component is wound is constituted as an application member to which is applied voltage of the same polarity as the charge polarity of the recording medium S, and if a grounding member for grounding the first image support 7 is provided further downstream in the movement direction of the first image support 7 than this application member, then it will be possible to prevent the recording medium from winding around the first image support 7 can causing a jam.

If the diameter of the support roller constituting the application member in the various constitutions discussed above is set to 20 mm or less, and particularly 16 mm or less, then recording medium S can be separated even more stably from the second image support 20 or the first image support 7 as a result of separation due to curvature, and jamming of the recording medium can be prevented even more effectively.

With this embodiment, the problem whereby the toner image transferred to the transfer method by the action of the first transfer member is retransferred to the image support when a toner image is transferred to the recording medium by the action of the second transfer member can be effectively suppressed, which allows images of high quality to be formed on both sides of the recording medium.

Fifth Embodiment

A fifth embodiment will now be described in detail through reference to the drawings.

Figure 32:
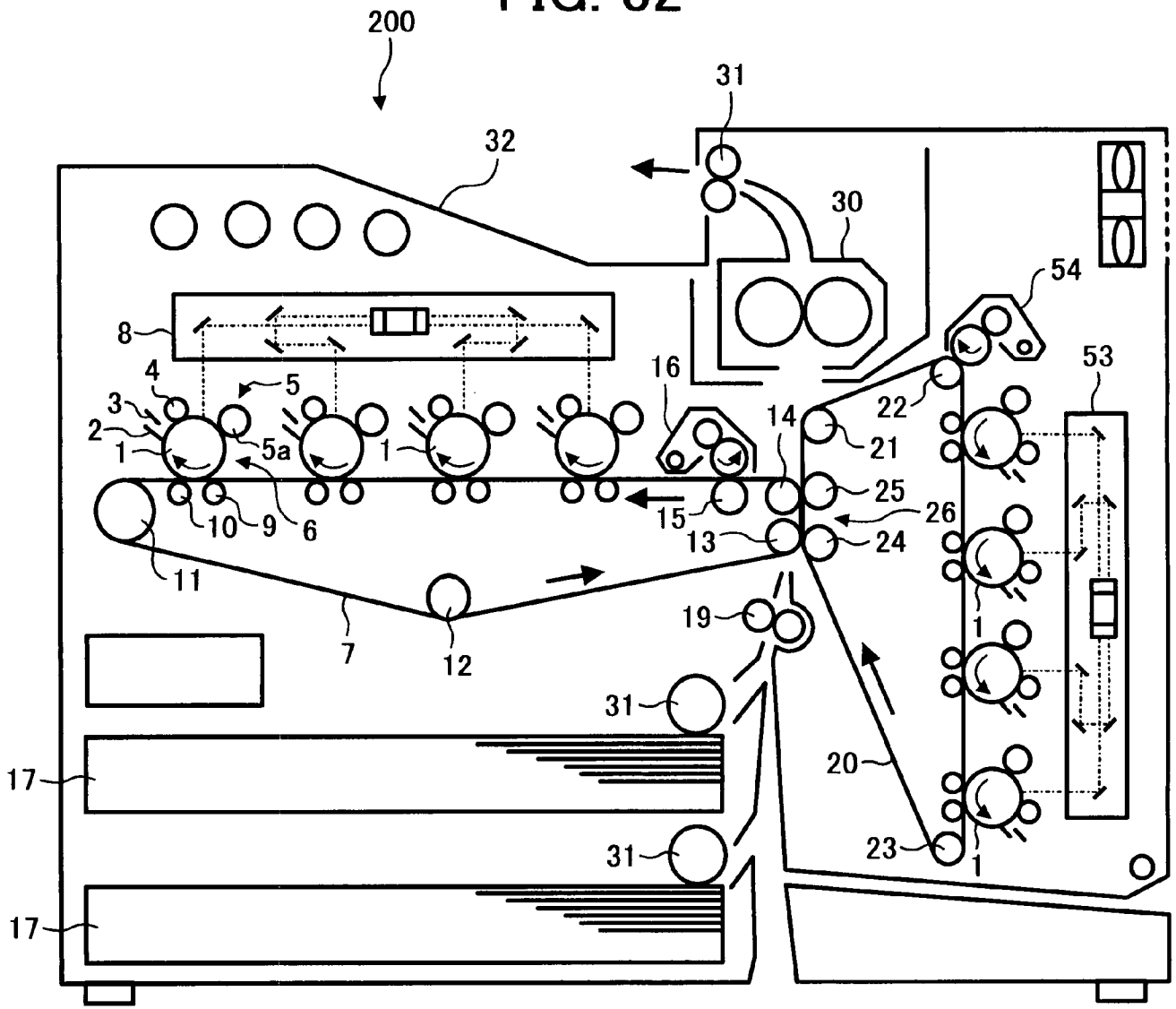
FIG. 32 is a cross section illustrating the simplified structure of the full-color printer pertaining to a fifth embodiment of the present invention.

As shown in FIG. 32, with the printer 200 in this embodiment, four imaging units 6 centered around photosensitive drums 1 are lined up along one side of the second intermediate transfer belt 20, and a second exposure apparatus 53 is provided adjacent to these four imaging units 6. These constitute a second imaging component, that is, there is a first imaging component along[10] the first intermediate transfer belt 7 and a second imaging component along[10] the second intermediate transfer belt 20. The paper feed cassettes 17 and the fixing apparatus 30 are common to both of these imaging components.

The constitution of the imaging units centered around the photosensitive drum 1 is the same for both the first and the second imaging components, and is the same as that of the imaging units shown in FIG. 3. The exposure apparatus 8 and 53 also have the same constitution. The first and second intermediate transfer belts 7 and 20 are the same as in the printer 100 in FIG. 2. A cleaning apparatus 54 provided to the second intermediate transfer belt 20 has the same constitution as the cleaning apparatus 16 provided to the first intermediate transfer belt 7. In this embodiment, the cleaning apparatus 54 can be left in contact with the second intermediate transfer belt 20 all the time, and there is no need for a mechanism for bringing the cleaning apparatus 54 into and out of contact with the belt.

When two-sided printing is performed with this printer 200, the image formed by the first imaging component is transferred from the first intermediate transfer belt 7 to one side of the paper, the image formed by the second imaging component is transferred from the second intermediate transfer belt 20 to the other side of the paper, the images on the paper are fixed by the fixing apparatus 30, and the paper is discharged into the discharge tray 32. The images formed on the photosensitive drum 1 by the imaging components are both positive images, are mirror images (negative images) on the intermediate transfer belts, and become positive images again when transferred to the paper. When the paper is stacked face-down in page order in the discharge tray 32, the image formed by the first imaging component is the front image, while the image formed by the second imaging component is the back image.[11]

When two-sided printing is performed with this printer, front and back images are formed by the first and second imaging components, respectively, and the images on both sides may be transferred directly to the paper, so the step of transferring the images from the first intermediate transfer belt 7 to the second intermediate transfer belt 20 can be omitted, which affords greater productivity in two-sided printing. Also, in the formation of color images in two-sided printing, the order in which the various color toners are applied can be the same on the front and back sides of the paper, and image quality can be improved by using the same coloring for the images on the front and back.

In the case of single-sided printing, when the paper is stacked face-down in page order in the discharge tray 32, an image is formed only by the first imaging component, this is transferred to one side of the paper, and the paper is discharged. In this case, the images formed on the photosensitive drums 1 of the first imaging component are positive images, are mirror images (negative images) on the first intermediate transfer belt 7, and become positive images again when transferred to the paper.

Meanwhile, when the paper is stacked face-up in page order in the discharge tray 32 during single-sided printing, an image is formed only by the second imaging component, this is transferred to one side of the paper, and the paper is discharged. In this case the image formation order is reversed (produced from the subsequent page). Also, the images formed on the photosensitive drums 1 of the second imaging component are positive images, are mirror images (negative images) on the second intermediate transfer belt 20, and become positive images again when transferred to the paper.

With the printer 200 in this embodiment, if the image transfer from the photosensitive drums 1 of the various imaging units to the first intermediate transfer belt 7 or the second intermediate transfer belt 20 is primary transfer, the image transfer from the first intermediate transfer belt 7 to the paper is secondary transfer, and the image transfer from the second intermediate transfer belt 20 to the paper is tertiary transfer, then all of the transfer means for the primary to tertiary transfer are transfer rollers (contact-type transfer means), and there is no discharge product as with a transfer charger, which is a non-contact type of transfer means. Nor is there any scattering of the toner supported on the intermediate transfer belts or of the toner transferred to the paper, which prevents fouling of the members and so forth. Furthermore, since there is no need for a mechanism for switching the polarity of the toner image, for example, the apparatus structure can be simpler and lower in cost. Also, since the transfer means are all disposed on the inside of the intermediate transfer members (within the transfer belt loops), there is no danger that the transfer means will be damaged in the event of a jam.

Again with this embodiment, the secondary transfer and tertiary transfer are not limited to attraction transfer, and it is possible to use repulsion transfer instead. Four modes of image transfer from the first and second image supports 7 and 20 to the sides of the paper in this printer 200 will now be described through reference to FIGS. 33A to 33D. In FIGS. 33A to 33D, the arrow a indicates secondary transfer, and the arrow b indicates tertiary transfer.

Figure 33B:
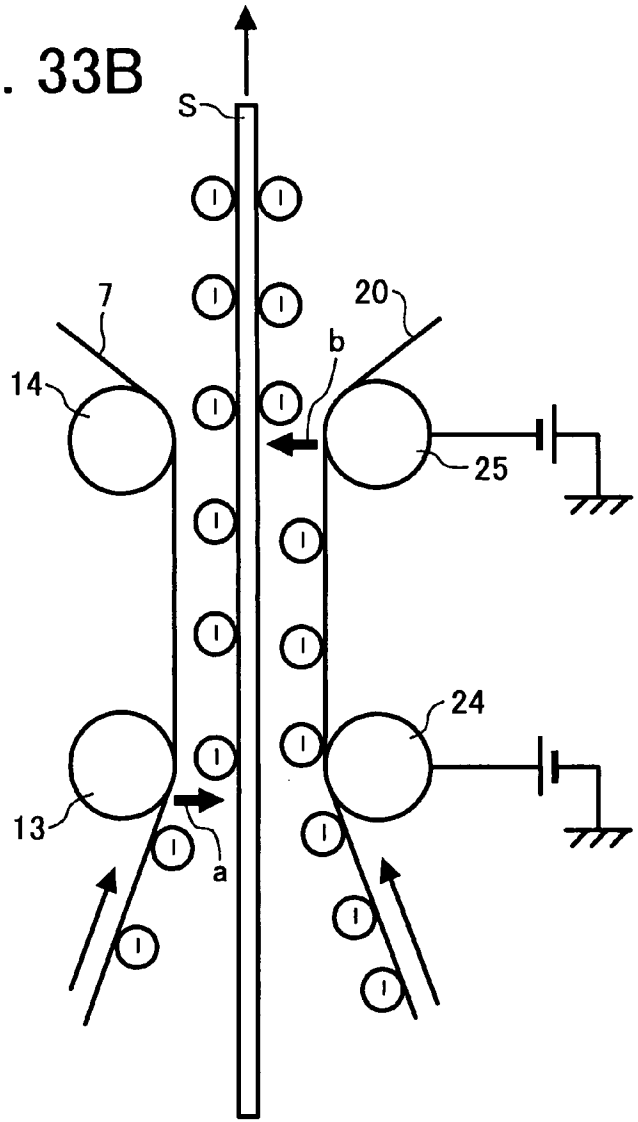
FIG. 33 consists of schematic diagrams illustrating four modes of image transfer from the first and second intermediate transfer belts onto each side of a sheet of paper in this color printer.
Figure 33A:
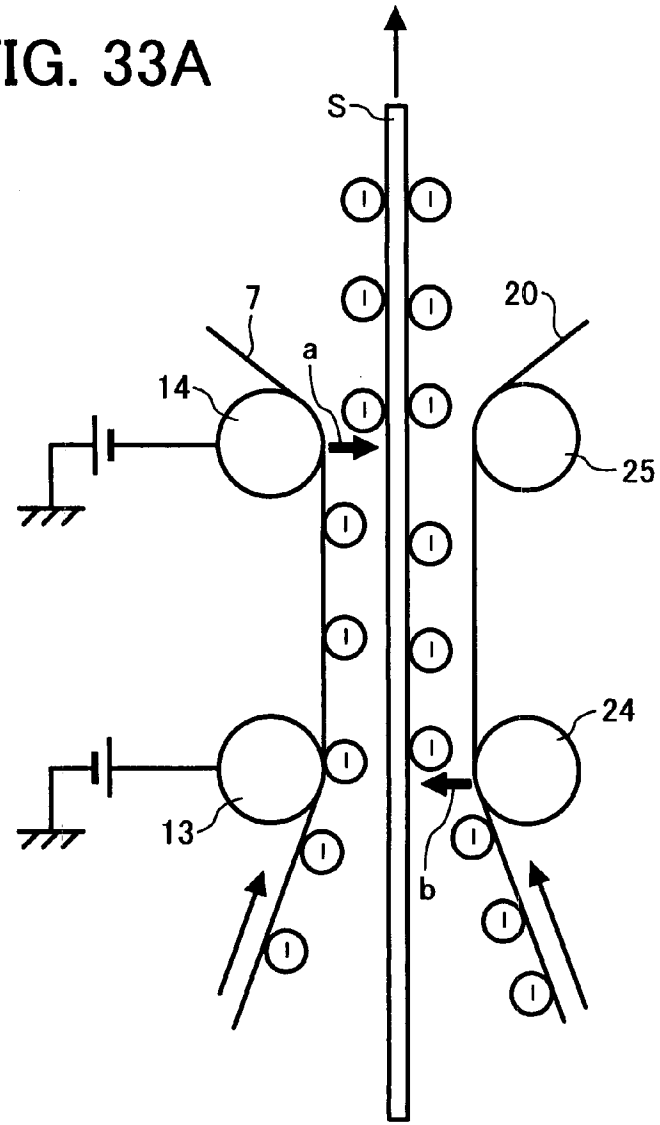

First, FIG. 33A is a structural example in which the secondary transfer means (transfer roller 14) and tertiary transfer means (transfer roller 13) are disposed within the first intermediate transfer belt 7. In this example, repulsion transfer is used for transfer from the first intermediate transfer belt 7 to the paper (arrow a), while attraction transfer is used for transfer from the second intermediate transfer belt 20 to the paper (arrow b).

FIG. 33B is a structural example in which the secondary transfer means (transfer roller 24) and tertiary transfer means (transfer roller 25) are disposed within the second intermediate transfer belt 20. In this example, attraction transfer is used for transfer from the first intermediate transfer belt 7 to the paper (arrow a), while repulsion transfer is used for transfer from the second intermediate transfer belt 20 to the paper (arrow b). With the constitution of FIG. 2, it is also possible to combine attraction transfer and repulsion transfer as in FIGS. 33A and 33B.

Figure 33D:
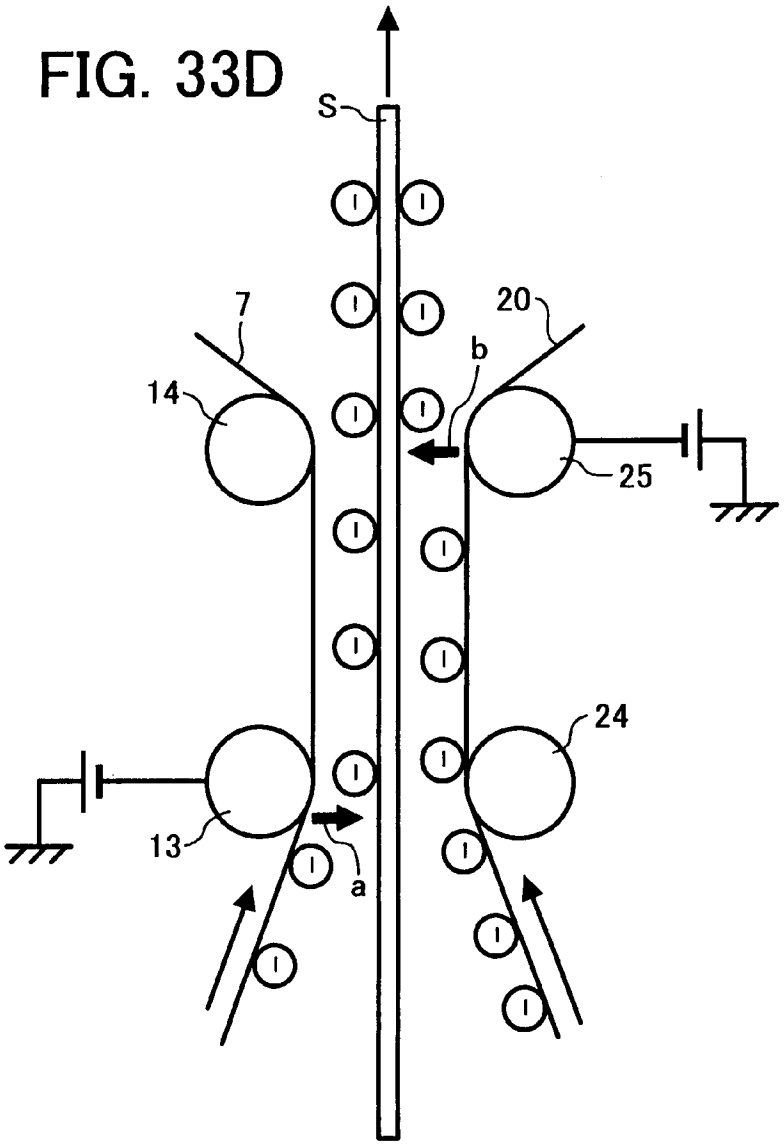
Figure 33C:
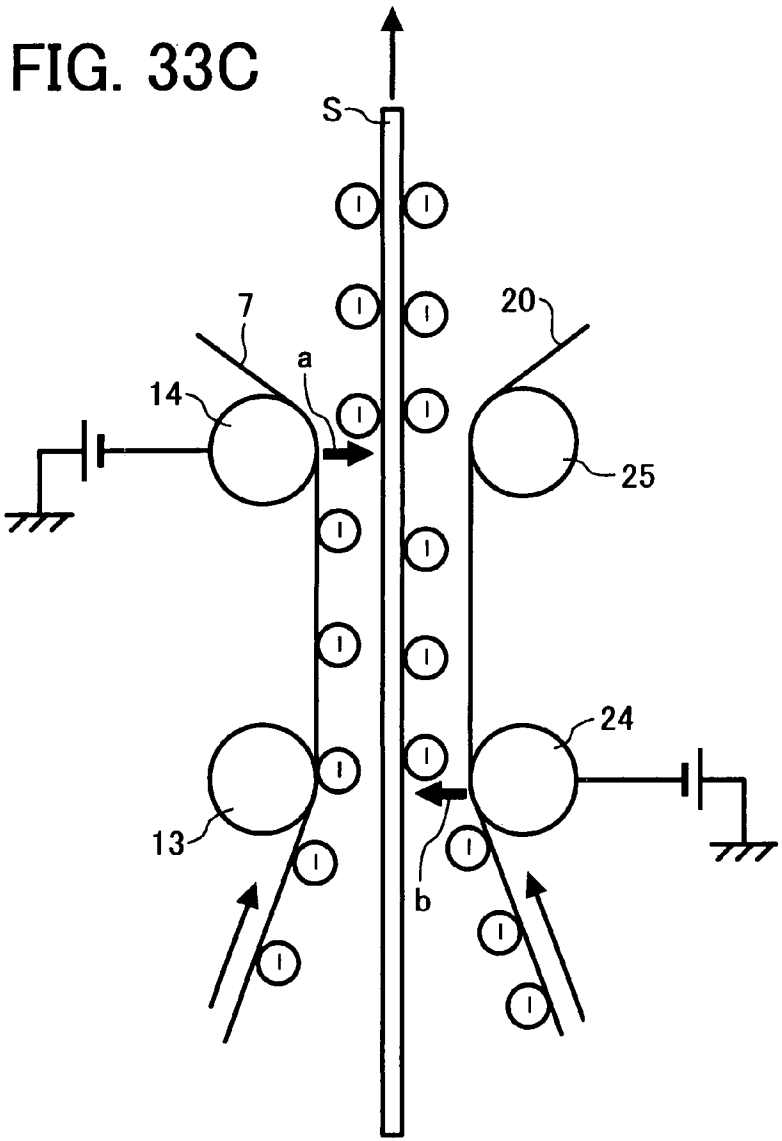

FIG. 33C is a structural example in which the secondary transfer means (transfer roller 14) is disposed within the first intermediate transfer belt 7, and the tertiary transfer means (transfer roller 24) is disposed within the second intermediate transfer belt 20. In this example, repulsion transfer is used both for transfer from the first intermediate transfer belt 7[12] to the paper (arrow a) and for transfer from the second intermediate transfer belt 20 to the paper (arrow b).

FIG. 33D is a structural example in which the secondary transfer means (transfer roller 13) is disposed within the first intermediate transfer belt 7, and the tertiary transfer means (transfer roller 25) is disposed within the second intermediate transfer belt 20. Again in this example, repulsion transfer is used both for transfer from the first intermediate transfer belt 7 to the paper (arrow a) and for transfer from the second intermediate transfer belt 20 to the paper (arrow b).

Although not depicted in the drawings, it is also possible in this embodiment for secondary transfer and tertiary transfer both to be attraction transfer.

In the apparatus constitution of FIG. 32, the rollers opposing the various transfer rollers are electroconductive rollers (electrode rollers), and are grounded so as to serve as ground rollers, which is the same as in the embodiments given above. The material and so forth of the transfer rollers and the opposing rollers thereof are also the same as in the embodiments given above. A charge of opposite polarity from that of the transfer bias of the transfer rollers across from the opposing rollers may be applied to these opposing rollers, which is also the same as in the embodiments given above. Furthermore, the power supply for applying a charge to the transfer rollers and their opposing rollers can be the same as that used in the embodiments given above.

In this embodiment, the secondary and tertiary transfer rollers are low resistance rollers of $10^9$ Ω·cm or less, and preferably $10^7$ Ω·cm or less.

Making the opposing rollers disposed across from the transfer rollers electroconductive rollers (electrode rollers) and grounding them affords a larger transfer electric field at the transfer rollers, and improves transfer efficiency. Each of the opposing rollers is a low resistance roller of $10^9$ Ω·cm or less, and preferably $10^7$ Ω·cm or less. This allows for effective grounding. Also, a charge of opposite polarity from that of the transfer bias may be applied to the opposing rollers. This increases the transfer electric field and improves transfer efficiency.

The power supply that applies a charge to the transfer rollers and opposing rollers may be designed so that a single power supply can apply charges of different polarity, and the use of a such a power supply allows for major reductions in how much space a plurality of power supplies take up and how much they cost, even when a charge with the opposite polarity from that of the transfer bias is applied to the opposing rollers.

In this embodiment, when the rollers 13, 14, 24, and 25 are used as transfer rollers, they have a structure in which an elastic layer is applied as a top layer over a core made of a metal or other suitable material, and this top layer has a thickness of 5 mm or less and a JIS-A hardness of 50 degrees or less. An elastomer of a resin or rubber whose resistance has been controlled with a carbon-metal oxide or the like is favorable as the material of the transfer roller top layer. Specific examples include a foamed EPDM rubber (sponge type), an acrylic resin elastomer, EPDM rubber, and urethane rubber. The hardness of the transfer rollers is lower than the hardness of the opposing rollers, and metal rollers, for example, can be used as the opposing rollers (when the rollers 13, 14, 24, and 25 are used as opposing rollers).

Thus setting the hardness of the transfer rollers to a JIS-A hardness of no more than 50 degrees, the thickness of the elastic layer to no more than 5 mm, and the hardness of the transfer rollers to be lower than the hardness of the opposing rollers (so that the transfer rollers are softer than the opposing rollers) results in a transfer region (transfer time) of suitable size (length), even when the intermediate transfer members are under tension, when the transfer rollers and opposing rollers are pressed together to sandwich the first intermediate transfer belt 7 and the second intermediate transfer belt 20, and this greatly increases the transfer efficiency. Furthermore, the roller shape including the intermediate transfer belts in the transfer region (transfer nip) becomes such that there is a depression in the transfer rollers (the transfer roller side is indented), a relative speed differential is produced between the transfer rollers and the intermediate transfer belts supporting the toner (because of their shape, the transfer rollers move faster), and this also improves transfer efficiency.

Furthermore, any two of the rollers 13, 14, 24, and 25 are used as transfer rollers in this embodiment, and the rollers across from these transfer rollers serve as opposing rollers. For example, as shown in FIG. 33A, when the rollers 13 and 14 are used as transfer rollers, the rollers 24 and 25 become opposing rollers. As shown in FIG. 33C, when the rollers 14 and 24 are used as transfer rollers, the rollers 25 and 13 become opposing rollers.

Also, as discussed above, setting the transfer roller hardness and manufacturing the rollers will be extremely easy if the material of the transfer roller top layer is an elastomer of a resin or rubber. Further, setting the resistance of the transfer rollers to a suitable value will be facilitated by adding an electron conductor such as a carbon-metal oxide to the above material and thereby controlling the resistance. This reduces the effect of environmental fluctuations such as temperature and humidity, and makes it possible to obtain stable transfer performance.

In this embodiment, the transfer rollers 13, 14, 24, and 25 serving as the secondary and tertiary transfer means are pressed from the transfer roller side toward the opposing roller side by a pressing means such as a spring (not shown). More specifically, a spring or the like can be used to press on the shaft or bearing of the transfer roller. Naturally, a structure may also be employed in which the shaft or bearing of the transfer roller is pressed on via some kind of pressing member.

Applying pressure from the transfer roller side in this manner allows the location (region) where the recording paper passes through the transfer nip to be set precisely by positioning the opposing rollers. Accordingly, variance in the transfer position can be minimized, which prevents dust and other such image defects during transfer. Furthermore, pressing on the shaft or bearing of the transfer roller also facilitates the setting of the roller shape (how much indentation there is during pressing against the opposing roller) of a low-hardness (soft) transfer roller.

It is preferable for the transfer rollers 13, 14, 24, and 25 serving as the secondary and tertiary transfer means to be larger in diameter than the opposing rollers. For instance, when the rollers 13 and 14 are used as transfer rollers as in FIG. 33A, the transfer rollers 13 and 14 are larger in diameter than the opposing rollers 24 and 25. Thus making the transfer rollers larger in diameter than the opposing rollers results in more deformation of the roller (and consequently more deformation of the intermediate transfer belt) on the transfer roller side, and transfer efficiency is improved by the relative speed differential produced between the transfer rollers and the intermediate transfer belt, which is a result of this shape. However, if the difference in roller diameters is too great, the above-mentioned relative speed differential will also be too great, and may result in image misalignment. This can also result in abnormality in how the roller is deformed, or in excessive deformation, so the ratio between the diameters of the transfer rollers and the opposing rollers is set at 2 or less.

With the constitution shown in FIG. 2, the back images in two-sided printing are transferred one more time than the front images, and pressure is applied between the rollers via the belts, so the toner is subjected to a high physical load during transfer. Therefore, the toner that is used is preferable a spherical toner that is less susceptible to the effects of this load, and a toner with an average sphericity of at least 0.95 is favorable. Also, a spherical toner is in point contain with the intermediate transfer belts (the belt surface is very smooth), and there are more contact points with the recording paper (the recording paper surface is bumpy), so transfer efficiency is also improved.

Also, with the constitution shown in FIG. 2, since the transfer of toner images from the first intermediate transfer belt 7 to the second intermediate transfer belt 20 is performed between belts that have smooth surfaces, there may be unevenness in the transfer pressure applied to the toner during transfer between the belts if the toner has a broad particle size distribution, and this can result in transfer unevenness. The effect of the particle size distribution becomes more pronounced as the toner particle size increases, but at a particle size of 4 to 9 μm, which is used for ordinary toners because of image quality considerations, transfer unevenness can substantially be ignored as long as the ratio of volume average diameter/number average diameter is from 1 to 1.5. This is a very effective way to deal with transfer unevenness during the transfer of images to recording paper.

It is also preferable for the toner to have low cohesion so that there will be little adhesion between the intermediate transfer belts, and a toner with a cohesion of 10% or less is preferred. This makes the toner less susceptible to the effects of physical load during transfer, and also improves transfer efficiency because adhesion to the belts is extremely low.

It is also preferable for the toner to contain a wax. With a toner that contains a wax, the wax in the toner migrates to the intermediate transfer belts 7 and 20 and reduces the coefficient of friction of the belt surface, which lowers the adhesive strength between the toner and the belts and improves transfer efficiency. Also, because the adhesive strength between the toner and the belts is lower, the toner is less susceptible to the effects of physical load during transfer. This is particularly favorable when a roller that is relatively soft, having a JIS-A hardness of 50 degrees or less, is used as the transfer roller, because the wax component in the toner will be moved to the belts by the transfer pressure when the opposing roller comes into contact with the transfer roller. Problems such as adhesion to the recording paper will be encountered if the wax content is too high, so the wax content in the binder resin of the toner is set at 20% or less.

Adhesion of toner to the belts can be further reduced, and transfer efficiency increased, by covering the toner surface with fine abrasive particles. Examples of abrasive particles that can be used include silica, alumina, and titanium. If the abrasive particles are added in an amount over 2 wt %, though, there may be side-effects such as filming of the photosensitive members or wear to the cleaning blade, so the added amount of abrasive particles is set at 2 wt % or less.

Specific examples and comparative examples in which the material of the transfer rollers, the type of toner, and so forth are varied in this embodiment will now be given. In these specific examples and comparative examples, any two of the rollers 13, 14, 24, and 25 are used as transfer rollers, and the rollers 13, 14, 24, and 25 across from these transfer rollers serve as opposing rollers.

SPECIFIC EXAMPLE 1

The transfer roller 24 was made of foamed EPDM rubber with a JIS-A hardness of 40 degrees, and transfer current with the opposite polarity from that of the toner was applied to this roller to transfer a color image from the first intermediate transfer belt 7 to the second intermediate transfer belt 20. After this, the color image supported on the first intermediate transfer belt 7 was transferred to the surface of the recording medium (transfer paper) that had been conveyed in, by applying transfer current with the opposite polarity from that of the toner to the transfer roller 24. Transfer current with the opposite polarity from that of the toner was then applied to the transfer roller 14, which had the same specifications as the transfer roller 24, to transfer the color image that had been transferred to the second intermediate transfer belt 20 onto the back of the recording medium. The opposing rollers 13 and 25 of the transfer rollers 14 and 24 were ground rollers here.

The roller diameter of the opposing rollers 13 and 25 was 12 mm, and the diameter of the transfer rollers 14 and 24 was 18 mm (opposing roller diameter<transfer roller diameter). The toner was an ordinary pulverized and graded type, with an average particle size of 10 μm. The recording medium was then conveyed to the fixing apparatus and fixed, and examined, which confirmed that good images had been transferred to both sides, even though the toner was a pulverized and graded type (naturally, the same results were obtained in single-sided printing as well).

SPECIFIC EXAMPLE 2

The transfer roller 24 was made of an acrylic resin elastomer with the JIS-A hardness adjusted to 45 degrees, and transfer current with the opposite polarity from that of the toner was applied to this roller to transfer a color image from the first intermediate transfer belt 7 to the second intermediate transfer belt 20. After this, the color image supported on the first intermediate transfer belt 7 was transferred to the surface of the recording medium that had been conveyed in, by applying transfer current with the opposite polarity from that of the toner to the transfer roller 24. Transfer current with the opposite polarity from that of the toner was then applied to the transfer roller 25, which had the same specifications as the transfer roller 24, to transfer the color image that had been transferred to the second intermediate transfer belt 20 onto the back of the recording medium. The opposing rollers 13 and 14 of the transfer rollers 24 and 25 were ground rollers here.

The roller diameter of the opposing rollers 13 and 14 was 15 mm, and the diameter of the transfer rollers 24 and 25 was 20 mm (opposing roller diameter<transfer roller diameter). The toner was an ordinary pulverized and graded type, with an average particle size of 8 μm. The recording medium was then conveyed to the fixing apparatus and fixed, and examined, which confirmed that good images had been transferred to both sides, even though the toner was a pulverized and graded type (naturally, the same results were obtained in single-sided printing as well).

COMPARATIVE EXAMPLE 1

The transfer roller 13 was made of EPDM rubber with a JIS-A hardness of 60 degrees, and transfer current with the same polarity as that of the toner was applied to this roller to transfer a color image from the first intermediate transfer belt 7 to the second intermediate transfer belt 20. After this, the color image supported on the first intermediate transfer belt 7 was transferred to the surface of the recording medium that had been conveyed in, by applying transfer current with the same polarity as that of the toner to the transfer roller 13. Transfer current with the same polarity as that of the toner was then applied to the transfer roller 25, which had the same specifications as the transfer roller 13, to transfer the color image that had been transferred to the second intermediate transfer belt 20 onto the back of the recording medium. The opposing rollers 14 and 24 of the transfer rollers 13 and 25 were ground rollers here.

The roller diameter of the opposing rollers 14 and 24 was 18 mm, the same as that of the transfer rollers 13 and 25 (opposing roller diameter=transfer roller diameter). The toner was an ordinary pulverized and graded type, with an average particle size of 10 μm. The recording medium was then conveyed to the fixing apparatus and fixed, and examined, which revealed that only uneven images had been obtained with the above-mentioned toner (the results were somewhat better in single-sided printing).

COMPARATIVE EXAMPLE 2

The transfer roller 24 was made of urethane rubber with a JIS-A hardness of 55 degrees, and transfer current with the opposite polarity from that of the toner was applied to this roller to transfer a color image from the first intermediate transfer belt 7 to the second intermediate transfer belt 20. After this, the color image supported on the first intermediate transfer belt 7 was transferred to the surface of the recording medium that had been conveyed in, by applying transfer current with the opposite polarity from that of the toner to the transfer roller 24. Transfer current with the opposite polarity from that of the toner was then applied to the transfer roller 14, which had the same specifications as the transfer roller 24, to transfer the color image that had been transferred to the second intermediate transfer belt 20 onto the back of the recording medium. The opposing rollers 13 and 25 of the transfer rollers 24 and 14 were ground rollers here.

The roller diameter of the opposing rollers 13 and 25 was 25 mm, and the diameter of the transfer rollers 24 and 14 was 20 mm (opposing roller diameter>transfer roller diameter). The toner was an ordinary pulverized and graded type, with an average particle size of 10 μm. The recording medium was then conveyed to the fixing apparatus and fixed, and examined, which revealed that only uneven images had been obtained with the above-mentioned toner (transfer was also unsatisfactory in single-sided printing).

SPECIFIC EXAMPLE 3

The transfer roller 13 was made of EPDM rubber with a JIS-A hardness of 60 degrees, and transfer current with the same polarity as that of the toner was applied to this roller to transfer a color image from the first intermediate transfer belt 7 to the second intermediate transfer belt 20. After this, the color image supported on the first intermediate transfer belt 7 was transferred to the surface of the recording medium that had been conveyed in, by applying transfer current with the same polarity as that of the toner to the transfer roller 13. Transfer current with the same polarity as that of the toner was then applied to the transfer roller 25, which had the same specifications as the transfer roller 13, to transfer the color image that had been transferred to the second intermediate transfer belt 20 onto the back of the recording medium. The opposing rollers 14 and 24 of the transfer rollers 25 and 13 were ground rollers here.

The roller diameter of the opposing rollers 14 and 24 was 18 mm, the same as that of the transfer rollers 25 and 13. The toner was a polymer type, with an average sphericity of 0.97, a volume average diameter of 6 μm, a ratio of volume average diameter/number average diameter of 1.4, and a cohesion of 9%. The recording medium was then conveyed to the fixing apparatus and fixed, and examined, which revealed that good images had been transferred to both sides (naturally, the same results were obtained in single-sided printing as well). In this example, the opposing roller diameter was equal to the transfer roller diameter, but toner characteristics were improved and good transfer images were obtained on both sides by using a polymer type of toner. Naturally, it should go without saying that good transfer images would be obtained on both sides if the opposing roller diameter were less than the transfer roller diameter.

SPECIFIC EXAMPLE 4

The transfer roller 24 was made of urethane rubber with a JIS-A hardness of 55 degrees, and transfer current with the opposite polarity from that of the toner was applied to this roller to transfer a color image from the first intermediate transfer belt 7 to the second intermediate transfer belt 20. After this, the color image supported on the first intermediate transfer belt 7 was transferred to the surface of the recording medium that had been conveyed in, by applying transfer current with the opposite polarity from that of the toner to the transfer roller 24. Transfer current with the opposite polarity from that of the toner was then applied to the transfer roller 14, which had the same specifications as the transfer roller 24, to transfer the color image that had been transferred to the second intermediate transfer belt 20 onto the back of the recording medium. The opposing rollers 13 and 25 of the transfer rollers 24 and 14 were ground rollers here.

The roller diameter of the opposing rollers 13 and 25 was 25 mm, and the diameter of the transfer rollers 24 and 14 was 20 mm. The toner was The toner was a polymer type, with an average sphericity of 0.97, a volume average diameter of 6 μm, a ratio of volume average diameter/number average diameter of 1.4, and a cohesion of 9%, and the binder contained 18 wt % wax. Furthermore, a silica micropowder was added to the top layer. The recording medium was then conveyed to the fixing apparatus and fixed, and examined, which confirmed that good images had been transferred to both sides (naturally, the same results were obtained in single-sided printing as well). In this specific example, the opposing roller diameter was greater than the transfer roller diameter, but the use of a polymer-type toner improved the toner characteristics and allowed good image transfer to both sides. Naturally, it should go without saying that good transfer images would be obtained on both sides if the opposing roller diameter were less than the transfer roller diameter.

SPECIFIC EXAMPLE 5

The wax content in the resin composition of the toner was 15%, and fine silica particles were added in a weight ratio of 1.5 wt % to the surface of the toner particles, but the other toner conditions and the apparatus conditions were the same as in Specific Example 4. The recording medium was then conveyed to the fixing apparatus and fixed, and examined, which confirmed that even sharper images had been obtained on both sides (naturally, the same results were obtained in single-sided printing as well). Again in this specific example, it should go without saying that good transfer images would be obtained on both sides if the opposing roller diameter were less than the transfer roller diameter.

SPECIFIC EXAMPLE 6

The transfer roller 24 was made of an acrylic resin elastomer with the JIS-A hardness adjusted to 45 degrees, and transfer current with the opposite polarity from that of the toner was applied to this roller to transfer a color image from the first intermediate transfer belt 7 to the second intermediate transfer belt 20. After this, the color image supported on the first intermediate transfer belt 7 was transferred to the surface of the recording medium that had been conveyed in, by applying transfer current with the opposite polarity from that of the toner to the transfer roller 24. Transfer current with the same polarity as that of the toner was then applied to the transfer roller 25, which had the same specifications as the transfer roller 24, to transfer the color image that had been transferred to the second intermediate transfer belt 20 onto the back of the recording medium.

In this case, the opposing rollers 13 and 14 of the transfer rollers 24 and 25 were ground rollers here. The roller diameter of the opposing rollers 13 and 14 was 15 mm, and the diameter of the transfer rollers 24 and 25 was 20 mm (opposing roller, diameter<transfer roller diameter). The toner was the same as that used in Specific Example 5. The recording medium was then conveyed to the fixing apparatus and fixed, and examined, which confirmed that sharpest images of all the above specific examples had been transferred to both sides (naturally, the same results were obtained in single-sided printing as well).

With the constitutions described above, in which two intermediate transfer belts were sandwiched between rollers (transfer rollers and opposing rollers) disposed facing and in contact with each other, the effect of transfer pressure is greater than in ordinary image transfer with intermediate transfer belts. However, as described above, by specifying the constitutions of the transfer rollers and opposing rollers according to this embodiment, there is a marked improvement in transfer performance in contact transfer between belts (transfer between the belts themselves and single- or two-sided transfer between a belt and paper), even when a conventional pulverized and graded type of toner is used.

Furthermore, toner adhesion is reduced and toner migration improved by using a polymer type of spherical toner, and this results in improved transfer performance in the constitutions given above. The transfer performance can be improved even more by reducing the particle size ratio (volume average diameter/number average diameter) and cohesion of the toner (adhesion between toner particles), lowering the coefficient of friction with the belts by admixing a wax, and improving adhesion and migration by adding fine particles (abrasive component).

As described above, this fifth embodiment has the following effects.

(1) A first transfer roller and a second transfer roller are disposed on the inside of first and second transfer members, respectively, first and second opposing rollers are provided in pressure contact therewith, an elastic layer with a thickness of 5 mm or less is provided to the top layer of each transfer roller, the JIS-A hardness of the transfer rollers is adjusted to 50 degrees or less, and the hardness of the transfer rollers is made lower than the hardness of the opposing rollers, the result of which is that when the transfer rollers and opposing rollers are brought into pressure contact with the first and second intermediate transfer belts sandwiched therebetween, a transfer region (transfer time) of sufficient size (length) can be obtained, even when the intermediate transfer belts are under tension, and transfer efficiency is greatly enhanced. Furthermore, the roller shape including the intermediate transfer belts in the transfer region (transfer nip) becomes such that there is a depression in the transfer rollers (the transfer roller side is indented), a relative speed differential is produced between the transfer rollers and the intermediate transfer belts supporting the toner (because of their shape, the transfer rollers move faster), and this also improves transfer efficiency.

(2) Since the transfer roller elastic layer is made of an elastomer of a resin or rubber whose resistance has been controlled with an electron conductor, setting the transfer roller hardness and manufacturing the rollers can be accomplished with the greatest of ease.

(3) Since the transfer rollers and their opposing rollers are pressed together by pressure from the transfer roller side, location (region) where the recording paper passes through the transfer nip to be set precisely by positioning the opposing rollers. Accordingly, variance in the transfer position can be minimized, which prevents dust and other such image defects during transfer.

(4) Since a pressing force is applied to the shaft or bearing of each transfer roller, it is easy to set the roller shape (how much indentation there is during pressing against the opposing roller) of a low-hardness (soft) transfer roller.

(5) Since each transfer roller and its opposing roller are sized such that the transfer roller diameter is greater than the opposing roller diameter, and the ratio between these roller diameters is 2 or less, roller deformation is greater on the transfer roller side, and transfer efficiency is increased by a relative speed differential produced between the transfer rollers and the intermediate transfer belts by this shape. If the diameter ratio is 2 or less, there is no abnormality in how the roller is deformed, or excessive deformation.

(6) Since the charge applied to the first transfer roller and the charge applied to the second transfer roller have the same polarity, and have the opposite polarity from that of the toner, the apparatus structure can be made simpler.

(7) Since the charge applied to the first transfer roller and the charge applied to the second transfer roller have the same polarity, and have the same polarity as that of the toner, the apparatus structure can be made simpler. Also, transfer can be performed more efficiently by utilizing repulsion. Furthermore, since electrostatic repulsion acts on the belts carrying the transferred toner, there is less disturbance of the toner on the opposite belt or on the opposite side of the paper.

(8) Since each opposing roller is an electroconductive roller, and either this electroconductive roller is grounded or a charge is applied with the opposite polarity from that of the charge applied to the mated transfer roller, there is a larger transfer electric field and transfer efficiency is higher.

(9) Since the transfer rollers are low-resistance rollers with a resistance of $10^9$ Ω·cm or less, the transfer current can be applied very effectively.

(10) Since the opposing rollers are low-resistance rollers with a resistance of $10^9$ Ω·cm or less, the rollers can be grounded very effectively.

(11) Since a spherical toner with an average sphericity of at least 0.95 is used, the toner is less susceptible to the effects of physical load during transfer. Also, transfer efficiency is higher because there are more contact points with respect to the recording paper.

(12) Since the volume average diameter is 4 to 9 μm, and the ratio of volume average diameter/number average diameter is from 1 to 1.5, there is no unevenness in transfer pressure, and transfer unevenness can be substantially eliminated. This is a very effective way to deal with transfer unevenness during the transfer of images to recording paper.

(13) Since a toner with a cohesion of 10% or less is used, the toner is less susceptible to the effects of physical load during transfer. Also, transfer efficiency is higher because adhesion to the belts is extremely low.

(14) Since a toner in which the binder resin contains a wax component in an amount of 20% or less is used, adhesion between the toner and the belts is lowered and transfer efficiency is increased. Also, the low adhesion between the toner and the belts makes the toner less susceptible to the effects of physical load during transfer. This is particularly favorable when a roller that is relatively soft, having a JIS-A hardness of 50 degrees or less, is used as the transfer roller, because the wax component in the toner will be moved to the belts by the transfer pressure when the opposing roller comes into contact with the transfer roller. Problems such as adhesion to the recording paper will be encountered if the wax content is too high, so the wax content in the binder resin of the toner is set at 20% or less.

(15) Since a toner containing fine abrasive particles in an amount of 2 wt % or less on the toner particle surface is used, the toner surface is covered by these fine abrasive particles, which reduces the adhesion of the toner to the belts and increases transfer efficiency. If the abrasive particles are added in an amount over 2 wt %, though, there may be side-effects such as filming of the photosensitive members or wear to the cleaning blade, so the added amount of abrasive particles is set at 2 wt % or less.

Various modifications will become possible for those skilled in the art after receiving the teachings of the present disclosure without departing from the scope thereof.

What is claimed is:

1. A transfer method, comprising:

displacing at least one of a first image support for supporting a first toner image and a second image support for supporting a second toner image towards the other of the first and second image supports to establish a contact region;

moving in the same direction and at the same speed the first and second image supports within the contact region in which image support sides of the first and second image supports come into contact;

conveying a recording medium sandwiched between the first and second image supports within the contact region;

using a first transfer member disposed upstream in the movement direction of the first and second image supports within the contact region to transfer one of the first and second toner images supported on one of the first and second image supports to one side of the recording medium conveyed within the contact region; and using a second transfer member disposed downstream in the movement direction of the first and second image supports within the contact region to transfer the other toner image of the first and second toner images supported on the other image support to the other side of the recording medium conveyed within the contact region.

2. The transfer method according to claim 1, wherein the two image supports are photosensitive members or intermediate transfer members.

3. The transfer method according to claim 1, wherein the transfer method employed by the transfer members is electrostatic transfer or thermal transfer.

4. A transfer apparatus, comprising:

a first image support that moves while supporting a first toner image on an image support side;

a second image support that moves while supporting a second toner image on an image support side;

a contact region established by displacing at least one of the first and second image supports towards the other of the first and second image supports, wherein the image support sides of the first and second image supports come into contact and a recording medium is conveyed in between the image support sides;

a first transfer member that is disposed upstream in the movement direction of the first and second image supports within the contact region, and that transfers at least one of the first and second toner images supported on one of the first and second image supports to one side of the recording medium conveyed within the contact region; and a second transfer member that is disposed downstream in the movement direction of the first and second image supports within the contact region, and that transfers the other of the first and second toner images supported on the other of the first and second image supports to the other side of the recording medium conveyed within the contact region, wherein at least one of the two image supports is a belt image support, and the transfer member is disposed within a belt loop of the belt image support.

5. The transfer apparatus according to claim 4, wherein the transfer members perform electrostatic transfer, and apply a charge to the image supports while in contact with the inner side of the belt loop of the image supports.

6. The transfer apparatus according to claim 5, wherein the transfer members are in the form of a roller.

7. The transfer apparatus according to claim 5, wherein at least one of the transfer members comprises a brush member.

8. The transfer apparatus according to claim 5, wherein the transfer members are in the form of a blade.

9. The transfer apparatus according to claim 4, wherein the transfer members perform electrostatic transfer, and apply a charge to the image supports in a state of non-contact with the inner side of the belt loop of the image supports.

10. The transfer apparatus according to claim 4, wherein the image supports are intermediate transfer belts, having a base of rubber or a resin film with a thickness of 50 to 1000 μm, and having a resistance of $10^6$ to $10^{11}$ Ω·cm.

11. The transfer apparatus according to claim 4, wherein at least one of the first image support and the second image support is provided so as to be movable to a position where the contact region releases contact.

12. An image forming apparatus, comprising:

an imaging component configured to produce a toner image;

a transfer apparatus configured to transfer toner images produced by the imaging component to both sides of a recording medium; and a fixing apparatus configured to fix the toner images transferred to the recording medium, said transfer apparatus comprising:

a first image support that moves while supporting a first toner image on an image support side;

a second image support that moves while supporting a second toner image on an image support side;

a contact region established by displacing at least one of the first and second image supports towards the other of the first and second image supports, wherein the image support sides of the first and second image supports come into contact and a recording medium is conveyed in between the image support sides;

a first transfer member that is disposed upstream in the movement direction of the first and second image supports within the contact region, and that transfers the first toner image supported on one of the first and second image supports to one side of the recording medium conveyed within the contact region; and a second transfer member that is disposed downstream in the movement direction of the first and second image supports within the contact region, and that transfers the second toner image supported on the other of the first and second image supports to the other side of the recording medium conveyed within the contact region, wherein at least one of the first and second image supports is a belt image support, and the transfer member is disposed within a belt loop of the belt image support.

13. An image forming apparatus, comprising:

a first image support that moves while supporting a first toner image on an image support side;

a second image support that moves while supporting a second toner image on an image support side;

a contact region established by displacing at least one of the first and second image supports towards the other of the first and second image supports, wherein the image support side of the first image support and the image support side of the second image support come into contact and a recording medium having toner images transferred onto both sides thereof is conveyed in between the image support sides;

two electroconductive rollers disposed upstream and downstream in the movement direction of the first image support and in contact with the side of the first image support opposite the image support side within the contact region; and two electroconductive rollers disposed upstream and downstream in the movement direction of the second image support and in contact with the side of the second image support opposite the image support side within the contact region, the two electroconductive rollers on the first image support side and the two electroconductive rollers on the second image support side sandwiching the first image support and the second image support and thereby forming an upstream nip and a downstream nip, in the pair of electroconductive rollers forming the upstream nip and the pair of electroconductive rollers forming the downstream nip, one electroconductive roller in each pair serving as an application roller to which a transfer current is applied, and the other electroconductive roller serving as a ground roller, and the absolute value of the transfer current applied to the application roller located in the upstream nip being set to be equal to or greater than the absolute value of the transfer current applied to the application roller located in the downstream nip.

14. The image forming apparatus according to claim 13, wherein the transfer current applied to the application roller located in the upstream nip and to the application roller located in the downstream nip can be varied according to the thickness of the recording medium.

15. The image forming apparatus according to claim 13, further comprising a paper thickness detector disposed along the conveyance path of the recording medium, as a member for detecting the thickness of the recording medium.

16. An image forming apparatus, comprising:

a first image support that moves while supporting a first toner image on an image support side;

a second image support that moves while supporting a second toner image on an image support side;

a contact region established by displacing at least one of the first and second image supports towards the other of the first and second image supports, wherein the image support side of the first image support and the image support side of the second image support come into contact and a recording medium having toner images transferred onto both sides thereof is conveyed in between the image support sides;

two electroconductive rollers disposed upstream and downstream in the movement direction of the first image support and in contact with the side of the first image support opposite the image support side within the contact region; and two electroconductive rollers disposed upstream and downstream in the movement direction of the second image support and in contact with the side of the second image support opposite the image support side within the contact region, the two electroconductive rollers on the first image support side and the two electroconductive rollers on the second image support side sandwiching the first image support and the second image support and thereby forming an upstream nip and a downstream nip, in the pair of electroconductive rollers forming the upstream nip and the pair of electroconductive rollers forming the downstream nip, one electroconductive roller in each pair serving as an application roller to which transfer current is applied, and the other electroconductive roller serving as a ground roller, and the nip width of the upstream nip being set to be equal to or greater than the nip width of the downstream nip.

17. An image forming apparatus, comprising:

a first image support that moves while supporting a first toner image on an image support side;

a second image support that moves while supporting a second toner image on an image support side;

a contact region established by displacing at least one of the first and second image supports towards the other of the first and second image supports, wherein the image support side of the first image support and the image support side of the second image support come into contact and a recording medium having toner images transferred onto both sides thereof is conveyed in between the image support sides;

two electroconductive rollers disposed upstream and downstream in the movement direction of the first image support and in contact with the side of the first image support opposite the image support side within the contact region; and two electroconductive rollers disposed upstream and downstream in the movement direction of the second image support and in contact with the side of the second image support opposite the image support side within the contact region, the two electroconductive rollers on the first image support side and the two electroconductive rollers on the second image support side sandwiching the first image support and the second image support and thereby forming an upstream nip and a downstream nip, in the pair of electroconductive rollers forming the upstream nip and the pair of electroconductive rollers forming the downstream nip, one electroconductive roller in each pair serving as an application roller to which a transfer current is applied, and the other electroconductive roller serving as a ground roller, and the transfer pressure of the upstream nip being set to be equal to or greater than the transfer pressure of the downstream nip.

18. An image forming apparatus, comprising:

a first image support that moves while supporting a first toner image on an image support side;

a second image support that moves while supporting a second toner image on an image support side;

a contact region established by displacing at least one of the first and second image supports towards the other of the first and second image supports, wherein the image support side of the first image support and the image support side of the second image support come into contact and a recording medium having toner images transferred onto both sides thereof is conveyed in between the image support sides;

two electroconductive rollers disposed upstream and downstream in the movement direction of the first image support and in contact with the side of the first image support opposite the image support side within the contact region; and two electroconductive rollers disposed upstream and downstream in the movement direction of the second image support and in contact with the side of the second image support opposite the image support side within the contact region, the two electroconductive rollers on the first image support side and the two electroconductive rollers on the second image support side sandwiching the first image support and the second image support and thereby forming an upstream nip and a downstream nip, in the pair of electroconductive rollers forming the upstream nip and the pair of electroconductive rollers forming the downstream nip, one electroconductive roller in each pair serving as an application roller to which a transfer current is applied, and the other electroconductive roller serving as a ground roller, and the hardness of the pair of electroconductive rollers that form the upstream nip being set to be equal to or greater than the hardness of the pair of electroconductive rollers that form the downstream nip.

19. The image forming apparatus according to claim 18, wherein the hardness of the pair of electroconductive rollers that form the downstream nip is set such that the hardness of the electroconductive roller located on the first or second image support side that is closer to the fixing apparatus is equal to or greater than the hardness of the other electroconductive roller.

20. An image forming apparatus, comprising:

a first image support that moves while supporting a first toner image on an image support side;

a second image support that moves while supporting a second toner image on an image support side;

a contact region established by displacing at least one of the first and second image supports towards the other of the first and second image supports, wherein the image support side of the first image support and the image support side of the second image support come into contact and a recording medium having toner images transferred onto both sides thereof is conveyed in between the image support sides;

two electroconductive rollers disposed upstream and downstream in the movement direction of the first image support and in contact with the side of the first image support opposite the image support side within the contact region; and two electroconductive rollers disposed upstream and downstream in the movement direction of the second image support and in contact with the side of the second image support opposite the image support side within the contact region, the two electroconductive rollers on the first image support side and the two electroconductive rollers on the second image support side sandwiching the first image support and the second image support and thereby forming an upstream nip and a downstream nip, in the pair of electroconductive rollers forming the upstream nip and the pair of electroconductive rollers forming the downstream nip, one electroconductive roller in each pair serving as an application roller to which a transfer current is applied, and the other electroconductive roller serving as a ground roller, and the timing at which the transfer current is applied to the two upstream and downstream application rollers is either when or before a front end of the recording medium reaches the upstream nip.

21. The image forming apparatus according to claim 20, wherein the timing at which the transfer current is applied to the two upstream and downstream application rollers is simultaneous.

22. The image forming apparatus according to claim 20, wherein one power supply is provided for applying the transfer current to the two upstream and downstream application rollers.

23. An image forming apparatus, comprising:

a first image support that moves while supporting a toner image on an image support side;

a second image support that moves while supporting a toner image on an image support side;

a contact region in which the image support side of the first image support and the image support side of the second image support come into contact and a recording medium having toner images transferred onto both sides thereof is conveyed in between these image support sides;

two electroconductive rollers disposed upstream and downstream in the movement direction of the first image support and in contact with the side of the first image support opposite the image support side within the contact region; and two electroconductive rollers disposed upstream and downstream in the movement direction of the second image support and in contact with the side of the second image support opposite the image support side within the contact region, the two electroconductive rollers on the first image support side and the two electroconductive rollers on the second image support side sandwiching the first image support and the second image support and thereby forming an upstream nip and a downstream nip, in the pair of electroconductive rollers forming the upstream nip and the pair of electroconductive rollers forming the downstream nip, one electroconductive roller in each pair serving as an application roller to which transfer current is applied, and the other electroconductive roller serving as a ground roller, and the timing at which application of the transfer current to the two upstream and downstream application rollers is stopped is after the rear end of the recording medium has passed through the downstream nip.

24. The image forming apparatus according to claim 23, wherein the timing at which application of the transfer current to the two upstream and downstream application rollers is stopped is simultaneous.

25. The image forming apparatus according to claim 23, wherein one power supply is provided for applying the transfer current to the two upstream and downstream application rollers.

26. An image forming apparatus, comprising:

a first image support that moves while supporting a toner image on an image support side;

a second image support that moves while supporting a toner image on an image support side;

a contact region in which the image support side of the first image support and the image support side of the second image support come into contact and a recording medium having toner images transferred onto both sides thereof is conveyed in between these image support sides;

two electroconductive rollers disposed upstream and downstream in the movement direction of the first image support and in contact with the side of the first image support opposite the image support side within the contact region; and two electroconductive rollers disposed upstream and downstream in the movement direction of the second image support and in contact with the side of the second image support opposite the image support side within the contact region, the two electroconductive rollers on the first image support side and the two electroconductive rollers on the second image support side sandwiching the first image support and the second image support and thereby forming an upstream nip and a downstream nip, in the pair of electroconductive rollers forming the upstream nip and the pair of electroconductive rollers forming the downstream nip, one electroconductive roller in each pair serving as an application roller to which transfer current is applied, and the other electroconductive roller serving as a ground roller, and at least one of the application rollers is left on after the rear end of the recording medium has passed through the downstream nip and until the front end of the recording medium reaches the nip on the fixing apparatus side.

27. An image forming apparatus for recording images on both sides of a recording medium, comprising:

first and second image supports on the surfaces of which are formed toner images, the toner image formed on each of said first and second image supports being transferred to one side or the other of a recording medium; and first and second transfer members disposed along a contact component in contact with the first and second image supports, said first transfer member being located further upstream in the movement direction of the first and second image supports than the second transfer member, the toner image formed on the surface of the first image support being transferred by the action of one of the first and second transfer members onto one side of a recording medium fed in between the first and second image supports in contact with each other, and the toner image formed on the surface of the second image support being transferred by the action of the other of the first and second transfer members onto the other side of the recording medium fed in between the first and second image supports in contact with each other, and the toner image transfer conditions being set such that if we let E(U) be the transfer electric field formed by the first transfer member, q1 be the amount of toner charge per unit of volume of the toner image transferred by the action of the first transfer member, E(D) be the transfer electric field formed by the second transfer member, and q2 be the amount of toner charge per unit of volume of the toner image transferred by the action of the second transfer member, the absolute values of the forces at which the toner images are transferred onto the recording medium, which are expressed by $F(U)=q1\times E(U)$ and $F(D)=q2\times E(D)$, are such that $F(U)\geqq F(D)$.

28. The image forming apparatus according to claim 27, further comprising a non-contact type of transfer member that does not come into contact with the first and second image supports as the first and second transfer members, and static elimination means for eliminating any residual charge from the first and second image supports after toner image transfer.

29. The image forming apparatus according to claim 27, wherein the first and second image supports consist of endless belts wound around a plurality of support rollers, belt anti-shift ribs that engage with the respective end faces of the support rollers are fixed to the back side of each endless belt at the ends in the width direction, and said belt anti-shift ribs are made of a material having a volumetric resistivity and dielectric constant substantially the same as those of the endless belts.

30. The image forming apparatus according to claim 27, wherein the second image support consists of an endless belt wound around a plurality of support rollers, if the second image support portion where a recording medium having toner images transferred onto both sides thereof is separated from the second image support is termed as the separation component, the support roller around which said separation component is wound is constituted as an application member to which is applied voltage of the same polarity as the charge polarity of the recording medium, and a ground member for grounding the second image support is provided further downstream in the movement direction of the second image support than said application member.

31. The image forming apparatus according to claim 30, wherein the diameter of the support roller constituting the application member is set to 20 mm or less.

32. The image forming apparatus according to claim 27, wherein the first image support consists of an endless belt wound around a plurality of support rollers, if the first image support portion where a recording medium having toner images transferred onto both sides thereof is separated from the first image support is termed as the separation component, the support roller around which said separation component is wound is constituted as an application member to which is applied voltage of the same polarity as the charge polarity of the recording medium, and a ground member for grounding the first image support is provided further downstream in the movement direction of the first image support than said application member.

33. The image forming apparatus according to claim 32, wherein the diameter of the support roller constituting the application member is set to 20 mm or less.

34. An image forming apparatus for recording images on both sides of a recording medium, comprising:

an image support; and first and second intermediate transfer members, a visualized image temporarily transferred from the image support via the first intermediate transfer member onto the second intermediate transfer member being transferred from the second intermediate transfer member onto one side of a recording medium, and a visualized image transferred from the image support onto the first intermediate transfer member being transferred from the first intermediate transfer member onto the other side of the recording medium, a first transfer roller for transferring the visualized image on the first intermediate transfer member onto one side of the recording medium or the second intermediate transfer member being disposed inside the first intermediate transfer member or second intermediate transfer member, and a second transfer roller for transferring the visualized image on the second intermediate transfer member onto the other side of the recording medium being disposed inside the first intermediate transfer member or second intermediate transfer member, first and second opposing rollers being disposed sandwiching the first and second intermediate transfer members and in pressure contact facing the respective transfer rollers, and an elastic layer with a thickness of 5 mm or less being provided on the top layer of each of the transfer rollers, the hardness of said transfer rollers being no more than 50 degrees as JIS-A hardness, and the hardness of said transfer rollers being lower than the hardness of the opposing rollers.

35. The image forming apparatus according to claim 34, wherein the material of the transfer roller elastic layer is a rubber or resin elastomer whose resistance has been controlled with an electron conductor.

36. The image forming apparatus according to claim 34, wherein the respective transfer rollers and their opposing rollers are pressed together by pressure from the transfer roller side.

37. The image forming apparatus according to claim 36, wherein pressure force is exerted on the roller shaft, or the bearing thereof, of each transfer roller.

38. The image forming apparatus according to claim 34, wherein the respective transfer rollers are larger in diameter than their opposing rollers, and the ratio of the roller diameters is 2 or less.

39. The image forming apparatus according to claim 34, wherein the charge applied to the first transfer roller is of the same polarity as the charge applied to the second transfer roller, and of the opposite polarity from that of the toner.

40. The image forming apparatus according to claim 34, wherein the charge applied to the first transfer roller is of the same polarity as the charge applied to the second transfer roller, and of the same polarity as that of the toner.

41. The image forming apparatus according to claim 34, wherein the respective opposing rollers are electroconductive rollers, and either said electroconductive rollers are grounded or a charge is applied of a polarity opposite that of the charge applied to the opposing transfer rollers.

42. The image forming apparatus according to claim 41, wherein the transfer rollers are low-resistance rollers with a resistance of $10^9$ Ω·cm or less.

43. The image forming apparatus according to claim 34, wherein the opposing rollers are low-resistance rollers with a resistance of $10^9$ Ω·cm or less.

44. The image forming apparatus according to claim 34, wherein the toner used in said image forming apparatus is a spherical toner with an average sphericity of at least 0.95.

45. The image forming apparatus according to claim 34, wherein the toner used in said image forming apparatus has a volume average diameter of 4 to 9 μm, and a ratio of volume average diameter/number average diameter of 1 to 1.5.

46. The image forming apparatus according to claim 34, wherein the toner used in said image forming apparatus has a cohesion of 10% or less.

47. The image forming apparatus according to claim 34, wherein the toner used in said image forming apparatus contains no more than 20% wax component in its binder resin.

48. The image forming apparatus according to claim 34, wherein the toner used in said image forming apparatus contains no more than 2 wt % fine abrasive component on its particle surfaces.

49. An image forming apparatus for recording images on both sides of a recording medium, comprising:

an image support; and first and second intermediate transfer members onto which a visualized image is transferred from said image support, the visualized images supported on each of the first and second intermediate transfer members being transferred to the respective sides of a recording medium, a first transfer roller that transfers the visualized image on the first intermediate transfer member onto one side of the recording medium being disposed inside the first intermediate transfer member or the second intermediate transfer member, and a second transfer roller that transfers the visualized image on the second intermediate transfer member onto the other side of the recording medium being disposed inside the second intermediate transfer member or the first intermediate transfer member, first and second opposing rollers being disposed sandwiching the first and second intermediate transfer members and in pressure contact facing the respective transfer rollers, and an elastic layer with a thickness of 5 mm or less being provided on the top layer of each of the transfer rollers, the hardness of said transfer rollers being no more than 50 degrees as JIS-A hardness, and the hardness of said transfer rollers being lower than the hardness of the opposing rollers.

50. The image forming apparatus according to claim 49, wherein the material of the transfer roller elastic layer is a rubber or resin elastomer whose resistance has been controlled with an electron conductor.

51. The image forming apparatus according to claim 49, wherein the transfer rollers and their opposing rollers are pressed together by pressure from the transfer roller side.

52. The image forming apparatus according to claim 51, wherein pressure force is exerted on the roller shaft, or the bearing thereof, of each transfer roller.

53. The image forming apparatus according to claim 49, wherein the transfer rollers are larger in diameter than their opposing rollers, and the ratio of the roller diameters is 2 or less.

54. The image forming apparatus according to claim 49, wherein the charge applied to the first transfer roller is of the same polarity as the charge applied to the second transfer roller, and of the opposite polarity from that of the toner.

55. The image forming apparatus according to claim 49, wherein the charge applied to the first transfer roller is of the same polarity as the charge applied to the second transfer roller, and of the same polarity as that of the toner.

56. The image forming apparatus according to claim 49, wherein the opposing rollers are electroconductive rollers, and either said electroconductive rollers are grounded or a charge is applied of a polarity opposite that of the charge applied to the opposing transfer rollers.

57. The image forming apparatus according to claim 56, wherein the transfer rollers are low-resistance rollers with a resistance of $10^9$ Ω·cm or less.

58. The image forming apparatus according to claim 49, wherein the opposing rollers are low-resistance rollers with a resistance of $10^9$ Ω·cm or less.

59. The image forming apparatus according to claim 49, wherein the toner used in said image forming apparatus is a spherical toner with an average sphericity of at least 0.95.

60. The image forming apparatus according to claim 49, wherein the toner used in said image forming apparatus has a volume average diameter of 4 to 9 μm, and a ratio of volume average diameter/number average diameter of 1 to 1.5.

61. The image forming apparatus according to claim 49, wherein the toner used in said image forming apparatus has a cohesion of 10% or less.

62. The image forming apparatus according to claim 49, wherein the toner used in said image forming apparatus contains no more than 20% wax component in its binder resin.

63. The image forming apparatus according to claim 49, wherein the toner used in said image forming apparatus contains no more than 2 wt % fine abrasive component on its particle surfaces.

* * * * *